US005212334A

United States Patent [19]

Smith, III

[11] Patent Number: 5,212,334

[45] Date of Patent: May 18, 1993

[54] DIGITAL SIGNAL PROCESSING USING CLOSED WAVEGUIDE NETWORKS

[75] Inventor: Julius O. Smith, III, Palo Alto, Calif.

[73] Assignee: Yamaha Corporation, Hamamatsu, Japan

[21] Appl. No.: 568,609

[22] Filed: Aug. 16, 1990

Related U.S. Application Data

[60] Division of Ser. No. 414,646, Sep. 27, 1989, Pat. No. 4,984,276, which is a continuation of Ser. No. 275,620, Nov. 14, 1988, abandoned, which is a continuation of Ser. No. 920,701, Oct. 17, 1986, abandoned, which is a continuation-in-part of Ser. No. 859,868, May 2, 1986, abandoned.

[51] Int. Cl.[5] ..... G10H 1/02; G10H 1/12; G10H 1/46

[52] U.S. Cl. ..... 84/622; 84/629; 84/633; 84/DIG. 9; 84/DIG. 10

[58] Field of Search ..... 84/622-625, 84/629, 630, 633, 648, 661-665, 675-677, 699, 700, 707, 736-741, DIG. 9, DIG. 10, DIG. 11, DIG. 26

[56] References Cited

U.S. PATENT DOCUMENTS

| | | | |
|---|---|---|---|
| Re. 31,004 | 8/1982 | Niimi . | |
| 3,347,973 | 10/1967 | Freeman | 84/675 X |
| 3,838,202 | 9/1974 | Nakada . | |
| 4,130,043 | 12/1978 | Niimi . | |
| 4,475,229 | 10/1984 | Frese . | |
| 4,508,000 | 4/1985 | Suzuki | 84/675 X |
| 4,548,119 | 10/1985 | Wachi et al. | 84/DIG. 9 |
| 4,554,858 | 11/1985 | Wachi et al. | 84/DIG. 9 |
| 4,622,877 | 11/1986 | Strong . | |
| 4,633,500 | 12/1986 | Yamada et al. | 381/51 |
| 4,649,783 | 3/1987 | Strong et al. . | |

FOREIGN PATENT DOCUMENTS

| | | |
|---|---|---|
| 58-48109 | 10/1983 | Japan . |
| 58-58678 | 12/1983 | Japan . |
| 59-7396 | 2/1984 | Japan . |
| 59-19353 | 5/1984 | Japan . |
| 59-19354 | 5/1984 | Japan . |

OTHER PUBLICATIONS

"Piano Tone Synthesis by Computer Simulation-Digital Filter Method" by Isao Nakamura, Junichiro Yamaguchi, Apr. 1977.

"Extended Application of Digital Filter Method to Plural Strings" by Isao Nakamura, Hironobu Takagi, Oct. 1981.

"Elimination of Limit Cycles and Overflow Oscillations in Time-Varying Lattice and Ladder Digital Filters", by Julius O. Smith, CCRMA, Dept. of Music, Stanford University.

"Waveguide Digital Filters", by Julius O. Smith, CCRMA, Dept. of Music, Stanford University.

"New Approach to Digital Reverberation using Closed Waveguide Networks", by Julius O. Smith, CCRMA, Dept. of Music, Stanford University.

"Functional Model of a Simplified Clarinet", by Stephen E. Stewart, et al., Department of Physics and Astronomy, Brigham Young University, accepted for publication Apr. 5, 1980, pp. 109-120.

"Self-Sustained Oscillations of the Clarinet: An Integral Equation Approach" by R. T. Schumacher, Dept. of Physics, Carnegie-Mellon University, pp. 298-309.

(List continued on next page.)

*Primary Examiner*—Stanley J. Witkowski

*Attorney, Agent, or Firm*—Graham & James

[57] ABSTRACT

A tone generation system includes one or more digital waveguide networks coupled to one or more junctions, one of which receives a control signal for controlling tone generation. The control signal initiates and interacts with a wave signal propagating through the waveguide networks to form a tone signal. A non-linear junction may be employed which receives a signal from a waveguide, converts it in accordance with a non-linear function based upon the value of the control signal and provides it back to the waveguide. A tone signal whose pitch is determined by the wave transmission characteristics of the waveguide network is thereby produced.

61 Claims, 7 Drawing Sheets

OTHER PUBLICATIONS

"Self-Sustained Oscillations of the Bowed String". by R. T. Schumacher, Dept. of Physics, Carnegie-Mellon University, pp. 111-120.

"On the Fundamentals of Bowed-String Dynamics", by M. E. McIntyre and J. Woodhouse, Department of Applied Mathematics and Theoretical Physics, University of Cambridge, vol. 43, No. 2, 1979, pp. 93-108.

"Air Flow and Sound Generation in Musical Wind Instruments", by N. H. Fletcher, Dept. of Physics, University of New England, 1979, pp. 123-146.

"Mechanism of Self-excited Feedback Oscillation in Clarinet", by Jun-ichi Saneyoshi, Tamagawa University.

"Regeneration in Brass Wind Instruments", by S. J. Elliott and J. M. Bowsher, Dept. of Physics, University of Surrey, Journal of Sound and Vibration, 1982 pp. 181-217.

"Synthesis of Bowed Strings", by Julius Orion Smith III, CCRMA, Dept. of Music, Stanford University.

"Techniques for Digital Filter Design and System Identification with Application to the Violin", by Julius O. Smith III, Stanford University, Jun., 1983.

"On the Oscillations of Musical Instruments", by M. E. McIntyre Dept. of Applied Mathematics and Theoretical Physics, University of Cambridge, R. T. Schumacher, Dept. of Physics, Carnegie-Mellen University and J. Woodhouse, Topexpress Ltd., publised 1983. pp. 1325-1345.

"Extensions of the Karplus-Strong Plucked-String Algorithm", by David A. Jaffe and Julius O. Smith, CCRMA, Stanford University, Computer Music Journal, vol. 7, No. 2, 1983, pp. 56-69.

"Digital Synthesis of Plucked-String and Drum Timbres", by Kevin Karplus, Computer Science Dept., Cornell University and Alex Strong, Computer Science Dept., Stanford University, Computer Music Journal, vol. 7, No. 2, 1983, pp. 43-55.

"A VLSI Approach To Sound Synthesis", by John Wawrzynek, et al. ICMI '84 Proceedings, pp. 53-64.

DIGITAL SIGNAL PROCESSING USING CLOSED WAVEGUIDE NETWORKS

CROSS-REFERENCE TO RELATED APPLICATION

This is a division of application Ser. No. 07/414,646, now U.S. Pat. No. 4,984,276 filed on Sep. 27, 1989, which is a continuation of application Ser. No. 07/275,620, filed Nov. 14, 1988, abandoned, which is a continuation of application Ser. No. 06/920,701, filed Oct. 17, 1986, abandoned, which is a continuation-in-part of application Ser. No. 06/859,868, filed May 2, 1986, abandoned.

BACKGROUND OF THE INVENTION

This invention relates to the field of digital signal processing and particularly to signal processing useful in digital music synthesis and other applications.

Digital music synthesis has attracted increased interest as data processors have undergone new developments which provide increased performance capabilities. Digital music synthesis has many applications such as the synthesis of stringed, reed and other instruments and such as the synthesis of reverberation.

In actual practice, it has been difficult to provide satisfactory models of music instruments, based upon quantitative physical models, which can be practically synthesized on a real-time basis using present-day computers and digital circuitry.

Most traditional musical instruments such as woodwinds and strings, have been simulated by additive synthesis which consists of summing together sinusoidal harmonics of appropriate amplitude, or equivalently by repeatedly reading from a table consisting of one period of a tone (scaled by an "amplitude function") to "play a note." Another method consists of digitally sampling a real musical sound, storing the samples in digital memory, and thereafter playing back the samples under digital control. FM synthesis as described, for example, in U.S. Pat. No. 4,018,121, has also been successful in synthesizing many musical sounds including brasses, woodwinds, bells, gongs, and some strings. A few instruments have been simulated by "subtractive synthesis" which shapes the spectrum of primitive input signals using digital filters.

All of the foregoing methods (with the occasional exception of subtractive synthesis) have the disadvantage of not being closely related to the underlying physics of sound production. Physically accurate simulations are expensive to compute when general finite-element modeling techniques are used.

In accordance with the above background, there is a need for techniques for synthesizing strings, winds, and other musical instruments including reverberators in a manner which is both physically meaningful and computationally efficient. There is a need for the achievement of natural and expressive computer-controlled performance in ways which are readily comprehensible and easy to use.

SUMMARY OF THE INVENTION

The present invention is a signal processor formed using digital waveguide networks. The digital waveguide networks have signal scattering junctions. A junction connects two waveguide sections together or terminates a waveguide. The junctions are constructed from conventional digital components such as multipliers, adders, and delay elements. The number of multiplies and additions determines the number of signal-scattering junctions that can be implemented in the waveguide network, and the number of delays determines the total delay which can be distributed among the waveguides interconnecting the junctions in the waveguide network. The signal processor of the present invention is typically used for for synthesis of reed, string or other instruments.

The waveguides of the present invention include a first rail for conducting signals from stage to stage in one direction and a second rail for conducting signals from stage to stage in the opposite direction. The accumulated delay along the first rail is substantially equal to the accumulated delay along the second rail so that the waveguide is balanced. The first rail is connected to the second rail at junctions so that signals conducted by one rail are also conducted in part by the other rail.

Lossless waveguides used in the present invention are bi-directional delay lines which sometimes include embedded allpass filters. Losses are introduced as pure attenuation or lowpass filtering in one or both directions.

The signal processor in some applications includes a non-linear junction connected to provide an input signal to the first rail of the waveguide and to receive an output signal from the second rail of the waveguide. The non-linear junction in some embodiments receives a control variable for controlling the non-linear junction and the signals to and from the waveguide.

In one embodiment, a reed instrument is synthesize a non-linear junction terminating a digital waveguide. A primary control variable, representing mouth pressure, is input to the non-linear junction (also controlled secondarily by embouchure variables). The junction simulates the reed while the digital waveguide simulates the bore of the reed instrument.

In another embodiment, a string instrument is synthesized. A primary control variable, representing the bow velocity, is input to the non-linear junction. The non-linear junction represents the bow-string interface (including secondary controls such as bow force, bow angle, bow position, and friction characteristics). In the stringed instrument embodiment, two digital lossless waveguides are connected to the non-linear junction. The first waveguide represents the long string portion (from the bow to the nut) and the other waveguide simulates the short string portion (from the bow to the bridge). A series of waveguides can also be used to implement the body of, for example, a violin, although in such a case there is normally no direct physical interpretation of the waveguide variables.

In particular embodiments, the reflection signal or signal coefficients introduced into the waveguides from the nonlinear junction are obtained from a table. In one embodiment, the nonlinearity to be introduced into the waveguides is $f(x)$ where $x$ is the table address and also the incoming signal sample in the waveguide (a travelling wave sample). In another embodiment, the values $g(x)=f(x)/x$ are stored in the table and the table is addressed by $x$. Each value of $g(x)$ addressed by $x$ from the compressed table (where $g(x)$ is called a coefficient) is then multiplied by $x$, $x*g(x)$ which thereby produces the desired value of $f(x)$.

In accordance with the above summary, the present invention captures the musically important qualities of natural instruments in digital music synthesis with digital processing techniques employing digital waveguides which are computationally efficient and therefore capable of inexpensive real-time operation.

The foregoing and other objects, features and advantages of the invention will be apparent from the following detailed description in conjunction with the drawings.

DETAILED DESCRIPTION

Figure 1:
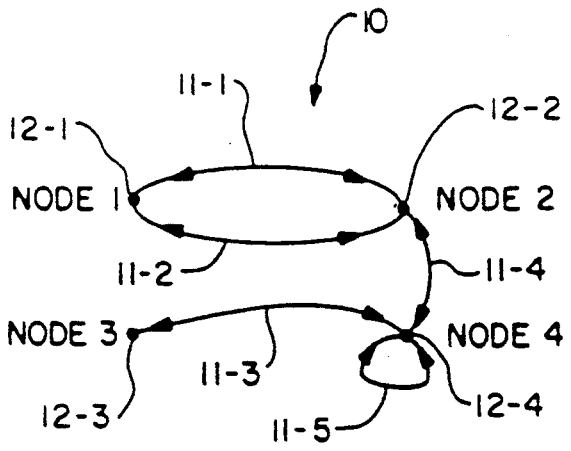
FIG. 1 depicts a simple closed waveguide network.

Lossless Networks—FIG. 1

In FIG. 1 a network 10 is a closed interconnection of bi-directional signal paths 11. The signal paths 11 are called branches or waveguides, designated 11-1, 11-2, 11-3, 11-4, and 11-5 and the interconnection points are called nodes or junctions, designated 12-1, 12-2, 12-3, and 12-4. An example of a simple network is shown in FIG. 1 where each signal path is bi-directional, meaning that in each waveguide there is a signal propagating in one direction and an independent signal propagating in the other direction. When a signal reaches a junction, one component is partially reflected back along the same waveguide, and other components are partially transmitted into the other waveguides connected to the junction. The relative strengths of the components of the transmitted or "scattered" signals at each junction are determined by the relative characteristic impedances of the waveguides at the junction. In FIG. 1, the waveguides 11 intersect at the junctions 12.

A lossless waveguide, such as each of the waveguides in FIG. 1, is defined specifically as a lossless bi-directional signal branch. In the simplest case, each branch or waveguide 11 in a waveguide network 10 is merely a bi-directional delay line. The only computations in the network take place at the branch intersection points (nodes or junctions). More generally, a lossless waveguide branch may contain a chain of cascaded allpass filters. For practical reverberator and other designs, losses are introduced in the form of factors less than 1 and/or low pass filters with a frequency response strictly bounded above by 1 in magnitude.

A closed lossless network preserves total stored signal energy. Energy is preserved if, at each time instant, the total energy stored in the network is the same as at any other time instant. The total energy at any time instant is found by summing the instantaneous power throughout the network waveguides 11. Each signal sample within the network contributes to instantaneous power. The instantaneous power of a stored sample is the squared amplitude times a scale factor, g. If the signal is in units of "pressure", "force", or equivalent, then $g=1/Z$, where Z is the characteristic impedance of the waveguide 11 medium. If the signal sample instead represents a "flow" variable, such as volume-velocity, then $g=Z$. In either case, the stored energy is a weighted sum of squared values of all samples stored in the digital network 10.

Figure 2:
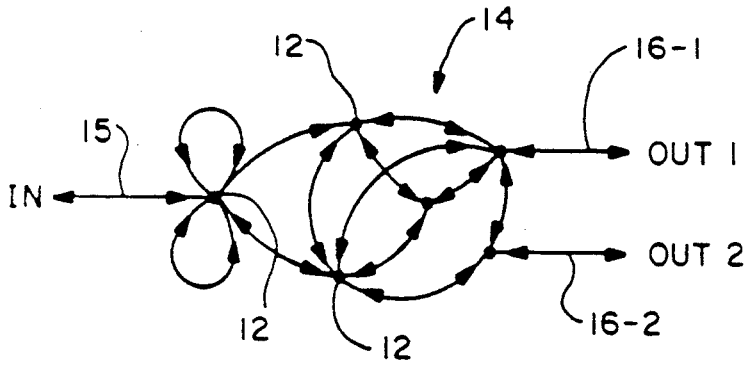
FIG. 2 depicts a 3-port waveguide network.

N-Port Network—FIG. 2

In FIG. 2, an N-port network 14 is shown in which for $N=3$, three waveguides, called ports, leave the network with one port 15 designated for input and two ports 16-1 and 16-2 designated for output. Such a structure is suitable, for example, for providing stereo reverberation of a single channel of sound. Note, however, that really in FIG. 2 there are three inputs(15, 16-1, 16-2) and three outputs (15, 16-1, 16-2) because in an N-port, each waveguide connected to the network provides both an input and an output since each waveguide is bi-directional.

An N-port network 14 of FIG. 2 is lossless if at any time instant, the energy lost through the outputs, equals the total energy supplied through the inputs, plus the total stored energy. A lossless digital filter is obtained from a lossless N-port by using every port as both an input and an output. This filter is the general multi-input, multi-output allpass filter.

An N-port network 14 is linear if superposition holds. Superposition holds when the output in response to the sum of two input signals equals the sum of the outputs in response to each individual input signal. A network is linear if every N-port derived from it is linear. Only linear networks can be restricted to a large and well-understood class of energy conserving systems.

Figure 3:
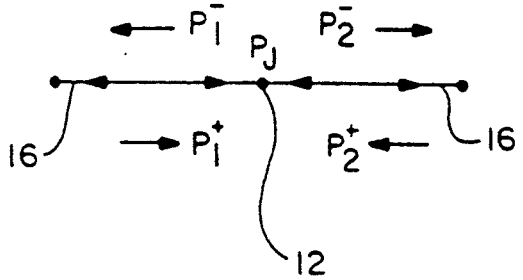
FIG. 3 depicts a junction of two waveguides.

Lossless Scattering—FIG. 3

Consider a parallel junction of N lossless waveguides of characteristic impedance $Z_i$ (characteristic admittance $\Gamma_i=1/Z_i$) as depicted in FIG. 3 for $N=2$.

If in FIG. 3 the incoming traveling pressure waves are denoted by $P_i^+$, where $i=1, \ldots, N$, the outgoing pressure waves are given by Eq.(1) as follows:

$$P_i^- = P_j - P_i^+ \qquad \text{Eq.(1)}$$

where P in Eq.(1) is the resultant junction pressure given as follows:

$$P_j = \sum_{i=1}^{N} \alpha_i P_i^+ \qquad \text{Eqs. (2)}$$

$$\text{where } \alpha_i = (2\Gamma_i)/\left(\sum_{l=1}^{N} \Gamma_l\right)$$

For N=2, $$P_j = \alpha_1 P_1^+ + \alpha_2 P_2^+$$

$$\alpha_1 = (2\Gamma_1)/(\Gamma_1 + \Gamma_2)$$

$$\alpha_2 = 2 - \beta_1$$

Define the reflection coefficient by $k = \alpha_1 - 1$, then from Eq. 1, $$P_1^- = P_j - P_1^+ = (\alpha_1 - 1)P_1^+ + \alpha_2 P_2^-$$

$$P_1^- = kP_1^+ + (1-k)P_2^+$$

$$P_2^- = \alpha_1 P_1^+ + (\alpha_2 - 1)P_2^+$$

$$P_2^- = (k+1)P_1^+ - kp_2^+$$

Thus, we have, for N=2, $$P_1^- = P_2^+ + k(P_1^+ - P_2^+)$$

$$P_2^- = P_1^+ + k(P_1^+ - P_2^+) \qquad \text{Eqs. (3)}$$

which is the one-multiplier lattice filter section (minus its unit delay). More generally, an N-way intersection requires N multiplies and N-1 additions to obtain $P_j$, and one addition for each outgoing wave, for a total of N multiplies and 2N−1 additions.

The series flow-junction is equivalent to the parallel pressure-junction. The series pressure-junction or the parallel flow-junction can be found by use of duality.

Figure 4:
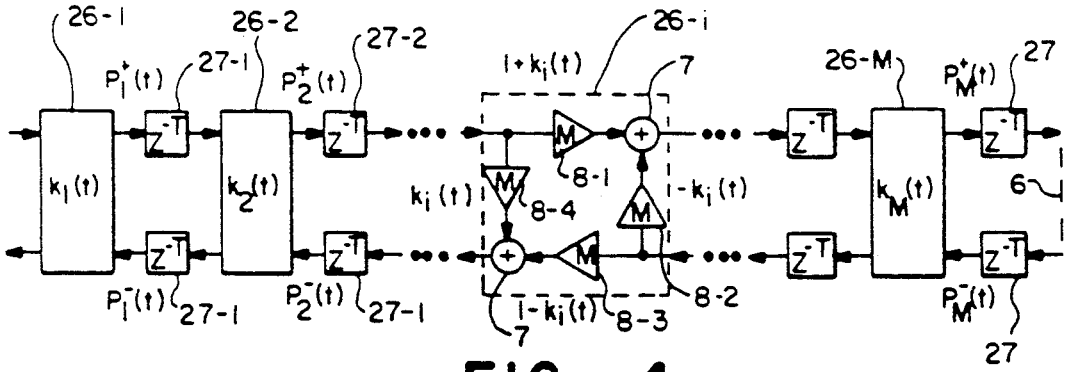
FIG. 4 depicts a cascade waveguide network in accordance with the present invention.

Cascade Waveguide Chains—FIG. 4

The basic waveguide chain 25 is shown in FIG. 4. Each junction 26-1, 26-2, . . . , 26-i, . . . , 26-M enclosing the symbol $k_i(t)$ denotes a scattering junction characterized by $k_i(t)$. In FIG. 4, the junction 26-i typically utilizes multipliers (M) 8 and adders(+) 7 to form the junction. In FIG. 4, the multipliers 8-1, 8-2, 8-3 and 8-4 multiply by the factors $[1+k(i)]$, $[-k_i(t)]$, $[1-k_i(t)]$, and $[k_i(t)]$, respectively. An alternative junction implementation 26'-i of FIG. 13 requires only one multiply. The junction 26-2 in FIG. 4 corresponds, for example, to the junction 12 in FIG. 3. Similarly, the delays 27-1 and 27-2 in FIG. 4 correspond to the branches 15 and 16, respectively, in FIG. 3. The Kelly-Lochbaum junctions 26-i and one-multiply junction 26'-i (see FIG. 13) or any other type of lossless junction may be used for junction 26. In particular, the two-multiply lattice (not shown) and normalized ladder (FIG. 11) scattering junctions can be employed. The waveguide 25 employs delays 27 between each scattering junction 26 along both the top and bottom signal paths, unlike conventional ladder and lattice filters. Note that the junction 26-i of FIG. 4 employs four multipliers and two adds while junction 26'-i of FIG. 13 employs one multiply and three adds.

Waveguide Variations—FIGS. 4–14

Reduction of junction 26 to other forms is merely a matter of pushing delays 27 along the top rail around to the bottom rail, so that each bottom-rail delay becomes 2T seconds ($Z^{-2T}$) instead of T seconds $Z^{-T}$. Such an operation is possible because of the termination at the right by an infinite (or zero) characteristic impedance 6 in FIG. 4. In the time-varying case, pushing a delay through a multiply results in a corresponding time advance of the multiplier coefficient.

Figure 5:
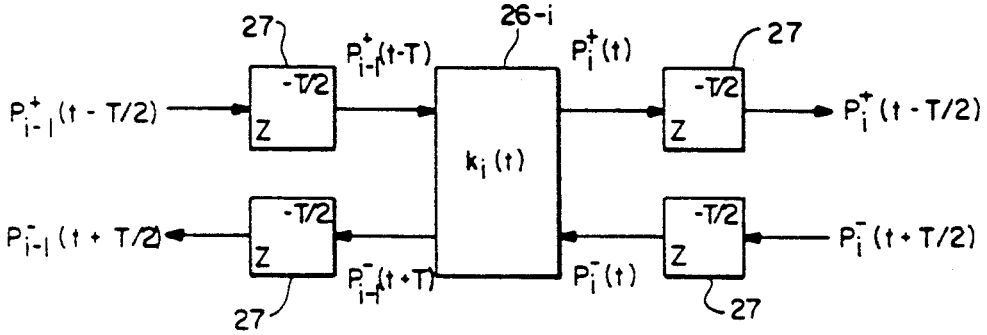
FIG. 5 depicts one embodiment of a cascade waveguide network section.

Imagine each delay element 27 in FIG. 4 being divided into halves, denoted by a delay of T/2 seconds. Then any waveguide can be built from sections such as shown in FIG. 5.

By a series of transformations, the two input-signal delays are pushed through the junction to the two output delays. A similar sequence of moves pushes the two output delays into the two input branches. Consequently, we can replace any waveguide section of the form shown in FIG. 5 by a section of the form shown in FIG. 6 or FIG. 7.

Figure 6:
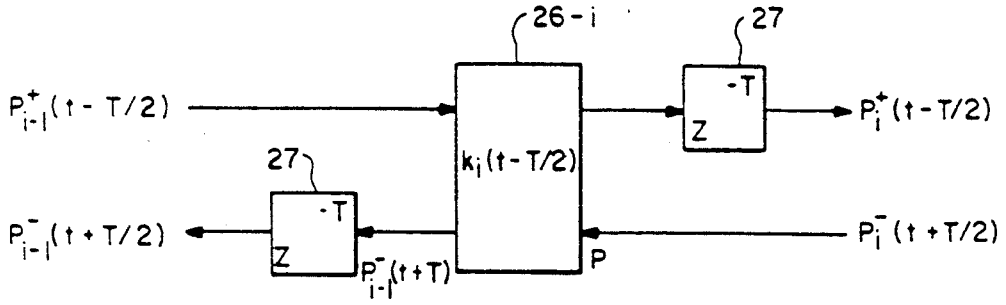
FIG. 6 depicts another embodiment of a cascade waveguide network section.
Figure 7:
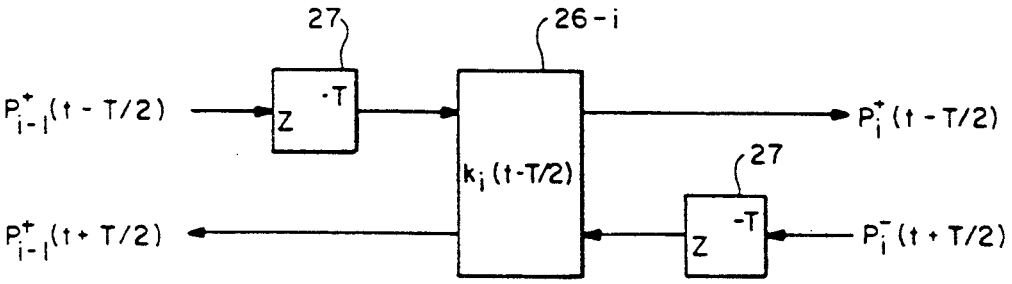
FIG. 7 depicts a third embodiment of a cascade waveguide network section.
Figure 8:
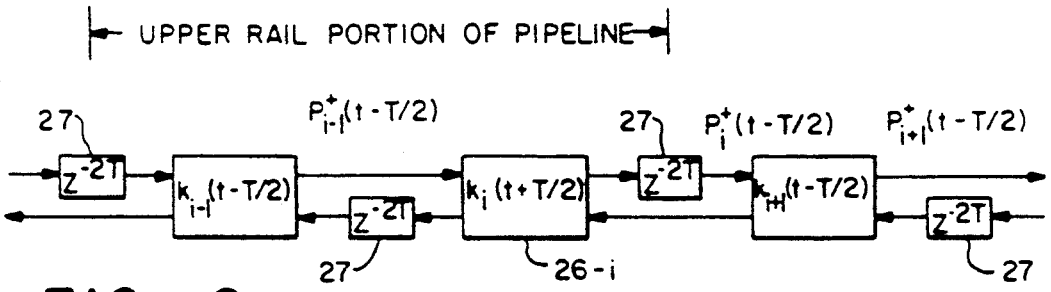
FIG. 8 depicts a pipelined embodiment of a waveguide filter.

By alternately choosing the structure of FIG. 6 and 7, the structure of FIG. 8 is obtained. This structure has some advantages worth considering: (1) it consolidates delays to length 2T as do conventional lattice/ladder structures, (2) it does not require a termination by an infinite characteristic impedance, allowing it to be extended to networks of arbitrary topology (e.g., multiport branching, intersection, and looping), and (3) there is no long delay-free signal path along the upper rail as in conventional structures—a pipeline segment is only two sections long. This structure, termed the "half-rate waveguide filter", appears to have better overall characteristics than any other digital filter structure for many applications. Advantage (2) makes it especially valuable for modeling physical systems.

Finally, successive substitutions of the section of FIG. 6 and reapplication of the delay consolidation transformation lead to the conventional ladder or lattice filter structure. The termination at the right by a total reflection (shown as 6 in FIG. 4) is required to obtain this structure. Consequently, conventional lattice filters cannot be extended on the right in a physically meaningful way. Also, creating network topologies more complex than a simple series (or acyclic tree) of waveguide sections is not immediately possible because of the delay-free path along the top rail. For example, the output of a conventional structure cannot be fed back to the input.

Energy and Power

The instantaneous power in a waveguide containing instantaneous pressure P and flow U is defined as the product of pressure and flow as follows:

$$\underline{P} = PU = (P^+ + P^-)(U^+ + U^-) = \underline{P}^+ + \underline{P}^- \qquad \text{Eq.(4)}$$

where, $$\underline{P}^+ = P^+U^+ = Z(U^+)^2 = \Gamma(P^+)^2$$

$$\underline{P}^- = P^-U^- = -Z(U^-)^2 = -\Gamma(P^-)^2 \qquad \text{Eqs.(5)}$$

define the right-going and left-going power, respectively.

For the N-way waveguide junction, we have, using Kirchoff's node equations, Eq.(6) as follows:

$$\underline{P}_j \triangleq \sum_{i=1}^{N} P_i U_i = \sum_{i=1}^{N} P_j U_i = P_j \sum_{i=1}^{N} U_i = 0 \qquad \text{Eq. (6)}$$

Thus, the N-way junction is lossless; no net power, active or reactive, flows into or away from the junction.

Quantization Effects

While the ideal waveguide junction is lossless, finite digital wordlength effects can make exactly lossless networks unrealizable. In fixed-point arithmetic, the product of two numbers requires more bits (in general) for exact representation than either of the multiplicands. If there is a feedback loop around a product, the number of bits needed to represent exactly a circulating signal grows without bound. Therefore, some round-off rule must be included in a finite-precision implementation. The guaranteed absence of limit cycles and overflow oscillations is tantamount to ensuring that all finite-wordlength effects result in power absorption at each junction, and never power creation. If magnitude truncation is used on all outgoing waves, then limit cycles and overflow oscillations are suppressed. Magnitude truncation results in greater losses than necessary to suppress quantization effects. More refined schemes are possible. In particular, by saving and accumulating the low-order half of each multiply at a junction, energy can be exactly preserved in spite of finite precision computations.

Signal Power in Time-Varying Waveguides

The convention is adopted that the time variation of the characteristic impedance does not alter the traveling pressure waves $P_i^{\pm}$. In this case, the power represented by a traveling pressure wave is modulated by the changing characteristic impedance as it propagates. The actual power becomes inversely proportional to characteristic impedance:

$$\underline{P}_i(x,t) = \underline{P}_i^+(x,t) + \underline{P}_i^-(x,t) = \frac{[P_i^+(x,t)]^2 - [P_i^-(x,t)]^2}{Z_i(t)} \qquad \text{Eq. (7)}$$

This power modulation causes no difficulties in the Lyapunov theory which proves absence of limit cycles and overflow oscillations because it occurs identically in both the finite-precision and infinite-precision filters. However, in some applications it may be desirable to compensate for the power modulation so that changes in the characteristic impedances of the waveguides do not affect the power of the signals propagating within.

Figure 9:
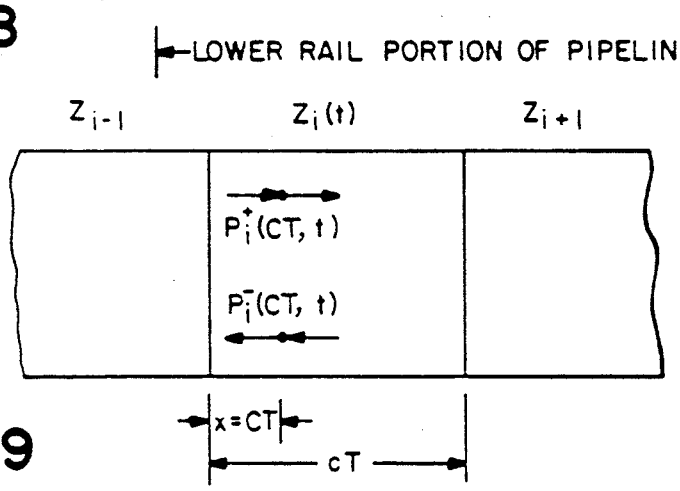
FIG. 9 depicts a travelling pressure wave at a general point within a waveguide section.

Consider an arbitrary point in the $i^{th}$ waveguide at time t and distance $x=c\tau$ measured from the left boundary, as shown in FIG. 9. The right-going pressure is $P_i^+(x,t)$ and the left-going pressure is $P_i^-(x,t)$. In the absence of scaling, the waveguide section behaves (according to our definition of the propagation medium properties) as a pressure delay line, and we have $P_i^+(x,t)=P_i^+(0,t-\tau)$ $P_i^-(x,t)=P_i^-(0,t+\tau)$(-$=P_i^-(cT,t-T+\tau)$. The left-going and right-going going components of the signal power are $[P_i^-(x,t)]^2/Z_i(t)$ and $[P_i^+(x,t)]^2/Z_i(t)$, respectively.

Below, three methods are discussed for making signal power invariant with respect to time-varying branch impedances.

Normalized Waveguides

Suppose the traveling waves are scaled as the characteristic impedance changes in order to hold signal power fixed. Any level can be chosen as a reference, but perhaps it is most natural to fix the power of each wave to that which it had upon entry to the section. In this case, it is quickly verified that the proper scaling is:

$$\bar{P}_i^+(x,t)=[(Z_i(t))/(Z_i(t-\tau))]^{\frac{1}{2}}P_i^+(0,t-\tau),\ x=c\tau \qquad \text{Eqs.(8)}$$

$$\bar{P}_i^-(x,t)=[(Z_i(t))/(Z_i(t-T+\tau))]^{\frac{1}{2}}P_i^-(cT,t-T+\tau)$$

In practice, there is no need to perform the scaling until the signal actually reaches a junction. Thus, we implement $$\bar{P}_i^+(Ct,t)=g_i(t)P_i^+(0,t-T) \qquad \text{Eqs.(9)}$$

$$\bar{P}_i^-(0,t)=g_i(t)P_i^-(Ct,t-T)$$

where $$g_i(t)=[(Z_i(t))/(Z_i(t-T))]^{\frac{1}{2}}$$

Figure 10:
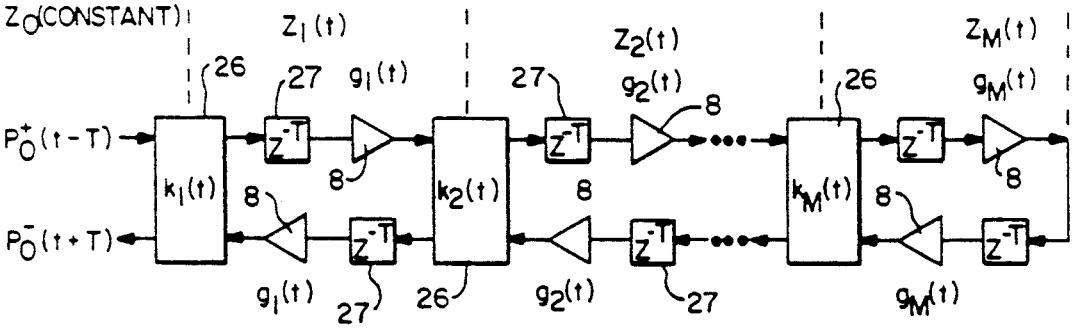
FIG. 10 depicts a normalized-waveguide digital filter.

This normalization is depicted in FIG. 10. In FIG. 10, each of the multipliers 8 multiplies the signal by $g_i(t)$ as given by Eqs.(9). In the single-argument notation used earlier, Eqs.(9) become $$\bar{P}_i^+(t-T)=g_i(t)P_i^+(t-T) \qquad \text{Eqs.(10)}$$

$$\bar{P}_i^-(t)=g_i(t)P_i^-(t)$$

This normalization strategy has the property that the time-varying waveguides (as well as the junctions) conserve signal power. If the scattering junctions are implemented with one-multiply structures, then the number of multiplies per section rises to three when power is normalized. There are three additions as in the unnormalized case. In some situations (such as in the two-stage structure) it may be acceptable to normalize at fewer points; the normalizing multiplies can be pushed through the scattering junctions and combined with other normalizing multiplies, much in the same way delays were pushed through the junctions to obtain standard ladder/lattice forms. In physical modeling applications, normalizations can be limited to opposite ends of a long cascade of sections with no interior output "taps."

To ensure passivity of a normalized-waveguide with finite-precision calculations, it suffices to perform magnitude truncation after multiplication by $g_i(t)$. Alternatively, extended precision can be used within the scattering junction.

Normalized Waves

Another approach to normalization is to propagate rms-normalized waves in the waveguide. In this case, each delay-line contains $$\bar{P}_i^+(x,t)=P_i^+(x,t)/[Z_i(t)]^{\frac{1}{2}} \qquad \text{Eqs.(11)}$$

$$\bar{P}_i^-(x,t)=P_i^-(x,t)/[Z_i(t)]^{\frac{1}{2}}$$

We now consider $P^{\pm}$(instead of $P^{\pm}$) to be invariant with respect to the characteristic impedance. In this case, $$\bar{P}_i^+(c,t)=P_i^+(cT,t)/[Z_i(t)]^{\frac{1}{2}}=P_i^+(0,t-T)/[Z_i(t-T)]^{\frac{1}{2}}=\bar{P}_i^+(t-T)$$

The scattering equations become $$[Z_i(t)]^{\frac{1}{2}}\,\bar{P}_i^+(0,t)= \qquad \text{Eqs. (12)}$$

$$[1+k_i(t)]\,[Z_{i-1}(t)]^{\frac{1}{2}}\,\bar{P}_{i-1}^+(cT,t)-k_i(t)\,[Z_i(t)]^{\frac{1}{2}}\,\bar{P}_i(0,t)$$

$$[Z_{i-1}(t)]^{\frac{1}{2}}\bar{P}_{i-1}^-(cT,t)=k_i(t)[Z_{i-1}(t)]^{\frac{1}{2}}\bar{P}_{i-1}^+(ct,T)+[1-k_i(t)][Z_i(t)]^{\frac{1}{2}}\bar{P}_i^-(t)$$

or, solving for $\bar{P}_i^{\pm}$, $$\bar{P}_i^+(0,t)= \qquad \text{Eqs. (13)}$$

$$[1+k_i(t)]\,[(Z_{i-1}(t))/(Z_i(t))]^{\frac{1}{2}}\,\bar{P}_{i-1}^+(cT,t)-k_i(t)\,\bar{P}_i^-(0,t)$$

$$\bar{P}_{i-1}^-(cT,t)=k_i(t)\bar{P}_{i-1}^+(ct,T-+[1-k_i(t)][(Z_i(t))/(Z_{i-1}(t))]^{\frac{1}{2}}\bar{P}_i^-(t)$$

But, $$(Z_{i-1}(t))/(Z_i(t))=(1-k_i(t))/(1+k_1(t)) \qquad \text{Eq.(14)}$$

whence $$[1+k_i(t)][(Z_{i-1}(t)/(Z_{il}(t))]^{\frac{1}{2}}=[1-k_i(t)][(Z_{i-1}(t))]^{\frac{1}{2}}=[1-k_i^2(t)]^{\frac{1}{2}} \qquad \text{Eq.(15)}$$

Figure 11:
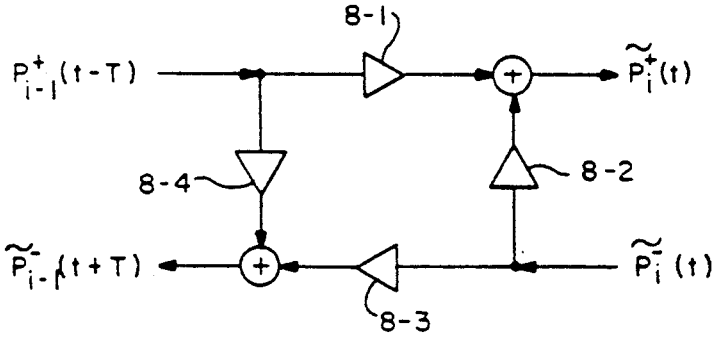
FIG. 11 depicts a wave-normalized waveguide junction.

The final scattering equations for normalized waves are $$\bar{P}_i^+(0,t)=c_i(t)\bar{P}_{i-1}^+(cT,t)-s_i(t)\,\bar{P}_i^-(0,t) \qquad \text{Eqs.(16)}$$

$$\bar{P}_{i-1}^-(cT,t)=s_i(t)\bar{P}_{i-1}^+(ct,T)+c_i(t)\,\bar{P}_i^-(t)$$

where $$S_i(t)\triangleq k_i(t) \qquad \text{Eqs.(17)}$$

$$c_i(t)\triangleq[1-k_i^2(t)]^{\frac{1}{2}}$$

can be viewed as the sine and cosine, respectively, of a single angle $\theta_i(t)=\sin^{-1}[k_i(t)]$ which characterizes the junction. FIG. 11 illustrates the Kelly-Lochbaum junction as it applies to normalized waves. In FIG. 11, the multipliers 8-1, 8-2, 8-3, and 8-4 multiply by the factors $[1-k_i(t)]^{\frac{1}{2}}$, $-k_i(t)$, $[1-k_i(t)]^{\frac{1}{2}}$, and $k_i(t)$, respectively. In FIG. 11, $k_i(t)$ cannot be factored out to obtain a one-multiply structure. The four-multiply structure of FIG. 11 is used in the normalized ladder filter (NLF).

Note that normalizing the outputs of the delay lines saves one multiply relative to the NLF which propagates normalized waves. However, there are other differences to consider. In the case of normalized waves, duals are easier, that is, changing the propagation variable from pressure to velocity or vice versa in the $i^{th}$ section requires no signal normalization, and the forward and reverse reflection coefficients are unchanged. Only sign-reversal is required for the reverse path. Also, in the case of normalized waves, the rms signal level is the same whether or not pressure or velocity is used. While appealing from a "balance of power" standpoint, normalizing all signals by their rms level can be a disadvantage. In the case of normalized delay-line outputs, dynamic range can be minimized by choosing the smaller of pressure and velocity as the variable of propagation.

Transformer-Coupled Waveguides

Still another approach to the normalization of time-varying waveguide filters is perhaps the most convenient of all. So far, the least expensive normalization technique is the normalized-waveguide structure, requiring only three multiplies per section rather than four in the normalized-wave case. . Unfortunately, in the normalized-waveguide case, changing the characteristic impedance of section i results in a changing of the reflection coefficients in both adjacent scattering junctions. Of course, a single junction can be modulated in isolation by changing all downstream characteristic impedances by the same ratio. But this does not help if the filtering network is not a cascade chain or acyclic tree of waveguide sections. A more convenient local variation in characteristic impedance can be obtained using transformer coupling. A transformer joins two waveguide sections of differing characteristic impedance in such a way that signal power is preserved and no scattering occurs. It turns out that filter structures built using the transformer-coupled waveguide are equivalent to those using the normalized-wave junction described in the previous subsection, but one of the four multiplies can be traded for an addition.

From Ohm's Law and the power equation, an impedance discontinuity can be bridged with no power change and no scattering using the following relations:

$$[P_i^+]^2/[Z_i(t)]=[P_{i-1}^+]/^2/[Z_{i-1}(t)] \qquad \text{Eqs.(18)}$$

$$[P_i^-]^2/[Z_i(t)]=[P_{i-1}^-]^2/[Z_{i-1}(t)]$$

Therefore, the junction equations for a transformer can be chosen as $$P_i^+=g_i(t)P_{i-1}^+ \qquad \text{Eqs.(19)}$$

$$P_{i-1}^-=g_i^{-1}(t)P_i^-$$

where, from Eq. (14)

$$g_i(t)\triangleq[(Z_i(t))/(Z_{i-1}(t))]^{\frac{1}{2}}=[(1+k_i(t))/(1-k_i(t)]^{\frac{1}{2}} \qquad \text{Eq.(20)}$$

The choice of a negative square root corresponds to a gyrator. The gyrator is equivalent to a transformer in cascade with a dualizer. A dualizer is a direct implementation of Ohm's law (to within a scale factor) where the forward path is unchanged while the reverse path is negated. On one side of the dualizer there are pressure waves, and on the other side there are velocity waves. Ohm's law is a gyrator in cascade with a transformer whose scale factor equals the characteristic admittance.

Figure 12:
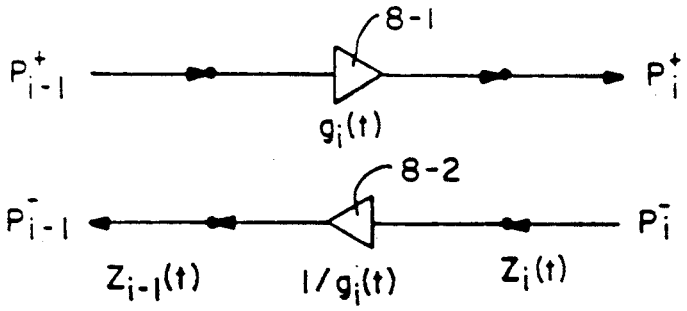
FIG. 12 depicts a transformer junction.

The transformer-coupled junction is shown in FIG. 12. In FIG. 12, the multipliers 8-1 and 8-2 multiply by $g_i(t)$ and $1/g_i(t)$ where $g_i(t)$ equals $[Z_i(t)/Z_{i-1}(t)]^{\frac{1}{2}}$. A single junction can be modulated, even in arbitrary network topologies, by inserting a transformer immediately to the left (or right) of the junction. Conceptually, the characteristic impedance is not changed over the delay-line portion of the waveguide section; instead it is changed to the new time-varying value just before (or after) it meets the junction. When velocity is the wave variable, the co-efficients $g_i(t)$ and $g_i^{-1}(t)$ in FIG. 12 are swapped (or inverted).

So, as in the normalized waveguide case, the two extra multipliers 8-1 and 8-2 of FIG. 12 provide two extra multiplies per section relating to the unnormalized (one-multiply) case, thereby achieving time-varying digital filters which do not modulate stored signal energy. Moreover, transformers enable the scattering junctions to be varied independently, without having to propagate time-varying impedance ratios throughout the waveguide network.

Figure 13:
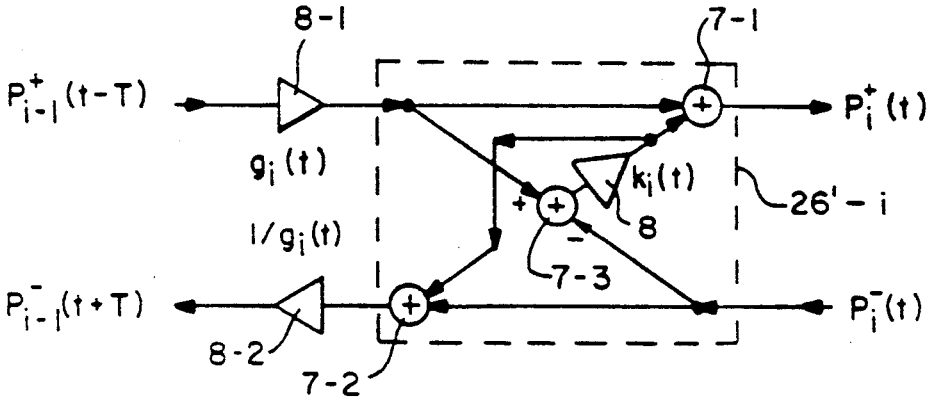
FIG. 13 depicts transformer-coupled waveguide junction.

In FIG. 13, the one-multiply junction 26'-i includes three adders 7-1, 7-2, and 7-3, where adder 7-3 functions to subtract the second rail signal, Pi,(t), from the first rail signal, $[P_{i-1}+(t-T)][g_i(t))]$. Junction 26'-i also includes the multiplier 8 which multiplies the output from adder 7-3 by $k_i(t)$. FIG. 13 utilizes the junction of FIG. 12 in the form of multipliers 8-1 and 8-2 which multiply the first and second rail signals by $g_i(t)$ and $1/g_i(t)$, respectively, where $g_i(t)$ equals $[(1-k_i(t))/(1+k_i(t))]^{\frac{1}{2}}$.

It is interesting to note that the transformer-coupled waveguide of FIG. 13 and the wave-normalized waveguide (shown in FIG. 11) are equivalent. One simple proof is to start with a transformer and a Kelly-Lochbaum junction, move the transformer scale factors inside the junction, combine terms, and arrive at FIG. 11. The practical importance of this equivalence is that the normalized ladder filter (NLF) can be implemented with only three multiplies and three additions instead of four multiplies and two additions.

The limit cycles and overflow oscillations are easily eliminated in a waveguide structure, which precisely simulates a sampled interconnection of ideal transmissions line sections. Furthermore, the waveguide can be transformed into all well-known ladder and lattice filter structures simply by pushing delays around to the bottom rail in the special case of a cascade, reflectively terminated waveguide network. Therefore, aside from specific round-off error and time skew in the signal and filter coefficients, the samples computed in the waveguide and the samples computed in other ladder/lattice filters are identical (between junctions).

The waveguide structure gives a precise implementation of physical wave phenomena in time-varying media. This property is valuable in its own right for simulation purposes. The present invention permits the delay or advance of time-varying coefficient streams in order to obtain physically correct time-varying waveguide (or acoustic tube) simulations using standard lattice/ladder structures. Also, the necessary time corrections for the traveling waves, needed to output a simulated pressure or velocity, are achieved.

The waveguide structures of the present invention are useful for two distinct applications, namely, tone synthesis (the creation of a musical tone signal) and reverberation (the imparting of reverberation effects to an already existing audio signal). The present invention is directed to use of waveguide structures for tone synthesis. Use of such structures for reverberation is described in detail in U.S. Pat. No. 4,984,276, the disclosure of which is incorporated herein by reference.

Figure 14:
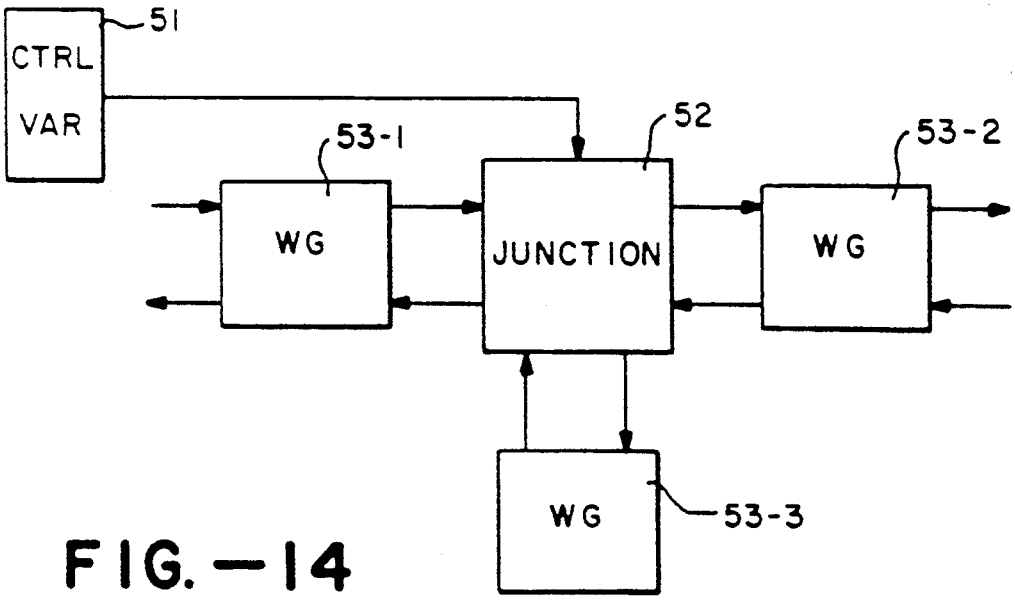
FIG. 14 depicts a non-linear junction, controlled by a control variable, and connected through a plurality of ports to a plurality of waveguides.

Waveguide Networks with Non-Linear Junction—FIG. 14

In FIG. 14, a plurality of waveguides 53 are interconnected by a non-linear junction 52. In the particular embodiment of FIG. 14, the junction 52 has three ports, one for each of the waveguide networks 53-1, 53-2, and 53-3. However, junction 52 can be an N-port junction interconnecting N waveguides or waveguide networks 53. The control variable register 51 provides one or more control variables as inputs to the junction 52. In FIG. 14 when only a single waveguide is utilized, the single waveguide becomes a special case, single-port embodiment of FIG. 14. Single port examples of the FIG. 14 structure are described hereinafter in connection with reed instruments such as clarinets or saxophones. Multi-port embodiments of the FIG. 14 structure are described hereinafter in connection with stringed instruments such as violins. A multi-port variation of the FIG. 14 structure is also described hereinafter in connection with a reverberator. Many other instruments not described in detail can also be simulated in accordance with the present invention. For example, flutes, organs, recorders, basoons, oboes, all brasses, and ion instruments can be simulated by single or multi-port, linear or non-linear junctions in combination with one or more waveguides or waveguide networks.

Figure 15:
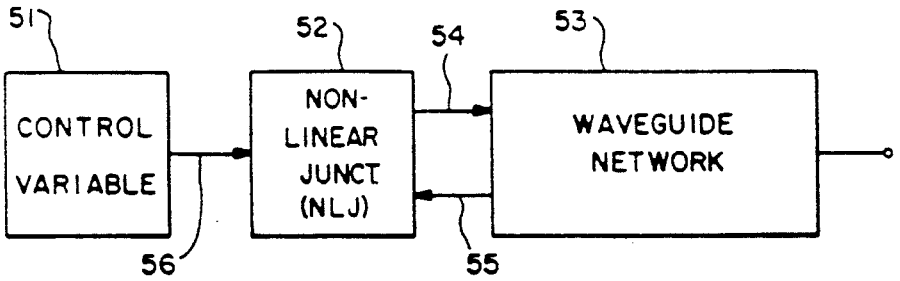
FIG. 15 depicts a terminating non-linear junction controlled by a control variable and connected to a waveguide network.

Waveguide with Non-Linear Terminating Junction—FIG. 15

In FIG. 15, a block diagram representation of a waveguide 53 driven by a non-linear junction 52 is shown. The non-linear junction 52 provides the input on the first rail 54 to the waveguide 53 and receives the waveguide output from the second rail on lines 55. A control variable unit 51 provides a control variable to the non-linear junction 52. The FIG. 15 structure can be used as a musical instrument for simulating a reed instrument in which case the control variable unit 51 simulates mouth pressure, that is the pressure drop across a reed. The non-linear junction 52 simulates the reed and the waveguide 53 simulates the bore of the reed instrument.

Figure 16:
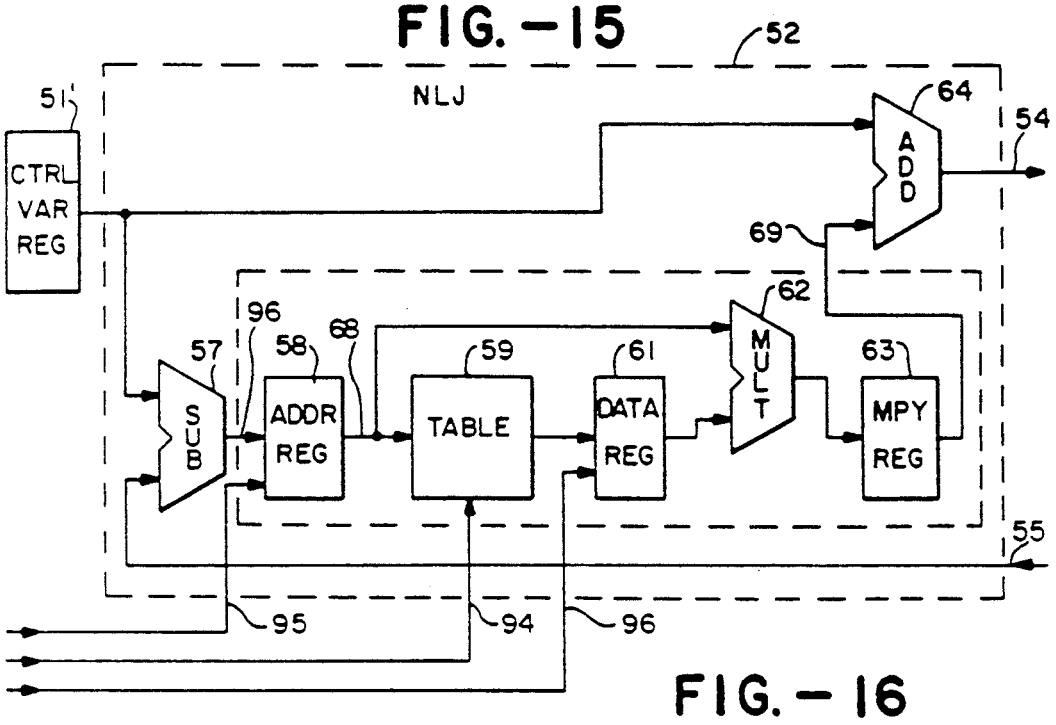
FIG. 16 depicts further details of the non-linear junction of FIG. 9.

Non-Linear Junction—FIG. 16

FIG. 16 depicts further details of a non-linear junction useful in connection with the FIG. 15 instrument for simulating a reed. The control register input on lines 56 is a control variable, such as mouth pressure. The control variable forms one input (negative) to a subtractor 57 which receives another input (negative) directly from the most significant bits of the waveguide second rail on lines 55. The subtractor 56 subtracts the waveguide output on lines 55 and the control variable on lines 56 to provide a 9-bit address on lines 69 to the coefficient store 70 and specifically the address register 58. The address register 58 provides the address on lines 68 to a table 59 and to a multiplier 62. The table 59 is addressed by the address, x, from address register 58 to provide the data, g(x), in a data register 61. The contents, g(x), in the data register 61 are multiplied by the address, x, from address register 58 in multiplier 62 to provide an output, x*g(x), in the multiplier register 63 which is equal to f(x). The output from the multiplier register 63 is added in adder 64 to the control variable to provide the first rail input on lines 54 to the waveguide 53 of FIG. 15.

In FIG. 16, table 59 in one embodiment stores 512 bytes of data and provides an 8-bit output to the data register 61. The multiplier 62 provides a 16-bit output to the register 63 The high order 8 bits in register 63 are added in saturating adder 64 to the 8 bits from the variable register 51' to provide a 16-bit output on lines 54. Similarly, the high order 8-bits from the 16-bit lines 55 are subtracted in subtractor 57.

The contents of the table 59 in FIG. 16 represent compressed data. If the coefficients required are f(x) from the compressed table 70, only a fewer number of values, g(x), are stored in the table 59. The values stored in table 59 are f(x)/x which are equal to g(x). If x is a 16-bit binary number, and each value of x represents one 8-bit byte of data for f(x), table 59 is materially reduced in size to 512 bytes when addressed by the high-order 9 bits of x. The output is then expanded to a full 16 bits by multiplication in the multiplier 62.

Further compression is possible by interpolating values in the table 59. Many table interpolation techniques are well known. For example, linear interpolation could be used. Interpolation can also be used to compress a table of f(x) values directly, thus saving a multiply while increasing the needed table size, for a given level of relative error Other examples include a double look-up, address normalization, root-power factorization, address and value quantization, address mapping to histogram. Other compression techniques can be employed.

The manner in which the data values for a reed instrument are generated is set forth in APPENDIX A.

Figure 17:
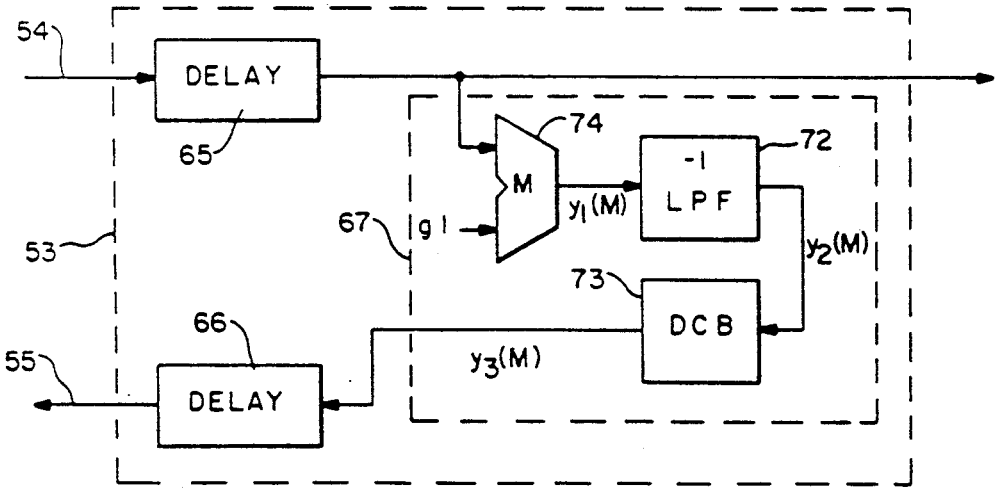
FIG. 17 depicts a block diagram representation of the waveguide of FIG. 9.

In FIG. 17, further details of a schematic representation of the waveguide 53 are shown. The waveguide 53 includes a first rail receiving the input on lines 54 and comprising a delay 65. A terminator 67 connects the delay 65 to the second rail delay 66 which in turn provides the second rail output on lines 55.

In an embodiment where the FIG. 16 signal processor of FIGS. 16 and 17 simulates a reed instrument, the terminator 67 is typically a single pole low-pass filter. Various details of a clarinet reed instrument in accordance with the signal processor of FIGS. 16 and 17 appear in APPENDIX B.

To simulate clarinet tone holes, a three-port scattering junction is introduced into the waveguide. Typically, the first three or four adjacent open tone holes participate in the termination of the bore.

In FIG. 17, the terminator 67 includes a multiplier 74, an inverting low-pass filter 72 and a DC blocking circuit 73. The multiplier 74 multiplies the signal on line 75 from the delay 65 by a loss factor $g_1$ where $g_1$ is typically $1\text{-}2\text{-}4^{-4}=0.9375$ for a clarinet. The output from the multiplier 74 is designated $y_1(n)$ where n is the sampled time index. The output from the low-pass filter 72 is designated $y_2(n)$, and the output from the DC blocking unit 73 is designated $y_3(n)$.

For a clarinet, the low-pass filter 72 has a transfer function H12(Z) as follows:

$$H_{12}(Z)=-(1-g)/(1-gZ^{-1})$$

Therefore the signal $y_2(n)$ output from the low-pass filter 72 is given as follows:

$$y_2(n)=(g-1)y_1(n)+gy_2(n-1)$$

In the above equations, g is a coefficient which is typically determined as equal to $1-2^{-k}$ where k can be any selected value. For example, if k is 3, g is equal to 0.875 and g equal to 0.9 is a typical value As another example, $1-2^{-3}+2^{-5}=0.90625$.

In FIG. 17, the transfer function, $H_{23}(Z)$, of the DC blocking circuit 73 is given as follows:

$$H_{23}(Z)=(1-Z^{-1})/(1-rZ^{-1})$$

With such a transfer function, the output signal $y_3(n)$ is given as follows:

$$y_3(n)=y_2(n)-y_2(n-1)+ry_3(n-1)$$

In simulations, the value of r has been set to zero. In actual instruments, DC drift can cause unwanted numerical overflow which can be blocked by using the DC block unit 73. Furthermore, when using the compressed table 70 of FIG. 16, the error terms which are produced are relative and therefore are desirably DC centered. If a DC drift occurs, the drift has the effect of emphasizing unwanted error components. Relative signal error means that the ratio of the signal error to signal amplitude tends to remain constant. Therefore, small signal values tend to have small errors which do not significantly disturb the intended operation.

In FIG. 17, for a clarinet, the delays 65 and 66 are typically selected in the following manner. One half the desired pitch period less the delay of the low-pass filter 72, less the delay of the DC block in unit 73, less the delay encountered in the non-linear junction 52 of FIG. 16.

When a saxophone is the reed instrument to be simulated by the FIG. 16 and FIG. 17 devices, a number of changes are made. The non-linear junction of FIG. 16 remains the same as for a clarinet. However, the waveguide network 53 of FIG. 15 becomes a series of cascaded waveguide sections, for example, of the FIG. 4 type. Each waveguide section represents a portion of the bore of the saxophone. Since the bore of a saxophone has a linearly increasing diameter, each waveguide section simulates a cylindrical section of the saxophone bore, with the waveguide sections representing linearly increasing diameters.

For a saxophone and other instruments, it is useful to have a non-linear bore simulation. Non-linearity results in excess absorption and pressure-dependent phase velocity. In order to achieve such non-linear simulation in accordance with the present invention, one method is to modify the delays in the waveguide structure of FIG. 8. In FIG. 8, each of the delays, $Z^{-2T}$, includes two units of delay. In order to introduce a non-linearity, one of the two units of delay is replaced by an all-pass filter so that the delay D changes from $Z^{-2T}$ to the following:

$$D=[Z^{-T}][(h+Z^{-T})/(1+hZ^{-T})]$$

With such a delay, the output signal, $y_2(n)$ is given in terms of the input signal, y (n) as follows:

$$y_2(n)=h*y_1(n-1)+y_1(n-2)-h*y_2(n-1)$$

In the above equations, in order to introduce the non-linearity, the term h is calculated as a function of the instantaneous pressure in the waveguide, which is the sum of the travelling-wave components in the first rail and the second rail. For example, the first rail signal input to the delay, $y_1^+(n)$ is added to second rail signal $y_1^-(n)$ and then utilized by table look up or otherwise to generate some function for representing h as follows:

$$h=f[y_1^+(n)+y_1^-(n)]$$

The delay of the first-order all-pass as a function of h can be approximated by $(1-h)/(1+h)$ at low frequencies relative to the sampling rate Typically, h is between $1-\epsilon$ and 0 for some small positive $\epsilon$ (the stability margin).

Using the principles described, simulation of a nonlinear waveguide medium (such as air in a clarinet bore) is achieved. For clarinet and other instruments, the bore which is modeled by the waveguides of the present invention, includes tone holes that are blocked and unblocked to change the pitch of the tone being played. In order to create the equivalent of such tone holes in the instruments using waveguides in accordance with the present invention, a three-port junction can be inserted between cascaded waveguide sections. One port connects to one waveguide section, another port connects to another waveguide section, and the third port is unconnected and hence acts as a hole. The signal into the third port is represented as $P_3+$and this signal is equal to zero. The radiated signal from the third port, that is the radiated pressure, is denoted by $P_3-$. The three-port structure for the tone hole simulator is essentially that of FIG. 14 without the waveguide 53-3 and without any control variable 51 input as indicated by junction 52 in FIG. 14. The junction 52 is placed as one of the junctions, such as junction 26-i in FIG. 4. With such a configuration, the junctions pressure, $P_J$, is given as follows:

$$P_J = \sum_{i=1}^{3} \alpha_i P_i^+$$

where, $\alpha_i = 2\Gamma_i/(\Gamma_1+\Gamma_2+\Gamma_3)$, $\Gamma_i$=characteristic admittance in $i^{th}$ waveguide $P_i^- = P_J - P_i^+$ $P_J = \alpha_1 p_1^+ \alpha_2 P_2^+ = \alpha_1 P_1^+ + (2-\alpha_1-\alpha_3)P_2^+$ $P_1^- = P_J - P_1^+ = (\alpha_1 - 1)P_1^+ + \alpha_2 P_2^+$ $P_2^- = P_J - P_2^+ = \alpha_1 P_1^+ + (\alpha_2 - 1)P_2^+$ $P_3^- = P_J - P_3^+ = P_J$ (tone hole output)

Let, $$\Gamma_3 = \begin{cases} (\Gamma_1 + \Gamma_2)/2, \text{ open hole} \\ 0, \text{ closed hole} \end{cases}$$

Then, $$\alpha_3 = \begin{cases} 1, \text{ open hole} \\ 0, \text{ closed hole} \end{cases}$$

$$\alpha_2 = \begin{cases} 1 - \alpha_1, \text{ open hole} \\ 2 - \alpha_1, \text{ closed hole} \end{cases}$$

Then, with $P_\Delta^+ = P_1^+ - P_2^{30}$ , we obtain the one multiply tone-hole simulation:

$$P_2^- = \alpha_1 P_\Delta^+,\ P_1^- = P_2^- - P_\Delta^+, \text{ (open hole)}$$

In a smooth bore, $\Gamma_1 = \Gamma_2 = \Gamma$ and $\Gamma_3 = \beta\Gamma$here $\beta$ is the cross-sectional area of the tone hole divided by the cross-sectional area of the bore. For a clarinet, $\beta = 0.102$ and for a saxophone, $\beta = 0.436$, typically. So we have:

$$\Gamma_3 \overset{\Delta}{=} \beta\Gamma = \begin{cases} \beta\Gamma, \text{ open} \\ 0, \text{ closed} \end{cases}$$

Then, $$\alpha_1 = \alpha_2 2\Gamma/(2\Gamma+\beta\Gamma) = 2/(2+\beta)\Delta\alpha$$

$$\alpha_3 = 2\beta/(2+\beta) = \beta\alpha,$$

There is now a single parameter $$\alpha = \begin{cases} 2/(2+\beta), \text{ open} \\ 1, \text{ closed} \end{cases}$$

So, the tone hole simulation is given by $$P_J = \alpha(P_1^+ + P_2^+) \text{ (if open)}$$

ti $P_1^- = P_J - P_2^+ = \alpha P_2^+ + (\alpha - 1)\ P_1^+ = P_2^+$(if closed)

$$P_2^- = P_J - P_1^+ = \alpha P_1^+ + (\alpha - 1)\ P_2^+ = P_1^+ \text{(if closed)}$$

Summary:

$$\alpha = \begin{cases} 0.95, \text{ clarinet} \\ 0.821, \text{ saxophone} \end{cases}$$

$$\Gamma_3 = \beta\Gamma$$

$$P_J = \alpha(P_1^+ + P_2^+$$

$$P_1^- = P_J - P_1^+$$

$$P_2^- = P_J - P_2^+$$

$$\alpha = \begin{cases} 2/(2+\beta), \text{ open} \\ 1, \text{ closed} \end{cases}$$

a=bore radius b=hole radius $$\beta = b^2/a^2 = \begin{cases} 0.102, \text{ clarinet} \\ 0.436, \text{ saxophone} \end{cases}$$

$$\alpha = (2a^2)/(2a^2+b^2) - \text{hole open}$$

$$\alpha = 1 - \text{hole closed}$$

$P_J$ is radiated away spherically from the open hole with a (1/R) amplitude attenuation.

Reed Simulation

Figure 20:
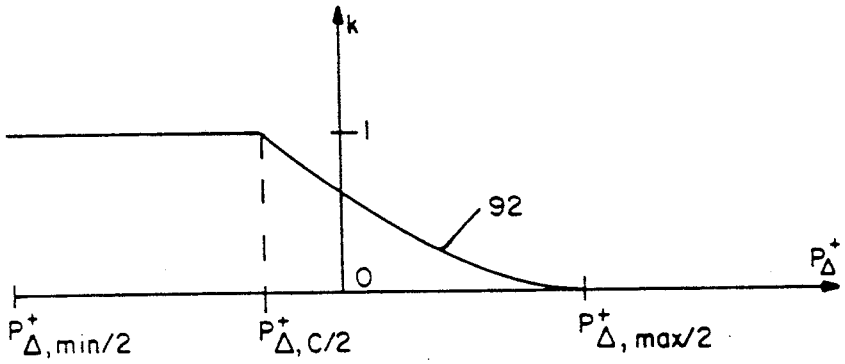
FIG. 20 is a graph of a waveform representing the data stored in the table of FIG. 16 for a reed instrument.

In FIG. 20, a graph is shown representing the data that is typically stored in the table 59 of FIG. 16 for a reed instrument. The output signal $R^-(n)$ on line 54 is as follows:

$$R^-(n) = k^* P_\Delta^+/2 + P_m(n)/2$$

The control variable input on line 56 is $P_m(n)/2$ and the input on line 68 to the table 59 is $$(P_{66}^+)/2 = (R^+(n) - P_m(n)/2)$$

where $R^+(n)$ is the signal sample on line 55 of FIG. 16.

The table 59 is loaded with values which, when graphed, appear as in FIG. 23. The curve 92 in FIG. 23 has a maximum value of one and then trails off to a minimum value of zero. The maximum value of one occurs between $(P_\Delta^+{}_{,min})/2$ and $(P_\Delta^+{}_c)/2$. The value $(P_\Delta^+{}_{,c})/2$ corresponds to the closure of the reed. From $(P_\Delta^+{}_{,c})/2$ to $(P_\Delta^+{}_{,max})/2$ the curve 92 decays gradually to zero." The equation for the curve 92 is given as follows, $$\text{Curve} = [(P_\Delta^+{}_{,max} - P_\Delta^+)/(P_\Delta^+{}_{,max} - P_\Delta^+{}_{,c})]^l$$

where l=1, 2, 3, . . .

The output from the table 59 is the variable k as given, in FIG. 20, that is, $$k = k[(P_\Delta^+)/2]$$

Bowed-String Simulation

Figure 18:
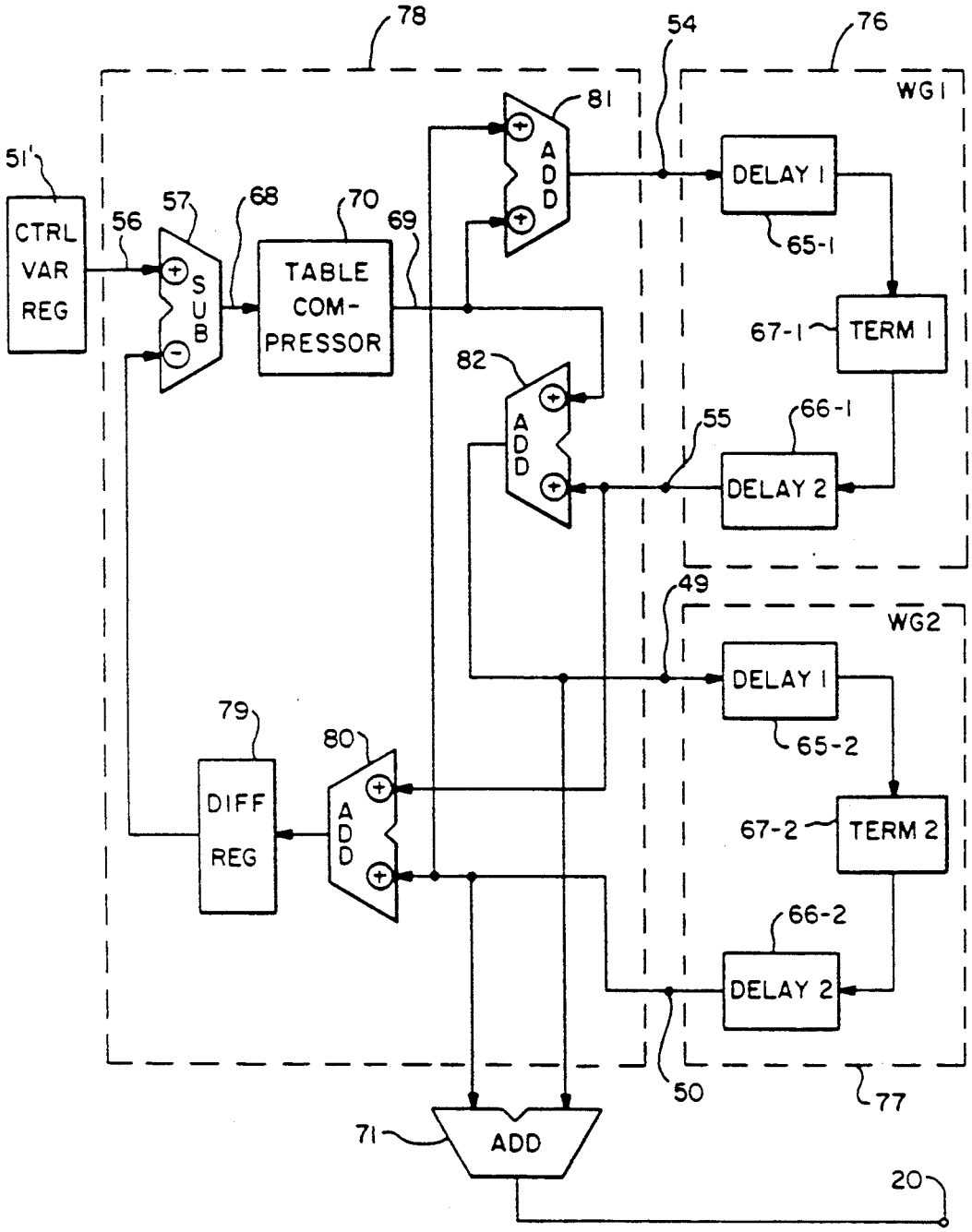
FIG. 18 depicts a non-linear junction connected to first and second waveguides.
Figure 21:
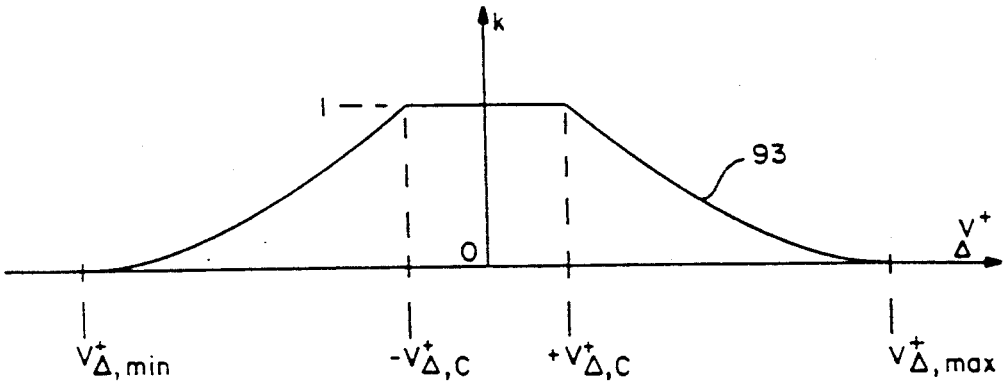
FIG. 21 is a graph of a waveform representing the data stored in the table of FIG. 16 for a string instrument.

In FIG. 21, a graph is shown representing the data that is typically stored in the coefficient table 59 of the signal table 70 (see FIG. 16) of FIG. 18. The output signals $V_{s,l}^-$ on line 54 and $V_{s,r}^-$ on line 49 are as follows:

$$V_{s,l}^- = k(V_\Delta^+)^* V_\Delta^+ + V_{s,r}^+$$

$$V_{s,r}^- = k(V_\Delta^+)^* V_\Delta^+ + V_{s,l}^+$$

The control variable input on line 56 is bow velocity, $V_b$, and the input on line 68 to the table 59 is $$V_\Delta^+ = V_b - (V_{s,l}^+ + V_{s,r}^+)$$

where $V_{s,l}^+$ is the signal sample on line 55 and $V_{s,r}^+$ is signal sample on line 50 of FIG. 18.

The table 59 is loaded with values which, when graphed, appear as in FIG. 24. The curve 93 in FIG. 24 has a maximum value of one and then trails off to a minimum value of zero to the left and right symmetrically. The maximum value of one occurs between $-V_{\Delta,c}^+$ and $+V_{\Delta,c}^+$. From $(V_{\Delta,c}^+)$ to $(V_\Delta^+, max)$ curve 93 decays gradually to zero. The equation for the curve 93 is given as follows, $$\text{Curve} = [(V_{\Delta,max}^+ - V_\Delta^+)/(V_{\Delta,max}^+ - V_{\Delta,c}^+)]^l$$

where $l = 1, 2, 3, \ldots$

The output from the table 59 is the reflection coefficient k as given in FIG. 24, that is, $$k = k[(V_\Delta^+)]$$

Compressed Table Variations

The compressed table 59 of FIG. 16 containing $g(x) = f(x)/x$ is preferable in that quantization errors are relative. However, alternatives are possible. The entire table compressor 70 of FIG. 16 can be replaced with a simple table. In such an embodiment, the round off error is linear and not relative. For linear errors, the error-to-signal ratio tends not to be constant. Therefore, for small signal amplitudes, the error tends to be significant so that the error may interfere with the intended operation. In either the table compressor embodiment 70 of FIG. 16 or a simple table previously described, the tables can employ compression techniques such as linear, Lagrange and quadratic interpolation with satisfactory results. In a linear interpolation example, the curve 92 of FIG. 20 would be replaced by a series of straight line segments thereby reducing the amount of data required to be maintained in the table.

Figure 19:
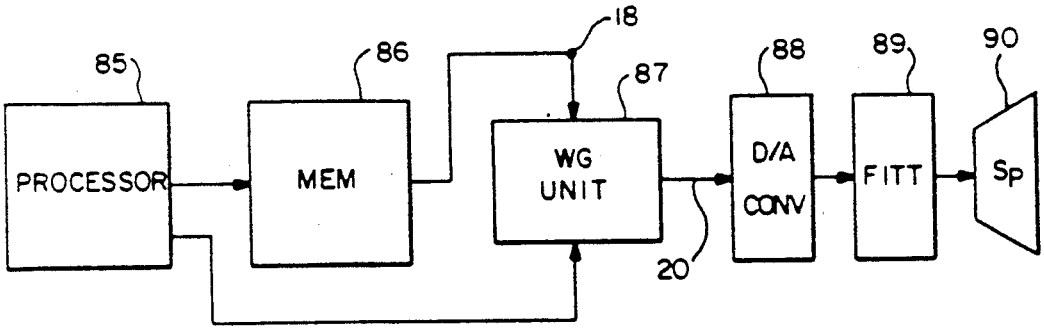
FIG. 19 is a signal processor forming a music instrument using digital waveguides.

Also table 59, address register 58 and data register 61 of FIG. 16 each have inputs 94, 95 and 96 from processor 85 (FIG. 19).

The inputs from processor 85 function to control the data or the access of data from the table 59. Modifications to the data in the table can be employed, for example, for embouchure control for reed synthesis. Similarly, articulation control for bowed-string synthesis is possible. In one example, the address register 58 has high order address bits, bits 10 and 11, which are supplied by lines 95 from the processor. In this manner, the high order bits can be used to switch effectively to different subtables within the table 59. This switching among subtables is one form of table modification which can be used to achieve the embouchure and articulation modifications.

Non-Linear Junction with Plural Waveguides—FIG. 18

In FIG. 18, further details of another embodiment of a non-linear junction is shown connected between a first waveguide 76 and a second waveguide 77. The non-linear junction 78 receives an input from the control variable register 51' and provides inputs to the waveguide 76 on lines 54 and receives an output on lines 55. Also the non-linear junction 78 provides an output to the waveguide 77 on lines 49 and receives an input on lines 50.

In FIG. 18, the non-linear junction 78 includes an adder 57 receiving as one input the control variable from the control variable register 51' on lines 56. The other input to the subtractor 57 is from the difference register 79 which in turn receives an output from an adder 80. The adder 80 adds the inputs on lines 55 from the waveguide 76 and lines 50 from the waveguide 77.

The output from the subtractor 57 on lines 68 is input to the table compressor 70. The table compressor 70 of FIG. 12 is like the table compressor 70 of FIG. 10 and provides an output on lines 69. The output on lines 69 connects as one input to each of the adders 81 and 82. The adder 81 receives as the other input the input from lines 50 from the waveguide 77 to form the input on lines 54 to the first waveguide 76. The second adder 82 receives the table compressor signal on lines 69 and adds it to the input from the first waveguide 76 on lines 55. The output from adder 82 connects on lines 49 as the input to the second waveguide 77.

In FIG. 18, the waveguide 76 includes the top rail delay 65-1 and the bottom rail delay 66-1 and a terminator 67-1.

Similarly, the second waveguide 77 includes a top rail delay 65-2 and a bottom rail delay 66-2 and a terminator 67-2.

In the case of a violin in which the long string portion is approximately one foot and the short string portion is one-fifth of a foot, the waveguides of FIG. 18 are as follows. The terminator 67-1 is merely an inverter which changes the sign of the first rail value from delay 65-1 going into the delay 66-1. For example, the changing the sign is a 2's complement operation in digital arithmetic. Each of the delays 65-1 and 66-1 is the equivalent of about fifty samples in length for samples at a 50 KHz frequency. The terminator 67-2 in the waveguide 77 is typically ten samples of delay at the 50 KHz sampling rate. The terminator 67-2 can be a single pole low-pass filter. Alternatively, the terminator can be a filter having the empirically measured bridge reflectance cascaded with all source of attenuation and dispersions for one round trip on the string. Various details of a violin appear in APPENDIX C.

Musical Instrument—FIG. 19

In FIG. 19, a typical musical instrument, that is signal processor, employing the waveguide units of the present invention is shown. In FIG. 19, a processor 85, such as a special purpose or general purpose computer, generates a digital signal representing the sound to be produced or a control variable for a synthesizer. Typically, the processor 85 provides an address for a random access memory such as memory 86. Memory 86 is addressed and periodically provides a digital output representing the sound or control variable to be generated.

The digital sample from the memory 86, typically at a sampling rate $T_s$ (usually near 50KHz), is connected to the waveguide unit 87. Waveguide unit 87 processes the digital signal in accordance with the present invention and provides an output to the digital-to-analog (D/A) converter 88. The converter 88 in turn provides an analog output signal through a filter 89 which connects to a speaker 90 and produces the desired sound.

When the signal processor of FIG. 19 is a reed instrument, the structure of FIGS. 15, 16 and 17 is typically employed for waveguide unit 87. In FIG. 15, the control variable 51 is derived from the processor 85 and the memory 86 of FIG. 19. The structure of FIGS. 15, 16 and 17 for a clarinet uses the FIG. 17 structure for waveguide 53 with a simple inverter (−1) for terminator 67. For a saxophone, the waveguide 53 is more complex, like FIG. 4.

When the signal processor of FIG. 19 is a bowed-string instrument, the waveguide unit 87 in FIG. 19 typically employs the structure of FIG. 18. The control variable input to register 51' of FIG. 18 comes from the memory 86 of FIG. 19. The output from the waveguide unit of FIG. 18 is derived from a number of different points, for example, from the terminals 54 and 55 for the waveguide 76 or from the terminals 49 and 50 from the waveguide 77 of FIG. 18. In one typical output operation, an adder 71 adds the signals appearing at terminals 49 and 50 to provide an input at terminal 20 to the D/A converter 88 of FIG. 19. The sum of the signals in adder 71 corresponds to the string velocity at the location of the bow on the instrument.

When reed and other instruments are employed, it has been found useful to introduce white noise summed with the control variable input to register 51' of FIG. 16. Additionally, the introduction of tremolo and other musical effects into the control variable enhances the quality of the sound produced.

TABLE 1

| |
|---|
| $N_1T_s = 5$ ms. |
| $N_2T_s = 17$ ms. |
| $N_3T_s = 23$ ms. |
| $N_4T_s = 67$ ms. |
| $N_5T_s = 113$ ms. |
| $T_s \approx 20$ microseconds |
| $\epsilon = 0.9$ where $\lvert\epsilon\rvert \leqq 1$ |
| $\sum_{i=1}^{5} = 2$ (lossless condition) |
| where $0 \leqq \alpha_i \leqq 2$ |
| For time-varying reverberation: |
| $\alpha_1 = 1$ |
| $\alpha_2 = \beta_1/2$ |
| $\alpha_3 = (1 - \beta_1)/2$ |
| $0 = \beta_1 \leqq 1$ |
| $\alpha_4 = \beta_2/2$ |
| $0 \leqq \beta_2 \leqq 1$ |
| $\alpha_5 = (1 - \beta_2)/2$ |

APPENDIX A

COPYRIGHT 1986 - THE BOARD OF TRUSTEES
OF THE LELAND STANFORD JUNIOR UNIVERSITY

BEST AVAILABLE COPY

```
COMMENT Plot reed flow versus differential pressure;
COMMENT Version 4 - V3 with mouth-pressure-independent table;
BEGIN "ReedF"

COMMENT                          Clarinet structure

                                        -        O--------------------O
P (n) -->o----------------->(+)----> P (n) --->| Waveguide, Length N |--->o--> Out
 m                          ↑        b        O-----------+-+--------O     |
-----                       |                              | |              |
  2        O------O         |                              ↓ ↓        O----+-------O
           | RC   |RC(n)|                                 |              |
           |Table +--->(s)          Output signal <---(+)<------|(-) Loupass |
           |      |     ↑  +        (two tone-holes)  ↑ ↑  1-LP O----+-------O
           O--↑---O     | P (n)/2    (this example)   | |   out      | LP out
              o<--------o  d                           | |              |
           ↓                         +        O-----------+-+-------O     ↓
           o----------------->(+)<---- P (n) <---| Waveguide, Length N |<---o
                              -  +     b        O--------------------O

O Pm - Mouth pressure (constant)
O Lowass Gain is close to (-1) at all frequencies, with
    increasing attenuation at high frequencies.
O Bell output is complementary highpass. If H(z) is the lowpass
    transfer function, bell output is 1-H(z).
    (Bell is a frequency-dependent beam splitter.)
O When tone hole(s) opened, delay line gets a reflection
    at each open tone hole. Consequently, much less energy gets to bell.
    In high registers, both holes and bell get a good-sized signal level.
O Reflection coefficient RC is 1 from 2mPbp-Pm between -1 and -.1 or so,
    then falls to .9 around 8, and decreases thereafter pretty slowly.

:

  REQUIRE "(|<>" DELIMITERS;
  DEFINE #="COMMENT";
  REQUIRE "JOSLIB.REQ[LIB,JOS]" SOURCE!FILE;
  REQUIRE "RECORD.REQ[LIB,JOS]" SOURCE!FILE;
  REQUIRE "MYIO.REQ[LIB,JOS]" SOURCE!FILE;
  REQUIRE "DISPLA.REQ[LIB,JOS]" SOURCE!FILE;
```

```
  INTEGER PROCEDURE Sign(REAL Val); RETURN(IF Val=0 THEN 0 ELSE IF Val>0 THEN 1 ELSE -1);

BOOLEAN PROCEDURE FindZero(REFERENCE REAL Z; REAL PROCEDURE F;
        REAL Xmin,Xmax,X0,dX);
COMMENT Find first zero of F(X) starting at X0, stepping dX;
BEGIN "FindZero"
  INTEGER cs,os;
  REAL X;
  X←X0;
  cs←os←Sign(F(X));
  CASE (cs+1) OF BEGIN
    (1) BEGIN Z←X; RETURN(TRUE) END;
    (0) WHILE (X←X+dX) LEQ Xmax AND cs=-1 DO cs←Sign(F(X));
    (2) WHILE (X←X-dX) GEQ Xmin AND cs=1 DO cs←Sign(F(X));
    ELSE PRINT(" FindZero: Procedure Sign is broken")
  END;
  Z ← X;
  IF NOT (Xmin LEQ X LEQ Xmax) THEN
  BEGIN
    Z ← (XMin MAX X MIN XMax);
    RETURN(FALSE);
  END;
  RETURN(TRUE);
END "FindZero";

# Configuration constants and declarations;

  DEFINE NPd="1024";      # Number of mouth-to-bore differential pressures;
  DEFINE NPdp="1024";     # Number of incoming pressure wave values to try;
  DEFINE NEmb="2";        # Number of embouchures to try;

  DEFINE RealBot = "1e-38";
  INTEGER Trace;
  DEFINE Debug(x) = ( (Trace LAND 2^x) );
  DEFINE DpyEd1 = ( IF Debug(1) THEN DpyEd );
  DEFINE DpyEd2 = ( IF Debug(2) THEN DpyEd );

  REAL ARRAY Garr,Xarr,ACarr[1:NPd*NEmb];
  REAL ARRAY RCarr,PdArr[1:NEmb*NPdp];
  STRING Pstr,Xstr;
  INTEGER iPd,j,iEmb,i;
  REAL P,Pdc,Pd,dPd,Uflow,Amp,Alpha,Pdmin,Pdmax,Emb,x0,x0e,Emin,Emax,dE,EFmax;
  REAL C,Zb,Rho,A0,Pi,Rb,Sr,Pdr,Beta,APdc,PdpMin,PdpMax,StepReduce;
  BOOLEAN TestMode;

  IF Trace=0 THEN Trace←7;
  IF StepReduce=0 THEN StepReduce←.01;
  SETFORMAT(0,2);
  IF Pi LEQ 0 THEN
  BEGIN "SetUp"
    Pi ← 4*ATAN(1);
    C ← 1050*12*2.54;     # Air speed in cm/sec. Dry, 20 degrees C, 1 atm;
    Rho ← 0.00129;        # Air density in g/cm^3, same conditions;
    Rb ← 0.746;           # Radius of clarinet bore in cm;
    Uflow ← 37;           # Reed flow amplitude (cm^3/sec) for Pd=x=1;
    Sr ← 1.4e-6;          # Reed stiffness in dyne/cm^3 (dyne=gm*cm/sec^2);
  # x0 ← 0.06;            # Reed opening (cm) at rest (Backus);
    x0 ← 0.15;            # Reed opening (cm) at rest (my measurement);
    Pdr ← 1e-8;           # Fraction of pressure drop felt by reed (!);
                          #   Physically, the value here is bizarre;
                          #   It has been set to give the desired behavior;
    EFmax ← .88*Sr;       # Pressure applied to reed at maximum embouchure;
  END "SetUp";

  A0 ← Pi*Rb^2;           # Cross-sectional area of clarinet bore in cm^2;
  Zb ← Rho*C/A0;          # Characteristic impedance of clarinet bore;
  Alpha ← Pdr/Sr;         # Alpha*Pd = Change in reed position (cm) vs. pr. drop;
  Beta ← EFmax/Sr;        # Beta*Pd = Change in reed position at max emb. (=1);
  Pdc←-x0/Alpha;          # Reed closure pressure (dyne/cm^2);
  APdc ← ABS(Pdc);        # We guestimate pressure in units of reed-closure pressure;
# Amp ← Zb*Uflow;         # Convert reed-aperture flow into traveling bore pressure;

  IF Amp LEQ 0 THEN Amp ← 1;
  AinReal(Amp,"Scale f:- ReedAdmittance/BoreAdmittance (- for resistor test)");
  IF Amp<0 THEN
  BEGIN
    PRINT("Replacing reed by fixed aperture of specific admittance=",Amp←-Amp,CrLf);
    TestMode←TRUE;
    IF Amp>1 THEN PRINT("You have set reed admittance greater than bore's!!",CrLf);
    PRINT(" Solution is ",CrLf,CrLf," Pbm = ",(1-Amp)/(1+Amp)," * Pbp  +  ",
        Amp/(1+Amp)," * PM",CrLf,CrLf);
    PRINT(" Reflection coefficient is RC = ",(1-Amp)/(1+Amp),CrLf);
  END ELSE TestMode←FALSE;

  Pdmin ← -Sr*x0/Alpha;   # Reed closure pressure is -x0/Alpha;
  Pdmax ← -Pdmin;         # Max differential pressure (Shouldn't go positive often?);
  PdpMin ← 2*Pdc;         # Minimum incoming pressure wave is twice reed closure;
  PdpMax ← -PdpMin;       # Maximum incoming pressure can be a reflection of min;
```

BEST AVAILABLE COPY

```
  Ebin←0;  Ebax←1;        # Embouchure (0:1). 0 => light embouchure. 1 => tight;
  dE ← (Ebax-Ebin)/(NEmb-1);
  FOR iEmb←1 STEP 1 UNTIL NEmb DO
  BEGIN "Eloop"
    Emb ← Ebin+(iEmb-1)×dE;      # Current embouchure;
    dPd←(Pdmax-Pdmin)/(NPd-1);
    FOR iPd←1 STEP 1 UNTIL NPd DO
    BEGIN "Iloop"
      REAL G,x;
      I←iPd+(iEmb-1)×NPd;
      Pd ← Pdmin + (iPd-1)×dPd; # Pressure drop across reed, bore to mouth;
      x ← x0 + Alpha×Pd;        # Reed position due to pressure drop;
      x ← x - Beta×Emb;         # Embouchure is an added force on reed "spring";
      x ← x MAX 0;              # 0 is reed closure, x0 is reed pos. at rest;
      Xarr[I] ← x;
      IF TestMode THEN G ← Amp×ABS(Pd)  # Plain resistor;
        ELSE G ← Amp×(ABS(Pd)×x↑2)↑.67; # Zb×ReedFlowGivenPressureDrop←Pd;
      Garr[I] ← (IF Pd>0 THEN G ELSE -G);
    END "Iloop";
  END "Eloop";

  Pstr ← "  Alpha←"&Cvfs(Alpha)&
         ", Pdc←"&Cvfs(Pdc)&", P←"&Cvfs(P)&", X0←"&Cvfs(X0)&
         " - Pd (dyne/cm↑2)";

  IF NOT TestMode THEN DpyEdl(Xarr,NPd,Pstr,"X position (cm)",Pdmin,Pdmax);

  DpyEdl(Garr,NPd,Pstr,"Pressure G (dyne/cm↑2)",Pdmin,Pdmax,PdMin,PdMax);

COMMENT Plot AC reflection gain vs. PM;

  FOR iEmb←1 STEP 1 UNTIL NEmb DO
  BEGIN
    FOR iPd←2 STEP 1 UNTIL NPd DO
    BEGIN
      REAL Gp; # Estimate of derivative of G;
      REAL ACgain; # AC gain is (1-Gp)/(1+Gp);
      INTEGER I;
      Pd ← Pdmin + (iPd-1)×dPd; # Current "operating point";
      I←iPd+(iEmb-1)×NPd;
      Gp ← (Garr[I]-Garr[I-1])/dPd;
      ACgain ← (1-Gp)/(1+Gp); # AC reflection coefficient at current op pt;
      ACarr[I] ← ACgain;
    END;
    ACarr[1+(iEmb-1)×NPd] ← ACarr[2+(iEmb-1)×NPd]; # Extrapolate 1 sample left;
  END;

  DpyEdl(ACarr,NPd,"ACgain(Pd)"&Pstr,"Ptbm/Ptbp",Pdmin,Pdmax);

  BEGIN "DpyAC"
    INTEGER Id,iEmb;
    STRING Ts;
    REAL Ymin,Ymax;
    REAL ARRAY Buf[1:NPd];
#   Ymin ← MinArr(NPd×NEmb,ACarr);
    Ymin ← 0;
    Ymax ← 1.1×MaxArr(NPd×NEmb,ACarr);
    IF Ymin GEQ Ymax THEN
    BEGIN PRINT(" AC gain PLOT IS CONSTANT = ",Ymin,CrLf); CALL(0,"EXIT") END;
    DPYOYL(ACarr,NPd,Id←0," AC Pbm/Pbp vs. Pd","AC RC",Ymin,Ymax,PdMin,PdMax,FALSE,TRUE,NEmb×NPd+1000);
    FOR iEmb←2 STEP 1 UNTIL NEmb DO
    BEGIN "DpyLoop"
      ARRBLT(Buf[1],ACarr[(iEmb-1)×NPd+1],NPd);
      DPYOYL(Buf,NPd,Id,NULL,"  Ym  ,Ymax,PdMin,PdMax,TRUE,FALSE);
    END "DpyLoop";

    WHILE TRUE DO
    BEGIN
      IF (Ts←INCHWL)="w" OR Ts="W" THEN DpyWrt(Id,"ACRC.PLT")
      ELSE IF Ts="R" OR Ts="r" THEN BEGIN QUICK!CODE PGIOT 2, END; MWrite(Id,0) END
      ELSE DONE
    END;
    Drels(Id);
  END "DpyAC";

COMMENT Toward the solution of G(Pd) + Pd - Pdp = 0,
        Replace G(Pd) by G(Pd) + Pd
        (which is approximately Pd
        since G=(Zb/Za)×Pd and Zb<<Za)
;
  FOR iEmb←1 STEP 1 UNTIL NEmb DO
    FOR iPd←1 STEP 1 UNTIL NPd DO
      Garr[I←iPd+(iEmb-1)×NPd] ← Garr[I] + (Pd ← Pdmin + (iPd-1)×dPd);

  DpyEdl(Garr,NPd,Pstr,"G+Pd",Pdmin,Pdmax);

COMMENT Now solve for aperture reflection coefficient;

  FOR iEmb←1 STEP 1 UNTIL NEmb DO
  BEGIN "Solv"
```

BEST AVAILABLE COPY

BEST AVAILABLE COPY

```
REAL PROCEDURE GPdpPd(REAL Pd; INTEGER iEmb);
# Return G(Pd)+Pd using Garr[1:NPd] for a coarse result,
  and use linear interpolation between samples;
# Return Garr[1+(Npd-1)*((Pd-PdMin)/(PdMax-PdMin))+(iEmb-1)*Npd];
BEGIN "GPdpPd"
  INTEGER i1,i2,iof;
  OWN BOOLEAN Inited;
  OWN REAL a,b;
  REAL g,rndx,ri1;
  IF NOT Inited THEN
  BEGIN "Init"
    Inited←TRUE;
    a ← (Npd-1)/(PdMax-PdMin);
    b ← 1-(Npd-1)*PdMin/(PdMax-PdMin);
  END "Init";
  rndx ← a*Pd+b; # Desired lookup index;
# Do linearly interpolated lookup;
  i1 ← rndx;
  IF Trace AND NOT (1 LEQ i1 LEQ Npd)
    THEN PRINT(" 2*Pdp-PM exceeds PdMin or PdMax",CrLf,
                " For Pd=",Pd,", indx = ",i1,CrLf);
  ri1 ← i1;
  g ← rndx - ri1;
  i1 ← (1 MAX i1 MIN Npd);
  i2 ← (i1 + 1) MIN Npd;
  iof ← (iEmb-1)*Npd;
  i1 ← i1 + iof;
  i2 ← i2 + iof;
  RETURN(Garr[i1]+g*(Garr[i2]-Garr[i1]));
END "GPdpPd";

#  We now find the solution Pd of the equation G(Pd) + Pd - Pdp = 0,
   for the complete range of Pdp values to be supported in operation,
   using a general local zero finder. For astable operation of the reed,
   the wave-impedance line should intersect the negative-resistance
   portion of the reed impedance curve in only one place. This means
   G(Pd)+Pd should be strictly increasing which implies the existence
   of only one zero.

INTEGER iPdp,i;
REAL PROCEDURE GPdpPdmPdp(REFERENCE REAL Pd); RETURN(GPdpPd(Pd,iEmb)-Pdp);

Emb ← Emin+(iEmb-1)*dE;      # Current embouchure;
PRINT(" Solving fixed-point problem for embouchure ",Emb,CrLf);
dPdp←(Pdpmax-Pdpmin)/(NPdp-1);

Xstr ← " Emb="&Cvfs(Emb)&", Pdc="&Cvfs(Pdc)&": Pd (dyne/cm^2)";

Pd←(PdMin MAX 0 MIN PdMax); # First search set to midpoint in sym. case;
Pdp ← PdpMin-dPdp;
FOR iPdp←1 STEP 1 UNTIL NPdp DO
BEGIN "PdpLoop"
  Pdp ← Pdp + dPdp;
  # Search from previous solution for new solution;
  IF NOT FindZero(Pd,GPdpPdmPdp,PdMin,PdMax,Pd,dPd)
    THEN PRINT(" No zero",CrLf);
  # Repeat at reduced step size (assumes interpolation in GPdpPd);
  IF NOT FindZero(Pd,GPdpPdmPdp,PdMin,PdMax,Pd,dPd*StepReduce)
    THEN PRINT(" No zero",CrLf);
  i ← iPdp+(iEmb-1)*NPdp;
  PdArr[i] ← Pd;
  rc ← (IF ABS(Pdp) GEQ dPd*StepReduce THEN 2*(Pd/Pdp)-1 ELSE rc);
  RCarr[i] ← rc;

  IF Debug(3) AND ABS(Pdp) LEQ (PdpMax-PdpMin)/20 THEN
  BEGIN "seeG"
     REAL ARRAY TmpArr[1:NPd*NEmb];
     INTEGER jEmb,jPd,i;
     FOR jEmb←1 STEP 1 UNTIL NEmb DO
     BEGIN
       INTEGER ndx,iof;
       FOR jPd←1 STEP 1 UNTIL NPd DO
         TmpArr[i←(jPd+(jEmb-1)*NPd)] ← Garr[i] - Pdp;
       ndx←1+(Npd-1)*((Pd-PdMin)/(PdMax-PdMin));
       IF NOT (1 LEQ ndx LEQ Npd) THEN BEGIN PRINT(" REALITY FAILURE ");
          ndx ← (1 MAX ndx MIN Npd) END;
       iof←(jEmb-1)*Npd;
       TmpArr[ndx+iof]←TmpArr[1+iof]; # Mark found zero-crossing;
     END;
     DpyEd(TmpArr,NPd,"G(Pd)+Pd-Pdp vs. Pd for Pdp="&CvFs(Pdp)&","&Xstr,
          "G+Pd-Pdp",PdMin,PdMax);
  END "seeG";
END "PdpLoop";
END "Solv";

DpyEd2(PdArr,NPdp,"Pd(Pdp):"&Xstr,"Pd",PdpMin,PdpMax,PdpMin,PdpMax);
DpyEd2(RCarr,NPdp,"Reflection coeff vs. Pdp for"&Xstr,"RC",PdpMin,PdpMax);
```

```
COMMENT PRACTICAL NOTE
        RCarr is written out (using the write-file option of DpyEd) to
        a disk file which is subsequently read by JCLA (after suitable
        format conversion) and used for the clarinet simulation reed table.
;
  BEGIN "DpyAll"
    INTEGER Id,i;
    STRING Ts,Xstr;
    REAL Ymin,Ymax;
    REAL ARRAY Buf[1:NPdp];

    Xstr ← " Emb="&Cvfs(Emb)&
           ", Pdc="&Cvfs(Pdc)&": Pdp (dyne/cm2)";
  # Ymin ← MinArr(NPdp*NEmb,PdArr);
  # Ymax ← MaxArr(NPdp*NEmb,PdArr);
    Ymin ← PdpMin;
    Ymax ← PdpMax;
    IF Ymin GEQ Ymax THEN
    BEGIN PRINT(Xstr,CrLf," PLOT IS CONSTANT = ",Ymin,CrLf); CALL(0,"EXIT") END;
    DPYOVL(PdArr,NPdp,Id←0,"Pd(Pdp): "&Xstr,"Pd",Ymin,Ymax,PdpMin,PdpMax,FALSE,TRUE,NEmb*NPdp+1000);
    FOR i←2 STEP 1 UNTIL NEmb DO
    BEGIN "DpyLoop"
      ARRBLT(Buf[1],PdArr[(i-1)*NPdp+1],NPdp);
      DPYOVL(Buf,NPdp,Id,NULL,NULL,Ymin,Ymax,PdpMin,PdpMax,TRUE,FALSE);
    END "DpyLoop";
    WHILE TRUE DO
    BEGIN
      IF (Ts←INCHWL)="w" OR Ts="W" THEN DpyWrt(Id,"PD"&CVS(iEmb)&".PLT")
      ELSE IF Ts="R" OR Ts="r" THEN BEGIN QUICK!CODE PGIOT 2, END; MWrite(Id,0) END
      ELSE DONE
    END;
    Drels(Id);

    Ymin ← MinArr(NPdp*NEmb,RCArr);
    Ymax ← 1.1*MaxArr(NPdp*NEmb,RCArr);
    IF Ymin GEQ Ymax THEN
    BEGIN PRINT(Xstr,CrLf," PLOT IS CONSTANT = ",Ymin,CrLf); CALL(0,"EXIT") END;
    DPYOVL(RCArr,NPdp,Id←0,"Pbe/Pdp: "&Xstr,"R.C.",Ymin,Ymax,PdpMin,PdpMax,FALSE,TRUE,NEmb*NPdp+1000);
    FOR i←2 STEP 1 UNTIL NEmb DO
    BEGIN "DpyLoop"
      ARRBLT(Buf[1],RCArr[(i-1)*NPdp+1],NPdp);
      DPYOVL(Buf,NPdp,Id,NULL,NULL,Ymin,Ymax,PdpMin,PdpMax,TRUE,FALSE);
    END "DpyLoop";
    WHILE TRUE DO
    BEGIN
      IF (Ts←INCHWL)="w" OR Ts="W" THEN DpyWrt(Id,"RC"&CVS(iEmb)&".PLT")
      ELSE IF Ts="R" OR Ts="r" THEN BEGIN QUICK!CODE PGIOT 2, END; MWrite(Id,0) END
      ELSE DONE
    END;
    Drels(Id);
  END "DpyAll"
END "ReadF";
```

APPENDIX B

COPYRIGHT 1986 - THE BOARD OF TRUSTEES
OF THE LELAND STANFORD JUNIOR UNIVERSITY

```
COMMENT Experimental Clarinet

Modification history:

3-MAR-86 version is first toot (used with JCLA.JET at that time).
16-MAR-86 - Added bell output highpass filter and changed L1 meaning.
16-MAR-86 - Placed DC blocking "cap" in bore.
25-MAR-86 - Added easier breakpoint control of RC table Rf.
TO DO ::: - Add clipper.


        To run:
                .R JETSAM
                *Jcla←Jcla
                a<CALL>
                EX Jcla

READ JETSAM for more information.

Relevant files:

SPECS/D
JETSAM/D
JETINS/D
JETSAM.SAI[LIB,BIL]
UDP2:JETINS.SAI[LIB,BIL]
MODES.TBL[LIB,BIL]
LOWER.DEF[NEW,MUS]
```

```
SAFLIB/D
:

REQUIRE "<><>" DELIMITERS;
REDEFINE #="COMMENT";
REDEFINE Thru=c step 1 until >,ALT=c'175>,CR=c'15>,CRLF=c('154'12)>,TAB=c('11&"")>;
REDEFINE Ck=c(IF Tr THEN Report ELSE Null'Message)>;
DEFINE WriteMode = "Write'Data+Gl'sinus'GQ+Sine";

INTEGER Tr;

REQUIRE " Need DPYENV.REL(SAM,JDS)" MESSAGE;
REQUIRE "DPYENV.REL(SAM,JDS)" LOAD'MODULE;

PROCEDURE pgclr; Quick'code pglot 2, end;  COMMENT clear all pieces of glass;

PROCEDURE Where(STRING Arg(NULL));
BEGIN "Where"
  IF Arg=NULL THEN
  BEGIN "Where"
      INTEGER i;
      DEFINE Nmax="60", j="i+i+1";
      STRING ARRAY W[1:Nmax];
      OWN INTEGER Seed;
      IF Seed = 0 THEN BEGIN Seed = MEMORY['17]; Seed+999999=RAN(Seed); END;
      i=0;
      W[j]+"in the morning paper";
      W[j]+"on the bathroom wall";
      W[j]+"upstairs";
      W[j]+"on the bumper";
      W[j]+"in the event of results";
      W[j]+"where you least expect it";
      W[j]+"between samples";
            on the tombstone";
            in the wizards' mail";
      W[j]+"in the obituaries";
      W[j]+"on the bottle";
      W[j]+"as a disclaimer";
      W[j]+"encrypted without a password";
      W[j]+"elsewhere";
      W[j]+"loosely speaking";
      W[j]+"as it were";
      W[j]+"in the core dump";
      W[j]+"on your forehead";
      W[j]+"in the fortune cookie";
      W[j]+"along with floating underwear messages";
      W[j]+"where it will never be read";
      W[j]+"somewhere";
      W[j]+"somewhere reasonable";
      W[j]+"as a token of our appreciation";
      W[j]+"a little bit to the left";
      W[j]+"as a reminder of Jezebelle";
      W[j]+"under the boardwalk";
      W[j]+"in tribute to the bit bucket";
      W[j]+"in an artificially intelligent place";
      W[j]+"on your W2 forms";
      W[j]+"in your credit file";
      W[j]+"in your letters home";
      W[j]+"in the ICMC abstracts";
      W[j]+"under consideration";
      W[j]+"in Patte's mail file";
      W[j]+"in a bug-report to BIL";
      W[j]+"in DAJ's floor space";
      W[j]+"in escrow";
      W[j]+"and then unplaced";
      W[j]+"where you wish";
      PRINT(W[RAN(8)mi+.45 MAX 1]);
  END "Where"
  ELSE PRINT(" Where else?");
END "Where";
COMMENT TbLook - table lookup object
;
INTEGER_OBJECT TbLook(ArgStr);
BEGIN
INTEGER i,DlyAdr,Scal,DlyPort,Modl,InLoc,OutLoc,DlyLen;
BOOLEAN GotPos,GotOut,GotAdr;
POINTER CurArg;
REAL QuitTime;
DlyPort=Modl=InLoc=OutLoc=DlyAdr=InValid_pe;
DlyLen=QuitTime=-1;
GotPos=TRUE;
GotOut=FALSE;
GotAdr=FALSE;
FOR i=1 STEP 1 UNTIL ArgNum DO
  BEGIN
  CurArg=GetArg;
  IF CurArg=NULL_RECORD
```

BEST AVAILABLE COPY

```
  THEN
    CASE IntMsg:Msg[CurArg] OF
      BEGIN
      [#Report]
      [#Null_Message] ;
      [#Address]      DlyAdr←IntMsg:Val[CurArg];
      [#Scale]        Scal←IntMsg:Val[CurArg];
      [#InputA]       InLoc←IntMsg:Val[CurArg];
      [#Output]       OutLoc←IntMsg:Val[CurArg];
      [#Len]          DlyLen←IntMsg:Val[CurArg];
      [#UsePatch]
          BEGIN "Patch"
          IF PeType(SpcMsg:i1[CurArg])=Modifier_pe
            THEN
              BEGIN
              Mod1←SpcMsg:i1[CurArg];
              DlyPort←SpcMsg:i2[CurArg];
              END
          ELSE
              BEGIN
              Mod1←SpcMsg:i2[CurArg];
              DlyPort←SpcMsg:i1[CurArg];
              END;
          IF PeType(DlyPort)≠Delay_pe THEN BoxError("Patch list delay is invalid");
          IF PeType(Mod1)≠Modifier_pe THEN BoxError("Patch list modifier is invalid:"&CVOS(Mod1));
          GotPes←FALSE;
          END "Patch";
      [#QuitAt]       QuitTime←RlMsg:Val[CurArg];
      [#Duration]     QuitTime←RlMsg:Val[CurArg]+Pass/Srate;
      ELSE BoxError("Tblook cannot handle "&GetMethodName[IntMsg:Msg[CurArg]])
      END
  ELSE DONE;
  END;
IF PeCheck(DlyPort)=invalid_pe THEN DlyPort←Get(Delay_pe,-1,"TblDly");
IF PeCheck(Mod1)=invalid_pe THEN Mod1←Get(Modifier_pe,-1,"TblMod");
IF PeCheck(OutLoc)=invalid_pe
  THEN BEGIN GotOut←TRUE; OutLoc←Get(ModSum_pe,-1,"TblOutLoc"); END;
IF DlyAdr=invalid_pe
  THEN
    IF DlyLen>0
      THEN
        BEGIN
        DlyAdr←Get(DmAddr_pe,DlyLen,"TblMem");
        GotAdr←TRUE;
        END
    ELSE BoxError("Tblook got neither a valid delay address, nor a delay length");
SamDly(Use(DlyPort),Address(DlyAdr),Mode(Rounded_Lookup),Scale(Scal));
SamMod(Use(Mod1),InputA(InLoc),Mode(Delay_Unit),Delay(DlyPort),Output(OutLoc));
IF QuitTime>0
  THEN
    BEGIN
    IF GotPes THEN FreeAll(QuitTime,DlyPort,Mod1);
    IF GotAdr THEN Free(QuitTime,DlyAdr);
    IF GotOut THEN Free(QuitTime,OutLoc);
    END;
RETURN(OutLoc);
END;
COMMENT Impulse, Constant, Noise;

COMMENT Impulse Instrument;

    PROCEDURE Impulse(REAL Beg,Dur,Amp; INTEGER OutLoc);
    BEGIN "Impulse"
        StopUntil(Beg);
        # One zero.  S := L1=M1 + L0=M0! L0 := L1! L1 := A;
        SamMod (Mode(One_Zero),QuitAt(Beg+Dur),
                Term8((Amps((1 LSH 19)-1))),
                Gain8(1),Output(OutLoc),Etc);
    END "Impulse";

COMMENT Step Instrument;

    PROCEDURE Constant(REAL Beg,Dur,Amp; INTEGER OutLoc);
    BEGIN "Constant"
        StopUntil(Beg);
        IF PeT[illegible]
          [illegible],Et[illegible]
        ELSE IF PeType(OutLoc)=GenSum_Pe THEN
            SamGEN(QuitAt(Beg+Dur),Amplitude(2*Amp),Output(OutLoc),
                Phase(90),Frequency(0),Etc)
        ELSE PRINT(" Constant: OutLoc is not a sum memory location! ");
    END "Constant";

COMMENT Noise Instrument;

    PROCEDURE Noise(REAL Beg,Dur,Amp; INTEGER OutLoc, Seed(0));
    BEGIN "Noise"
        INTEGER RanSum;
        StopUntil(Beg);
        RanSum ← (IF Amp=1 THEN OutLoc ELSE Get(ModSum!Pe,-1,"NoiseOut"));
```

BEST AVAILABLE COPY

BEST AVAILABLE COPY

```
        SawMod(QuitAt(Beg+Dur), Mode(Uniform_noise),
            InputA(Zero),InputB(Zero),Output(RanSum),
            Coeff0('1254635 LSH 18), Coeff1(0), Scale0(2),Scale1(0),
            Term0('668623),Term1('1777777aRAN(Seed)), Etc);
        IF Amp NEQ 1 THEN
            MixSig(QuitAt(Beg+Dur),Output(OutLoc),InputA(RanSum),Gain(Amp),Etc);
    END "Noise":

COMMENT Woodwind Bore with output at bell and internal DC blocking;

    INTEGER PROCEDURE Bore(REAL Beg,Dur,Lg,Fg,Rp,Rz;
                           INTEGER Li,PbpSum,PbaSum);
    BEGIN "Bore"
        DEFINE Q=c QuitAt(Beg+Dur) >;
        INTEGER FltIn,FltOut,Cap1,Cap2,Cap3,DelLen,OutSum,Out1;
        DelLen ← (Li-5)/2; # Li = delay from PbaSum to PbpSum;
        StopUntil(Beg);
        FltIn ← DlyLin(Q,InputA(PbaSum),Len(DelLen-3),Etc);
# RguPe ← Get(Delay+Pe), FltIn ← DlyLin(...,Use(RguPe));
        FltOut ← OnePole(Q,Gain(-Lgs(1-ABS(Fg))),Coeff(Fg),InputB(FltIn),Etc);
        Cap1 ← OneZero(Q,Coeff(Rz),Gain(1/(1+Rz)),InputA(FltOut),Etc);
        Cap2 ← OnePole(Q,Gain(1+Rp),Coeff(Rp),InputB(Cap1),Etc);
        DlyLin(Q,InputA(Cap2),Len(DelLen-3),Output(PbpSum),Etc);
        Out1 ← OneZero(Q,Coeff(1),Gain(0.5),InputA(FltIn),Etc);
        OutSum ← OnePole(Q,Gain(Fg),Coeff(Fg),InputB(Out1),Etc); # Bell;
        RETURN(OutSum);
    END "Bore":

COMMENT Reed Mouthpiece
:
    INTEGER PROCEDURE Reed(REAL Beg,Dur; INTEGER TblAdr,TblPwr2,Pa2Sum,PbpSum);
    BEGIN "Reed"
        INTEGER TblIn,TblOut,TblLen,MidSum,PdpSum,PdpdSum,Pa2dSum,TmpSum,PbaSum,MaxIn,MinIn;
        REAL EndT; EndT←Beg+Dur;
        StopUntil(Beg);
        TblLen ← 2↑TblPwr2;      # Table lookup length in samples;
        PdpSum ← MixSig(QuitAt(EndT),InputA(PbpSum),Gain0(1),
                        InputB(Pa2Sum),Gain1(-1),Etc); # Input is Pa/2;
        PdpdSum ← DlyLin(QuitAt(EndT),InputA(PdpSum),Len(4-3),Etc); # Pipe correction;
#       MidSum ← SawGEN(QuitAt(EndT),Frequency(0),Phase(90),
                Amplitude(2×(TblLen-0.5)/(2↑28)),Etc);
        MidSum ← LatchSig(QuitAt(EndT),Term1(TblLen×2),Etc);
        MaxIn ← MixSig(QuitAt(EndT),InputA(MidSum),Gain0(1),
                InputB(PdpSum),Coeff1(TblLen×2 LSH 10),Etc); # 10=DX len;
#               InputB(PdpSum),Gain1((TblLen/2)/2↑19),Etc);
        MinIn ← MaxSig(QuitAt(EndT),InputA(Zero),InputB(MaxIn),Gain1(1),Etc);
        TblIn ← MinSig(QuitAt(EndT),InputA(MidSum),Gain0(2-2↑(1-TblPwr2)),
                InputB(MinIn),Gain1(1),Etc);
        TblOut ← TbLook(QuitAt(EndT),InputA(TblIn),
                        Scale(0),Address(TblAdr),Len(TblLen));
        PbaSum ← MulSig(QuitAt(EndT),InputA(TblOut),InputB(PdpdSum),Gain1(1),Etc);
        DlyLin(QuitAt(EndT),Output(PbaSum),InputA(Pa2S
        RETURN(PbaSum);
    END "Reed":

COMMENT Pipeline delays not counting sum memory interconnect:
MixSig  0
DlyLin  3
RevSig  1
TbLook  3
MulSig  1
OnePole 0
OneZero 1
:
End!Instruments;
COMMENT Global variables;

INTEGER PbpSum,PbaSum,Li,RcT;
REAL Beg,Dur,Lg,Fg,Ta,Pa,Fs,Eps,Rp,Rz,Rn,Ng,Emb,Stif,AMa,AMf;
BOOLEAN Rt,It,Wd;
STRING What,SATfile;
EXTERNAL INTEGER NoCYOS;

INTEGER TblAdr,Pa2Sum;
DEFINE TblPwr2="10",Nrc="2↑TblPwr2";
INTEGER ARRAY RC[0:Nrc]; # Extra 1st Wd used by DelayArray for wcma;

DEFINE RTflag = "(IF Rt THEN RealTime ELSE Null!Message)";
DEFINE StdOpen=cSetSrate(Fs),RTflag,Channels(2),Optimize(CombineBit),DvStop,Etc>;

DEFINE WDfile(x)=c(IF Wd AND NOT Rt THEN WriteDataFile(x) ELSE NULL!MESSAGE)>;
DEFINE RTreport=c(IF NOT Rt THEN Report ELSE NULL!MESSAGE)>;

DEFINE Q=c QuitAt(Beg+Dur) >;

POINTER Pf,Rf;

PROCEDURE CkEnv; IF Emb NEQ 0 THEN Rf←MakEnv("0 1 "&CYF(Emb×100)&" 1 100 "&CYF(Stif));
```

BEST AVAILABLE COPY

```
COMMENT GetRCtable - Load Reflection-Coefficient Table;
PROCEDURE GetRCtable(INTEGER ARRAY RC; INTEGER N);
BEGIN "GetRCtable"
    INTEGER i,Chan,Brk,Eof;
    IF RcT=1 THEN
    BEGIN
        FOR i←1 STEP 1 UNTIL N DO RC[i]←Tas(2↑19-1); # 1-Epsilon;
        PRINT("RC table is constant = ",Ta,CrLf);
    END
    ELSE IF RcT=2 THEN
    BEGIN
        STRING Ts;
        IF SATfile=NULL THEN
        BEGIN
            PRINT("Length ",N," input SAT file = ");
            SATfile ← INCHWL;
        END ELSE
        BEGIN
            PRINT("Using previous table SATfile = ",SATfile,CrLf,
                " (Set NULL to override)",CrLf);
            RETURN
        END;
        OPEN(Chan←GetChan,"DSK",'17,0,2,0,Brk,Eof); IF Eof THEN PRINT("open failed");
        LOOKUP(Chan,SATfile,Eof);                   IF Eof THEN PRINT("LOOKUP failed");
        ARRYIN(Chan,RC[0],N+1);
        RELEASE(Chan);
        PRINT("File ",SATfile," loaded.",CrLf);
    END
    ELSE
    BEGIN
        RcT←3;
        FOR i←1 STEP 1 UNTIL N DO RC[i] ← (2↑19-1)×EnvY((i-1)×100/(N-1),Rf) MAX 0;
        PRINT("RC table set to current Rf function.",CrLf);
    END;
END "GetRCtable";
COMMENT PutRCtable - Generate Reflection-Coefficient Table;

PROCEDURE PutRCtable;
BEGIN "PutRCtable"
    INTEGER i,Chan,Brk,Eof;
    STRING Onase;
    GetRCtable(RC,Nrc);
    PRINT("Output SAT file = ");
    Onase ← INCHWL;
    OPEN(Chan←GetChan,"DSK",'17,0,2,0,Brk,Eof); IF Eof THEN PRINT("open failed");
    ENTER(Chan,Onase,Eof);                      IF Eof THEN PRINT("enter failed");
    ARRYOUT(Chan,RC[0],Nrc+1);
    RELEASE(Chan);
    PRINT("File ",Onase," written.",CrLf);
END "PutRCtable";

COMMENT Dtest - Delay-line test;

PROCEDURE Dtest;
BEGIN "Dtest"
    StartSas(StdOpen,File("Dtest.Sas"),WDfile("Dtest.snd")); PRINT(CrLf);
    Bind(Sasbox,SetPass(BegasSrate));
    PbasSus ← DACModSus[0];  PbpSus ← DACModSus[1];
    DlyLin(Q,Len(L1-3),InputA(PbpSus),Output(PbasSus),Etc);
    DlyLin(Q,Len(L1-3),InputA(PbasSus),Output(PbpSus),Etc);
    IF It THEN Impulse(Beg+Eps,Dur,Ta,PbpSus)
        ELSE Noise(Beg+Eps,Beg+2×L1/Srate,Ta,PbpSus);
    IF Wd THEN WriteSig(Q,InputA(PbpSus),Etc);
    StopSas(Q,RTreport);
END "Dtest";

COMMENT Btest - Bore test;

PROCEDURE Btest;
BEGIN "Btest"
    StartSas(StdOpen,File("Btest.Sas"),WDfile("Btest.snd")); PRINT(CrLf);
    Bind(Sasbox,SetPass(BegasSrate));
    PbasSus ← DACModSus[0];  PbpSus ← DACModSus[1];
    IF Wd THEN WriteSig(Q,InputA(PbpSus),Etc);
    DlyLin(Q,Len(6-3),InputA(PbpSus),Output(PbasSus),Etc);
    Bore(Beg,Dur,Lg,Fg,Rp,Rz,L1,PbpSus,PbasSus);
    IF It THEN Impulse(Beg+Eps,Dur,Ta,PbpSus)
        ELSE Noise(Beg+Eps,Beg+2×L1/Srate,Ta,PbpSus);
    StopSas(Q,RTreport);
END "Btest";

COMMENT Rtest - Reed test;

PROCEDURE Rtest;
BEGIN "Rtest"
    INTEGER i,OutSus,NoiSus,MixSus,Pa2Sus,AsgSus,PfaSus;
    StartSas(StdOpen,File("Rtest.Sas"),WDfile("Rtest.Snd"),HogSas); PRINT(CrLf);
    TblAdr←GetF(Beg+Dur,DaAddr_pe,Nrc,"RCtable");
    IF Rt THEN BEGIN
        GetRCtable(RC,Nrc);
```

BEST AVAILABLE COPY

```
        DelayArray(RC,TblAdr,Nrc);
    END ELSE PRINT("TblAdr=","",cvos(PeNumber(TblAdr)),CrLf);
    Bind(Sambox,SetPass(Beg*Srate));
    [illegible]
    OutSum ← DACModSum[1];
    PfaSum ← SawGEN(Q,AmpEnv(SclEnv(Pf,Pa)),Frequency(0),Phase(90),Gshift(gs_off),Etc);
    NoiSum ← OnePole(Q,Gain(Ngm(1-Rn)),Coeff(Rn),InputB(NoiSig(Q,Etc)),Etc);
    MixSum ← MixSig(Q,InputA(PfaSum),Gain0(1),InputB(NoiSum),Gain1(1),Etc);
    AmgSum ← SawGEN(Q,Amplitude(AMa),Frequency(AMf),Gshift(gs_off),Etc);
    Pm2Sum ← SawMOD(Q,Mode(Am),Gain1(2-AMa),InputA(MixSum),InputB(AmgSum),Etc);
    PbaSum ← Reed(Beg,Dur,TblAdr,TblPur2,Pm2Sum,PbpSum);
    OutSum ← Bore(Beg,Dur,Lg,Fg,Rp,Rz,Ll,PbpSum,PbaSum);
    IF Wd THEN WriteSig(Q,InputA(PbaSum),Etc);
    IF Ta>0 THEN IF It THEN Impulse(Beg+Eps,Dur,Ta,PbpSum)
                        ELSE Constant(Beg+Eps,Dur,Ta,MixSum);
    StopSam(Q,RTreport);
END "Rtest";

COMMENT KeyTest - Test playing from the keyboard;

PROCEDURE KeyTest;
BEGIN "KeyTest"
    INTEGER i,OutSum,NoiSum,MixSum,Pm2Sum,AmgSum,PfaSum;
    StartSam(StdOpen,File("KeyTest.Sam"),WDfile("KeyTest.Snd"),HogSam); PRINT(CrLf);
    TblAdr←GetF(Beg+Dur,DmAddr_pe,Nrc,"RCtable");
    IF Rt THEN BEGIN
        GetRCtable(RC,Nrc);
        DelayArray(RC,TblAdr,Nrc);
    END ELSE PRINT("TblAdr=","",cvos(PeNumber(TblAdr)),CrLf);
    Bind(Sambox,SetPass(Beg*Srate));
    PbpSum ← DACModSum[0];
    OutSum ← DACModSum[1];
    PfaSum ← SawGEN(Q,AmpEnv(SclEnv(Pf,Pa)),Frequency(0),Phase(90),Gshift(gs_off),Etc);
    NoiSum ← OnePole(Q,Gain(Ngm(1-Rn)),Coeff(Rn),InputB(NoiSig(Q,Etc)),Etc);
    MixSum ← MixSig(Q,InputA(PfaSum),Gain0(1),InputB(NoiSum),Gain1(1),Etc);
    AmgSum ← SawGEN(Q,Amplitude(AMa),Frequency(AMf),Gshift(gs_off),Etc);
    Pm2Sum ← SawMOD(Q,Mode(Am),Gain1(2-AMa),InputA(MixSum),InputB(AmgSum),Etc);
    PbaSum ← Reed(Beg,Dur,TblAdr,TblPur2,Pm2Sum,PbpSum);
    OutSum ← Bore(Beg,Dur,Lg,Fg,Rp,Rz,Ll,PbpSum,PbaSum);
    IF Wd THEN WriteSig(Q,InputA(PbaSum),Etc);
    IF Ta>0 THEN IF It THEN Impulse(Beg+Eps,Dur,Ta,PbpSum)
                        ELSE Constant(Beg+Eps,Dur,Ta,MixSum);
    PRINT("Entering play loop:",CrLf);
    WHILE TRUE DO
    BEGIN
    StopSam(Q,RTreport);
END "KeyTest";

COMMENT Who, Save;


PROCEDURE Who;          COMMENT Print globals;
BEGIN "Who"
    REDEFINE SemiCrLf=c(";"&"15&"12)>;
    PRINT(Tab,"Rt=",(IF Rt THEN "TRUE" ELSE "FALSE"),SemiCrLf);
    IF Rt THEN Wd←FALSE;
    PRINT(Tab,"Wd=",(IF Wd THEN "TRUE" ELSE "FALSE"),SemiCrLf);
    PRINT(Tab,"Pf←MakEnv(""",PrtEnv(Pf),""")",SemiCrLf);
    PRINT(Tab,"Rf←MakEnv(""",PrtEnv(Rf),""")",SemiCrLf);
    IF RcT=2 THEN PRINT(Tab,"SATfile←""",SATfile,"""",SemiCrLf);
    PRINT(CrLf);
    PRINT(Tab,"RcT=",RcT,SemiCrLf);
#   PRINT(Tab,"Beg=",Beg,SemiCrLf);
    PRINT(Tab,"Dur=",Dur,SemiCrLf);
    PRINT(Tab,"Ll=",Ll,"; COMMENT Pitch = "&CYF(Fs/Ll)&";",CrLf);
    PRINT(Tab,"Pa=",Pa,SemiCrLf);
    [illegible]
    PRINT(Tab,"Lg=",Lg,SemiCrLf);
    PRINT(Tab,"Fg=",Fg,SemiCrLf);
    PRINT(Tab,"Rp=",Rp,SemiCrLf);
#   PRINT(Tab,"Rz=",Rz,SemiCrLf);
    PRINT(Tab,"Ng=",Ng,SemiCrLf);
    PRINT(Tab,"Rn=",Rn,SemiCrLf);
    PRINT(Tab,"Tr=",Tr,SemiCrLf);
    PRINT(Tab,"AMa=",AMa,SemiCrLf);
    PRINT(Tab,"AMf=",AMf,SemiCrLf);
#   PRINT(Tab,"Eab=",Eab,SemiCrLf);
#   PRINT(Tab,"Stif=",Stif,SemiCrLf);
    PRINT(Tab,"Fs=",CYS(Fs),SemiCrLf);
    IF Ta>0 THEN
    BEGIN
        PRINT(Tab,Tab,"It=",(IF It THEN "TRUE" ELSE "FALSE"),SemiCrLf);
        PRINT(Tab,Tab,"Eps=",Eps,SemiCrLf);
    END;
END "Who";

PROCEDURE Save(STRING Fname("JCLA"));   COMMENT Save globals;
BEGIN "Save"
    IF Fname=NULL THEN BEGIN  Print("Output JET file:"); Fname←INCHWL END;
    IF Fname=NULL THEN RETURN;
    SETPRINT(Fname,"B"); Who; SETPRINT(NULL,"T")
END "Save";
```

```
COMMENT Set up defaults and try it:

    PROCEDURE E(STRING F(NULL)); EvalF("DSK",(IF F THEN F ELSE "JCLA.JET")); E;

    REDEFINE r="Rtest"; # I hate to type;
    REDEFINE dr = "dpyenv(rf)";
    REDEFINE da = "dpyenv(pf)";

    PRINT(CrLf,"JCLA:  ",
     COMPILER!BANNER[LENGTH(SCANC(COMPILER!BANNER,"11&","","sinz"))+11 FOR 17],CrLf);
    SETFORMAT(0,3);
    NoCYOS = TRUE; COMMENT If Evaluator doesn't recognize type, don't print;
    Ta = 0;
      It = FALSE;
      Eps = 0.01;
    Tr = 0;
    RcT=3;
    AMa=0;
    AMf=0;

    What = "Who,What,':'"&CrLf&"OpenFile(name),CloseFile,Btest,Rtest";

    WHILE TRUE DO SAILError(0,"Who,What,Where, or ':'","");

    Save;

END "JetSam";
```

BEST AVAILABLE COPY

```
JCLA

Determine if pipe corrections are needed
How to get proper clipping?
Noise may need 1pole lowpass or so. Should sound normal.
Fix DC onset slap in JCLA
Try bigger table
Flare bell
Sum output correctly for tone holes
Future: two bores

#28-Mar-86  1839        JDS
Clip and delay-change control

Reason for signal heat w rc=0 at right: At + signal extreme, all of
mouth pressure gets gated in, and since mouth pressure is maxamp,
this yields largest possible reflection signal. Perhaps key thing
is whether slope exceeds -1 or some such.


#22-Mar-86  0819        JDS     JCLA

COMMENT T1 Make a clarinet double toot:

Pf=MakEnv("0 0  25 1  50 0  75 1  100 0");
Rf=MakEnv("0 1  25 1  65.0  .88  100 .82");

Li=91; Beg= .0; Dur= 5.00; Pa= 1.00; Ta= .0; Lg= .990; Fg= .700; Rp= .0;
Rz= 1.00; Ng= 0; Rn= .9; Tr=0; Fs=40000;


COMMENT T2 = T1 except reduce Rf at right and dampen bore:

        Pf=MakEnv("0 0  25 1  50 0  75 1  100 0");
        Rf=MakEnv("0 1  25 1  100 0");

Li=31; Beg= 0; Dur= 5.0; Pa= 1.0; Ta= 0; Lg=.95; Fg= .700; Rp= 0;
Rz=1.0; Ng= 0; Rn= 0; Tr=0; Fs=40000;

COMMENT

OutSum (bell output) WAY too faint. Also, it's not much brighter.
Bore signal is strong but too bassy.
Signal is very sensitive to breakpoint loc. Moving left or right worsens.
Decreasing rightmost rc in Rf makes the note louder! We can compensate
  by decreasing Lg as we have done here.
Noise added to mouth pressure didn't change anything fundamental (Ng>0).
  Oddly, the noise level gets modulated somehow by the note amplitude.
Brightness: Set Fg from .7 to .1
  Fg=.7 is not bright enough.
  Fg=-.1 gives highpass in loop. Less than this does not sound.
;


COMMENT T3 (wow) = T2 except less lowpass, hotter bore, Ps noise:

        Rt=TRUE;
        Wo=FALSE;
        Pf=MakEnv("  0  0  25 1  50 0  75 1 100 0");
        Rf=MakEnv("  0  1  25 1  100 0");
```

```
Li←91; Beg← 0; Dur← 5.0; Pa← 1.0; Ta← 0; Lg← .970; Fg← .500; Rp← 0;
Rz←1.0; Rg← .85; Rn← 0; Tr←0; Fs←40000;

COMMENT In this case, amazingly, the first note almost "overblows" to
yield the 3rd harmonic (a fifth up). The two notes are identical but
for what the noise is doing, yet the second note has a solid fundamental
and sounds completely different wrt timbre.
:

8/29/86 (it's been a while!)

Wrote GENSAT.SAI to try some other RC functions.
First repeated the function in wow.jet and got
identical results. Next tried order 2: Found that
threshold blowing pressure (TBP) dropped to about
Pa=0.5, and at Pa=0.8, the note duration was about
the same as before.
JCLA examples

#21-Mar-86  0151          JOS
COMMENT Make a clarinet double toot;

        Rt←TRUE;          Wd←FALSE;
        Pf←MakEnv("0 0  25 1  50 0  75 1  100 0");
        Rf←MakEnv("0 1  25 1  65.0  .88  100 .82");

        Li←100; Beg← .0; Dur← 5.00; Pa← 1.00; Ta← .0; Lg←.99;
        Fg← .700; Rp← .0; Rz← 1.00; Tr←0; Fs←40000;

Winning impulse test of reed and bore

    RT ← FALSE;
    WD ← TRUE;
    Beg ← 0;
    Dur ← .1;
    PwF ← MakEnv("0 0 1 0 2 1 100 1");
    RcF ← MakEnv("0 1 25 1 65 .88 100 .82");
    Fs ← 30000;
    LoopLen ← 10;
    PwAmp ← 0;
    TestAmp ← .01;
      ImpTest ← TRUE;
      Eps ← 0.01;
    Trace ← 0;
    LoopGain ← 1;
    FbGain ← 0;

Winning Step test

    RT ← FALSE;
    WD ← TRUE;
    Beg ← 0;
    Dur ← .1;
    PwF ← MakEnv("0 0 1 0 2 1 100 1");
    RcF ← MakEnv("0 1 25 1 65 .88 100 .82");
    Fs ← 30000;
    LoopLen ← 10;
    PwAmp ← 0;
    TestAmp ← .4;
      ImpTest ← FALSE;
      Eps ← 0.01;
    Trace ← 0;
    LoopGain ← 1;
    FbGain ← 0;

Step test u[illegible]nv

    RT ← FALSE;
    WD ← TRUE;
    Beg ← 0;
    Dur ← .1;
    PwF ← MakEnv("0 0 1 0 2 1 100 1");
    RcF ← MakEnv("0 1 25 1 65 .88 100 .82");
    Fs ← 30000;
    LoopLen ← 10;
    PwAmp ← .4;
    TestAmp ← 0;
      ImpTest ← FALSE;
      Eps ← 0.01;
    Trace ← 0;
    LoopGain ← 1;
    FbGain ← 0;

First working toot test, 3/1/86. Main problem is big DC step

    Fs ← 30000;
    RT ← TRUE;
    WD ← FALSE;
```

BEST AVAILABLE COPY

```
     PmF ← MakEnv("0 0 20 1 80 1 100 0");
     RcF ← MakEnv("0 1 25 1 65 .88 100 .82");

     Beg ← 0;
     Dur ← 1;
     LoopLen ← 35;
     PmAmp ← 1;
     LoopGain ← .99;
     FbGain ← .7;

Filnam Ext  PPN    Size  Written  Time Pro    Writer      Reference--% Dumped  Off
SE1    JET SAMJOS   115 12-Sep-86 0927 000   1JOS JCLA    07-Oct-86 04 P287>
JCLA   JET SAMJOS   256 22-Mar-86 0056 000   1JOS E       07-Oct-86 06 P273>
IOTC86 JET SAMJOS    91 29-Aug-86 2349 000   1JOS JETSAM  07-Oct-86 10 P286>
BRIGHT JET SAMJOS    78 03-Apr-86 1223 000 TXT AM JCLA    07-Oct-86 01 P273>
TEST   JET SAMJOS   256 21-Mar-86 0030 000   1JOS E       07-Oct-86 01 P273>
BASSAX JET SAMJOS    85 29-Aug-86 2316 000   1JOS JCLA    07-Oct-86 07 P286>
SE2    JET SAMJOS    90 12-Sep-86 0931 000   1JOS JCLA    07-Oct-86 04 P287>
SE3    JET SAMJOS    90 12-Sep-86 0935 000   1JOS JCLA    07-Oct-86 04 P287>
TOOT2  JET SAMJOS   128 21-Mar-86 0032 000   1JOS E       07-Oct-86 01 P286>
WOW    JET SAMJOS   128 22-Mar-86 0122 000   1JOS E       07-Oct-86 05 P273>
NOLOSS JET SAMJOS    92 30-Aug-86 0815 000   1JOS JETSAM  07-Oct-86 02 P286>
SIMPC  JET SAMJOS    92 30-Aug-86 0034 000   1JOS JETSAM  07-Oct-86 02 P286>
SE4    JET SAMJOS    91 12-Sep-86 0937 000   1JOS JCLA    07-Oct-86 04 P287>
SE5    JET SAMJOS    91 12-Sep-86 0938 000   1JOS JCLA    07-Oct-86 04 P287>
       Total=   3.3

SE1    JET SAMJOS   115 12-Sep-86 0927 000   1JOS JCLA    07-Oct-86 04 P287>
       Rt←TRUE;
       Wo←FALSE;
       Pf←MakEnv("  .0000000  .0000000  12.5000000  1.0000000  37.5000000  1.0000000  50.0000000  .0000000
62.5000000  1.0000000  87.5000000  1.0000000  100.0000000  .0000000");
       Rf←MakEnv("  .0000000  1.0000000  25.0000000  1.0000000  100.0000000  .0000000");
       SATfile←"p4.sat";
       Rcl←2;
       Dur← 5.000000    ;
       Ll←91; COMMENT Pitch = 439.5604400;
       Pa← .5000000    ;
       Ta← .0000000    ;
       Lg← .9700000    ;
       Fg← .1000000    ;
       Rp← .0000000    ;
       Ng← .1000000e-2 ;
       Rn← .0000000    ;
       Tr←2;
       AMa← .0000000    ;
       AMf← .0000000    ;
       Fs←40000;

JCLA   JET SAMJOS   256 22-Mar-86 0056 000   1JOS E       07-Oct-86 06 P273>
COMMENT Make a clarinet double toot, reduce Rf at right and dampen bore;
       REDEFINE r←"Rtest";
       REDEFINE dr = "dpyenv(rf)";
       REDEFINE da = "dpyenv(pf)";
       Rt←TRUE;
       Wo←FALSE;
       Pf←MakEnv("0 0  25 1  50 0  75 1  100 0");
       Rf←MakEnv("0 1  25 1  100 0");
       Ll←91; COMMENT Pitch approx 440;
       Beg← .0;
       Dur← 5.00;
       Pa← 1.00;
       Ta← .0;
       Lg← .95;
       Fg← .700;
       Rp← .0;
       Rz← 1.00;
       Ng← 0;
       Rn← 0;
       Tr←0;
       Fs←40000;

IOTC86 JET SAMJOS   [illegible]
COMMENT OutSum (be[illegible] WAY too faint. Also, it's not much brighter.
Bore signal is strong but too bassy.

Signal is very sensitive to breakpoint loc. Moving left or right worsens.
Decreasing rightmost rc in Rf makes the note louder! We can compensate
  by decreasing Lg as we have done here.
Noise added to mouth pressure didn't change anything fundamental (Ng>0).
  Oddly, the noise level gets modulated somehow by the note amplitude.
Brightness: Set Fg from .7 to .1
  Fg=.7 is not bright enough.
  Fg=.1 gives highpass in loop. Less than this does not sound.;
       Rt←TRUE;
       Wo←FALSE;
       Pf←MakEnv("  .000  .000  12.500  1.000  37.500  1.000  50.000  .000  62.500  1.000  87.500  1.000  10
0.000  .000");
       Rf←MakEnv("  .000  1.000  25.000  1.000  100.000  .000");
       Ll←91; COMMENT Pitch = 439.560;
       Beg← .000    ;
```

BEST AVAILABLE COPY

```
        Dur← 5.00    ;
        Pa← .500     ;
        Ta← .000     ;
        Lg← .970     ;
        Fg← .100     ;
        Rp← .000     ;
        Rz← 1.00     ;
        Ng← .100e-2  ;
        Rn← .000     ;
        Tr←2;
        Emo← .000    ;
        Stif← .000   ;
        Fs←40000;

BRIGHT JET SAFLOS     78 03-Apr-86 1223 000 TXT AN JCLA   07-Oct-86 01 P273>
        Rt←TRUE;
        Wd←FALSE;
        Pf←MakEnv(" .000  .000  25.000  1.000  50.000  .000  75.000  1.000  100.000  .000");
        Rf←MakEnv(" .000  1.000  25.000  1.000  100.000  .000");
        Ll←91; COMMENT Pitch = 439.560;
        Beg← .000    ;
        Dur← 5.00    ;
        Pa← 1.00     ;
        Ta← .000     ;
        Lg← .995     ;
        Fg← .300     ;
        Rp← .000     ;
        Rz← .000     ;
        Ng← .500e-2  ;
        Rn← .000     ;
        Tr←0;
        Fs←40000;

TEST   JET SAFLOS    256 21-Mar-86 0030 000   1JOS E      07-Oct-86 01 P273>
COMMENT Impulse-in-lossless-loop test;
    Fs ← 30000;
    RT ← TRUE;
    WD ← FALSE;
    PF ← MakEnv("0 0 20 1 80 1 100 0");
    RF ← MakEnv("0 1 25 1 65 .88 100 .82");
    Beg ← 0;
    Dur ← .1;
    LL ← 35;
    PA ← 0;
    TA ← 1.0;
    LG ← 1;
    FG ← 0;
    Rp←Rz←0;

BASSAX JET SAFLOS     85 29-Aug-86 2316 000   1JOS JCLA   07-Oct-86 07 P286>

        Rt←TRUE;
        Wd←FALSE;
        Pf←MakEnv(" .000  .000  12.500  1.000  37.500  1.000  50.000  .000  62.500  1.000  87.500  1.000  10
0.000  .000");
        Rf←MakEnv(" .000  1.000  25.000  1.000  100.000  .000");
        Ll←150; COMMENT Pitch = 266.667;
        Beg← .000    ;
        Dur← 3.00    ;
        Pa← .550     ;
        Ta← .000     ;
        Lg← .970     ;
        Fg← .500     ;
        Rp← .000     ;
        Rz← 1.00     ;
        Ng← .100e-2  ;
        Rn← .000     ;
        Tr←2;
        Fs←40000;

SE2    JET SAFLOS     90 12-Sep-86 0931 000   1JOS JCLA   07-Oct-86 04 P287>
        Rt←TRUE;
        Wd←FALSE;
        Pf←MakEnv(" .000  .000  12.500  1.000  37.500  1.000  50.000  .000  62.500  1.000  87.500  1.000  10
0.000  .000");
        Rf←MakEnv(" .000  1.000  25.000  1.000  100.000  .000");
        SATfile←">4.sat";
        RcT←2;
        Dur← 5.00    ;
        Ll←91; COMMENT Pitch = 439.560;
        Pa← .500     ;
        Ta← .000     ;
        Lg← .970     ;
        Fg← .100     ;
        Rp← .000     ;
        Ng← .100e-2  ;
        Rn← .000     ;
        Tr←2;
        AMa← .500e-1 ;
        AMf← 5.00    ;
        Fs←40000;
```

BEST AVAILABLE COPY

```
SE3     JET SAMJOS     90 12-Sep-86 0935 000   1JOS JCLA   07-Oct-86 04 P287>
        Rt←TRUE;
        Wd←FALSE;
        Pf←MakEnv("  .000  .000  12.500  1.000  37.500  1.000  50.000  .000  62.500  1.000  87.500  1.000  10
0.000  .000");
        Rf←MakEnv("  .000  1.000  25.000  1.000  100.000  .000");
        SATfile←"o4.sat";
        RcT←2;
        Dur← 5.00    ;
        Li←91; COMMENT Pitch = 439.560;
        Pa← .800     ;
        Ta← .000     ;
        Lg← .970     ;
        Fg← .100     ;
        Rp← .000     ;
        Ng← .100e-2  ;
        Rn← .000     ;
        Tr←2;
        AMa← 1.00    ;
        AMf← 4.00    ;
        Fs←40000;

 TOT2   JET SAMJOS     128 21-Mar-86 0032 000   1JOS E      07-Oct-86 01 P286>
COMMENT Make a basic toot, this time using DC block in loop;

        Rt←TRUE;
        Wd←FALSE;
        Pf←MakEnv("  .000  .000  20.000  1.000  80.000  1.000  100.000  .000");
        Rf←MakEnv("  .000  1.000  25.000  1.000  65.000  .880  100.000  .820");
        Li←100; COMMENT Pitch = 400.000;
        Beg← .000;
        Dur← 1.00;
        Pa← 1.00;
        Ta← .000;
        Lg← .990;
        Fg← .700;
        Rp← .000;
        Rz← 1.00;
        Tr←0;
        Fs←40000;

WOW     JET SAMJOS     128 22-Mar-86 0122 000   1JOS E      07-Oct-86 05 P273>
COMMENT Make a clarinet double toot, reduce Rf at right and dampen bore;
        Rt←TRUE;
        Wd←FALSE;
        Pf←MakEnv("  0  0  25 1  50 0  75 1 100 0");
        Rf←MakEnv("  0  1  25 1  100 0");
        Li←91; COMMENT Pitch = 439.560;
        Beg← 0;
        Dur← 5.0;
        Pa← 1.0;
        Ta← 0;
        Lg← .970;
        Fg← .500;
        Rp← 0;
        Rz← 1.0;
        Ng← .05;
        Rn← 0;
        Tr←0;
        Fs←40000;

MOLOSS  JET SAMJOS     92 30-Aug-86 0015 000   1JOS JETSAM 07-Oct-86 02 P286>
        Rt←TRUE;
        Wd←FALSE;
        Pf←MakEnv("  .000  .000  12.500  1.000  37.500  1.000  50.000  .000  62.500  1.000  87.500  1.000  10
0.000  .000");
        Rf←MakEnv("  .000  1.000  25.000  1.000  100.000  .000");

        Li←400; COMMENT Pitch = 100.000;
        Beg← .000    ;
        Dur← 10.0    ;
        Pa← .500     ;
        Ta← .000     ;
        Lg← 1.00     ;
        Fg← .000     ;
        Rp← .000     ;
        Rz← 1.00     ;
        Ng← .100e-2  ;
        Rn← .000     ;
        Tr←2;
        Emb← .000    ;
        Stif← .000   ;
        Fs←40000;

SIMPC   JET SAMJOS     92 30-Aug-86 0034 000   1JOS JETSAM 07-Oct-86 02 P286>
        Rt←TRUE;
        Wd←FALSE;
        Pf←MakEnv("  .000  .000  12.500  [illegible]  37.500  1.000  50.000  .000  62.500  1.000  87.500  1.000  10
[illegible]");
        Rf←MakEnv("  .000  1.000  25.[illegible]  [illegible]  100.000  .000");
```

BEST AVAILABLE COPY

BEST AVAILABLE COPY

```
        Ll←100; COMMENT Pitch = 400.000;
        Beg← .000    ;
        Dur← 2.00    ;
        Pa← .450     ;
        Ta← .000     ;
        Lg← 1.00     ;
        Fg← .000     ;
        Rp← .000     ;
        Rz← .000     ;
        Ng← .100e-2  ;
        Rn← .000     ;
        Tr←2;
        Emb← .000    ;
        Stif← .000   ;
        Fs←48000;
        Rt←TRUE;
        Ud←FALSE;
        Pf←MakEnv(" .000  .000  12.500  1.000  37.500  1.000  50.000  .000  62.500  1.000  87.500  1.000  10
0.000  .000");
        Rf←MakEnv(" .000  1.000  25.000  1.000  100.000  .000");
        SATfile←"o4.sat";

SE4     JET SAMJOS     91 12-Sep-86 0937 000   1JOS JCLA   07-Oct-86 04 P287>
        RcT←2;
        Dur← 3.00    ;
        Ll←150; COMMENT Pitch = 266.667;
        Pa← .550     ;
        Ta← .000     ;
        Lg← .970     ;
        Fg← .500     ;
        Rp← .000     ;
        Ng← .100e-2  ;
        Rn← .000     ;
        Tr←2;
        AMa← .500e-1 ;
        AMf← 5.00    ;
        Fs←48000;
        Rt←TRUE;
        Ud←FALSE;
        Pf←MakEnv(" .000  .000  12.500  1.000  37.500  1.000  50.000  .000  62.500  1.000  87.500  1.000  10
0.000  .000");
        Rf←MakEnv(" .000  1.000  25.000  1.000  100.000  .000");
        SATfile←"o4.sat";

SE5     JET SAMJOS     91 12-Sep-86 0938 000   1JOS JCLA   07-Oct-86 04 P287>
        RcT←2;
        Dur← 3.00    ;
        Ll←300; COMMENT Pitch = 133.333;
        Pa← .550     ;
        Ta← .000     ;
        Lg← .970     ;
        Fg← .500     ;
        Rp← .000     ;
        Ng← .100e-2  ;
        Rn← .000     ;
        Tr←2;
        AMa← .500e-1 ;
        AMf← 5.00    ;
        Fs←48000;
```

APPENDIX C

COPYRIGHT 1986 - THE BOARD OF TRUSTEES
OF THE LELAND STANFORD JUNIOR UNIVERSITY

```
COMMENT Violin Simulation software.

Modification history:

Original file was Y.SAI[SAM,JOS], ca. Oct. '82.
Then it became   YS.SAI[SID,JOS], from November '82 to April '83.
No substantial changes were installed over the next couple of years.

12/11/85 - Changed Trace usage. Installed bulk string restoring force.
           Added velocity and bow-string force output files.


BUGS:

        Allpass reset for vibrato is not perfect. You can hear
        little glitches once per period (when delay line increases?)
        Need a careful review of this. Perhaps restore old version
        to see if it happened way back when. I thought not! (12/11/85)

        The bow friction curve used in HyperBow is not sufficiently
        realistic.  The pure discontinuity should be replaced
        by a finite slope.
```

The bow-string solver does not correctly implement hysteresis behavior. Need a stick-slip hysteresis memory bit. Currently, the smallest velocity perturbation is selected which can be wrong in the stuck case. It has been observed that when negative velocity pulse returns to bow from nut, we seem to be jumping to slipping without getting over the friction curve peak.

BEST AVAILABLE COPY

```
;
BEGIN "VS"

  REQUIRE "()<>" DELIMITERS;
  DEFINE # = ! COMMENT ), thru = ( STEP 1 UNTIL ), CrLf = ((15)&(12)),
         Tab = ((11&""), Alt = ((175&""), Cr = ((15)&""), Saf = ();

  EXTERNAL INTEGER !SKIP!;
  INTERNAL INTEGER Trace, Quiet;

  REQUIRE "JOSLIB.REQ(LIB,JOS)" SOURCE!FILE;
  REQUIRE "RECORD.REQ(LIB,JOS)" SOURCE!FILE;
  REQUIRE "MYIO.REQ(LIB,JOS)" SOURCE!FILE;
  REQUIRE "FLTIO.REQ(LIB,JOS)" SOURCE!FILE;
  REQUIRE "DISPLA.REQ(LIB,JOS)" SOURCE!FILE;
  EXTERNAL PROCEDURE TrpIni(INTEGER CODE); # JAMLIB floating-point traps;

DEFINE Trace1="(Trace LAND 1)",
       Trace2="(Trace LAND 2)",
       Trace3="(Trace LAND 4)",
       Trace4="(Trace LAND 8)",
       Trace5="(Trace LAND 16)",
       Trace6="(Trace LAND 32)";

# Filter and Delay-Line routines;

  SIMPLE INTEGER PROCEDURE Index(INTEGER Ptr,Len);
      RETURN(IF Ptr>Len THEN Ptr-Len ELSE IF Ptr LEQ 0 THEN Ptr+Len ELSE Ptr);

  REAL PROCEDURE DlyLin(REAL ARRAY D; REFERENCE INTEGER Ptr;
                        INTEGER Len; REAL InSig(0));
  COMMENT Places InSig into delay line of length Len and returns current output;
  BEGIN "DlyLin"

      REAL Output;
      IF Ptr LEQ 0 THEN BEGIN ARRCLR(D); Ptr=1; END;  # Initialize;
      Output = D[Ptr];
      D[Ptr] = InSig;
      Ptr = Index(Ptr+1,Len); # Ptr always points to end of delay-line;
      RETURN(OutPut);
  END "DlyLin";


  REAL PROCEDURE Filter(INTEGER Ni,No; REAL ARRAY Ic,Oc,Px,Py;
                REFERENCE INTEGER Iptr,Optr; REAL X(0));
  COMMENT
          Place Input X into filter and return output. See FLTIO.SAI(LIB,JOS)
          for filter documentation (Ni,No,Ic,Oc). Px[1:Ni+1],Py[1:No] are
          history arrays for the filter. Iptr, Optr are used internally.
;
  BEGIN "Filter"
      INTEGER i,j;
      REAL Acc;
      Acc = 0;
      DlyLin(Px,Iptr,Ni,X);    # Push input;
      j=Iptr;                  # Points one past input;
      FOR i = 1 Thru Ni DO Acc = Acc + IC[i]*Px[j-Index(j-1,Ni)];
      j=Optr;
      FOR i = 2 Thru No DO Acc = Acc + OC[i]*Py[j-Index(j-1,No)];
      DlyLin(Py,Optr,No,Acc); # Output;
      RETURN(Acc);
  END "Filter";

  real procedure MAXABSARR(integer n; real array y);
  begin "MaxArr"
      real ymax,ay;
      integer i, MinX;
      MinX = ARRINFO(y,1);     Comment Lower subscript bound;
      ymax=ABS(y[MinX]);
      for i=1 step 1 until n-1 do if (ay=ABS(y[i+MinX])) > ymax then ymax=ay;
      return(ymax);
  end "MaxArr";

# Vibrato;

REAL PROCEDURE Vibrato(REAL PcPv,PcRv,Pvf,Rvf,Fs; INTEGER Time);
BEGIN "Vibrato"
  DEFINE PI="3.14159265358979 3";
  OWN REAL Ang,Dang,Rscl,Rrscl,Cranv,Pranv,Ranv,RiScl;
  OWN INTEGER Rcnt,Ri;
  REAL Factor;
```

BEST AVAILABLE COPY

```
  IF Time LEQ 1 THEN
  BEGIN
    Ang←0;
    Dang←Pi×2×Pvf/Fs;
    Rscl←2×PcRv;
    Rcnt←Fs/Rvf+0.5; # Period of random vibrato;
    Rrscl←1.0/Rcnt;
    Ri←0;
  END;

  IF (PcRv=0) AND (PcPv=0) THEN RETURN(1);

  Factor ← 1 + PcPv×SIN(Ang) + Cranv;
  Ang ← Ang + Dang;
  IF Ri=0 THEN
  BEGIN
    Pranv ← Ranv;

    Ranv ← Rscl×(RAN(0)-0.5);
    Cranv ← Pranv;
    RiScl ← (Ranv-Pranv)×Rrscl;
  END
  ELSE
    Cranv ← Pranv + Ri×RiScl;

  Ri ← Ri+1;
  IF Ri GEQ Rcnt THEN Ri←0;

  RETURN(Factor);

END "Vibrato";

# Bow noise;

REAL PROCEDURE BowNoise(REAL PcBn,Bnf,Fs; INTEGER Time);
BEGIN "BowNoise"
  OWN REAL Rscl,Rrscl,Cranv,Pranv,Ranv,RiScl;
  OWN INTEGER Rcnt,Ri;
  REAL Factor;

  IF PcBn=0 THEN RETURN(0);

  IF Time LEQ 1 THEN
  BEGIN
    Rscl←2×PcBn;
    Rcnt←Fs/Bnf+0.5; # Period of random BowNoise;
    Rrscl←1.0/Rcnt;
    Ri←0;
  END;

  IF Ri=0 THEN
  BEGIN
    Pranv ← Ranv;
    Ranv ← Rscl×(RAN(0)-0.5);
    Cranv ← Pranv;
    RiScl ← (Ranv-Pranv)×Rrscl;
  END
  ELSE
    Cranv ← Pranv + Ri×RiScl;

  Ri ← Ri+1;
  IF Ri GEQ Rcnt THEN Ri←0;

  RETURN(Cranv);

END "BowNoise";
# Fixed-point finder;

  INTEGER PROCEDURE FP(INTEGER ARRAY F; INTEGER Nf,b,Res(1); REAL Amp(1);
                       BOOLEAN Sym=(FALSE));
  COMMENT
    Solve F[x] = x + b for x. F is declared [1:Nf] but considered centered
        about x=0. F[n] is assumed positive for n in [1:MidLoc].
    If Sym is TRUE, F[n] assumed positive everywhere.
        Otherwise it is assumed negative in the right half [MidLoc+1:Nf].
        (Sym is TRUE for clarinet, flute, and organ, FALSE for bowed string.)
    Res is the desired accuracy in x.
    Note that the Friedlander instability is not necessarily resolved
        for the case Sym=FALSE.
  ;
  BEGIN "FP"
    INTEGER Lb,Ub,i,Dx,Fx;
    INTEGER x; # In = (2nd b) should be real, but here we want speed;

    INTEGER MidLoc; # Middle point of F curve;

    MidLoc ← Nf LSH -1; # F should be discontinuous at midloc,midloc+1 if not Sym;
    Lb← MidLoc-b; # Slope of line is always positive;
    IF Lb<1 THEN  PRINT(" FP: lb = ",Lb," Now set to ",Lb←1,CrLf);
    IF Lb>Nf THEN  PRINT(" FP: ub = ",Lb," Now set to ",Lb←Nf,CrLf);
```

BEST AVAILABLE COPY

```
    Ub ← (IF Sym THEN MidLoc+b ELSE MidLoc); # Upper limit of search;
    IF Lb>MidLoc THEN
    BEGIN "swap"
      i←Lb;
      Lb←(IF Sym THEN Ub ELSE MidLoc+1);
      Ub←i;
    END "swap";

    x ← (Ub+Lb) LSH -1; # middle;
    Dx ← (Ub-Lb) LSH -1; # First step-size times 2;
    b ← b - MidLoc; # View this as translating x to center at 0 below;

    WHILE Dx>Res DO
    BEGIN "Bisect"
      Dx ← Dx LSH -1; # Halve the step-size;
      IF AmpaF[x]>x+b THEN x ← x+Dx MIN Ub ELSE x ← x-Dx MAX Lb; # Slope positive;
    END "Bisect";

    IF Trace2 THEN
    BEGIN "look"
      STRING Ts;
      INTEGER Id,i,DpySiz;
      OWN INTEGER Nwait;
      REAL ARRAY DpyBuf[1:Nf];
      REAL dmax,dmin;
      IF Nwait LEQ 0 THEN
      BEGIN
        FOR i←1 STEP 1 UNTIL Nf DO DpyBuf[i] ← AmpaF[i];
        Id←0;
        DpySiz ← 3*Nf+1000;
        dmax ← MaxArr(NF,DpyBuf) MAX NF+b;
        dmin ← MinArr(NF,DpyBuf) MIN 1+b;
        DpyOvl(DpyBuf,Nf,Id,"VELOCITY","VELOCITY",dmin,dmax,-512,512,
          FALSE,TRUE,DpySiz);
        FOR i←1 STEP 1 UNTIL Nf DO DpyBuf[i] ← i+b;
        DpyOvl(DpyBuf,Nf,Id,NULL,NULL,dmin,dmax,-512,512,FALSE,FALSE);
        ARRCLR(DpyBuf);
        DpyBuf[x]←AmpaF[x];
        DpyOvl(DpyBuf,Nf,Id,NULL,NULL,dmin,dmax,-512,512,TRUE,FALSE);
        IF (Ts←INCHWL)="w" OR Ts="W" THEN DpyWrt(Id,"FRIC.PLT")
        ELSE Nwait ← INTSCAN(Ts,0);
        IF Nwait<0 THEN Trace ← Trace XOR Trace2; # Turn off this trace;
        DRELS(Id);
      END;
      IF Nwait>0 THEN Nwait ← Nwait-1;
    END "look";

    RETURN(x-MidLoc);

  END "FP";

# Bow-string interaction;

  REAL PROCEDURE BowEffect(INTEGER ARRAY Friction; INTEGER NF,V,Vb(256);
                           REAL Pb(1));
  COMMENT
          Compute the additive velocity imparted to the string from the bow
          on the basis of current string velocity (V), bow velocity (Vb),
          and bow pressure (Pb). The two basic effects used to determine
          this are bow friction and string wave impedance. The array
          Friction[1:Nf] is assumed to contain friction-times-wave-admittance
          as a function of velocity, with zero velocity corresponding to
          the middle of the array (Nf/2).
  ;
  BEGIN "BowEffect"
    REAL Vip,Vo;

    Vip ← Vb - V;  # Wave admittance line is always through (-Vip,Vip);
    IF Pb=0 THEN RETURN(0);
#   Vo ← FP(Friction,Nf,Vip,1,Pb)+Vip; # Find Vp=Vip intersect Friction(Vp);
    Vo ← FP(Friction,Nf,Vip,1,Pb); # Play loop adds in Vi;
    RETURN(Vo);

  END "BowEffect";

# Simplified Bow-string interaction - Hyperbolic friction curve;

  REAL PROCEDURE HyperBow(REAL Vi,Vb,Pb);
  COMMENT
          Compute the additive velocity imparted to the string from the bow
          on the basis of current string velocity (Vi), bow velocity (Vb),
          and bow pressure (Pb). The two basic effects used to determine
          this are bow friction and string wave impedance.
          The equations which must be simultaneously satisfied are

                Y f = dV
                  f = F(V-Vb)
                    = F(Vi+dV-Vb)
```

```
        where Y is the characteristic admittance of the string, f is the force
        of the bow on the string, and
        F(V) is the force V. velocity friction curve for the bow and string.
        Here we use Y F(V) = -Pb/V as the friction curve normalized by Y. Thus
        dV is found as the solution to dV = -Pb/(dV+Vi-Vb). It is returned
        as the amount to add to the incident string velocity Vi to comply
        with the physical constraints of bow friction and string wave impedance.
:
BEGIN "HyperBow"
  REAL Vib,dV,V1,V2,Rad,Tmp;
  OWN INTEGER StCnt,Slipping,WasSlipping;

  Vib = Vi - Vb;  # Wave admittance line is always through (-Vbi,Vbi);

  IF Pb=0 THEN RETURN(0);
  Rad = Vib*Vib - 4*Pb;
  IF Rad<0 THEN
  BEGIN "Stuck"
    dV = -Vib; # Cancel differential velocity. String is stuck to bow;
  END "Stuck"
  ELSE
  BEGIN "Slip"
    Rad = SQRT(Rad)/2;
    Tmp = -Vib/2;
    V1 = Tmp + Rad;      # Two real solutions to the quadratic (have same sign);
    V2 = Tmp - Rad;
    dV = (IF V1>0 THEN V2 ELSE V1); # Always take the smallest solution;
#
  The above statement is oversimplified. A bit should be maintained which
  indicates whether the string is stuck or slipping relative to the bow.
  Then we always take the solution which leaves us in the same state if
  possible. It is possible to have two stuck solutions in which case the
  above rule (i.e., choose the smaller change in velocity) works properly.
  The "least-action" rule can fail when the string is in the stuck state,
  taking it out of that state too soon.

:
  END "Slip";

  IF Trace3 THEN
  BEGIN
    WasSlipping=Slipping;
    Slipping = (IF ABS(Vi+dV - Vb) < 0.000001 THEN FALSE ELSE TRUE);
    IF WasSlipping AND NOT Slipping THEN BEGIN PRINT(StCnt," SLIPS",CrLf);
      StCnt=0; END ELSE
    IF NOT WasSlipping AND Slipping THEN BEGIN PRINT(StCnt," STICKS",CrLf);
      StCnt=0; END;
    StCnt=StCnt+1;
  END;

  IF Trace2 THEN
  BEGIN "hlook"
    STRING Ts;
    INTEGER Id,i,DpySiz;
    OWN INTEGER Nwait;
    REAL Xscl,Ymax,Ymin,Xmin,Xmax;
    INTEGER Mid;
    DEFINE Ndpy="512";
    REAL ARRAY DpyBuf[1:Ndpy];
    IF Nwait LEQ 0 THEN
    BEGIN "plot"
      # Stuck: Scale [1:Ndpy] to be [-2*Pb,2*Pb] = [Xscl*(1-Mid),Xscl*(Ndpy-Mid)];
      # Slip: Scale [1:Ndpy] to be [-2*Vib,2*Vib]=[Xscl*(1-Mid),Xscl*(Ndpy-Mid)];
      SIMPLE REAL PROCEDURE ItoY(INTEGER i); RETURN((Xscl*(i-Mid)));
      SIMPLE INTEGER PROCEDURE Ytol(REAL Y);
        RETURN((Y/Xscl) + Mid + 0.5 MAX 1 MIN Ndpy);
      Mid = Ndpy/2;
      Ymax = (IF NOT Slipping THEN 2*Pb ELSE ABS(2*(Vi-Vb)));
      Ymin = -Ymax;
#     Xmax = (IF NOT Slipping THEN 2*Pb ELSE ABS(2*(Vi-Vb)));
      Xmax = 2*(ABS(Vb) MAX ABS(Vi) MAX ABS(Vi+dV));
      Xmin = -Xmax;
      Xscl = Xmax/(Mid-1);
      FOR i=1 STEP 1 UNTIL Ndpy DO
        DpyBuf[i] = (IF ABS(ItoY(i)-Vb)>0.000001 THEN -Pb/((ItoY(i)-Vb)) ELSE 0);
      DpySiz = 3*Ndpy+1000;
      DpyOvl(DpyBuf,Ndpy,Id=0,(IF Slipping THEN "SLIP" ELSE "STUCK")&" VELOCITY",
        "VELOCITY",Ymin,Ymax,Xmin,Xmax,FALSE,TRUE,DpySiz);
      FOR i=1 STEP 1 UNTIL Ndpy DO DpyBuf[i] = ItoY(i)-Vi; # Wave impedance line;
      DpyOvl(DpyBuf,Ndpy,Id,NULL,NULL,Ymin,Ymax,Xmin,Xmax,FALSE,FALSE);
      ARRCLR(DpyBuf);
      DpyBuf[Ytol(dV+Vi)] = dV; # Evaluate solution on impedance line;
      DpyOvl(DpyBuf,Ndpy,Id,NULL,NULL,Ymin,Ymax,Xmin,Xmax,TRUE,FALSE);
      IF (Ts=INCHWL)="w" OR Ts="W" THEN DpyWrt(Id,"X.PLT")
      ELSE Nwait = INTSCAN(Ts,0);
      IF Nwait<0 THEN Trace = Trace XOR Trace2; # Turn off this trace;
      DRELS(Id);
    END "plot";
    IF Nwait>0 THEN Nwait = Nwait-1;
  END "hlook";
```

BEST AVAILABLE COPY

BEST AVAILABLE COPY

```
    RETURN(dY);

  END "HyperBow";

# Declarations;

  DEFINE FltMax=(88);
  DEFINE NfMax = (48896), MaxFriction = (128);
  INTEGER ARRAY Friction[1:NfMax]; # Bow-string friction curve;
  REAL ARRAY IcSl,OcSl,IcSr,OcSr,IcB,OcB[1:FltMax]; # Filter coefficients;
  INTEGER NiSl,NoSl,NiSr,NoSr,NiB,NoB; # Filter orders (+1);
  INTEGER P,Pl,Pr,Cpr,Ppr,Hwl,Hwr,i,j,Samp,N,Nf,Nl,Type,BowPos,Nstall,Nol0;
  BOOLEAN HypFric;
  STRING NutFilterFile,BridgeFilterFile,BodyFilterFile,PeriodFile,FrictionFile,Ts;
  REAL Fs,Dur,Frq,Lift;
  REAL BowPosition,BowVelocity,BowPressure,BP,BV,BowAccel;
  REAL BVtc,BPtc,BVpr,BPpr,BVas,BPas; # Time constants of attack plus assoc. vars.;
  REAL BPdtc,BPdpr,BPdas,BPfin,tBp,tBpd; # Time consts of decay plus assoc. vars.;
  REAL Disp,SlipF; # String displacement and Slip force;
  REAL PcPv,PcRv,Pvf,Rvf,Apc,DcPr,Pap; # Vibrato parameters;
  REAL PcBn,Bnf; # Bow noise parameters;
  REAL Stiffness; # Stiffness of tension-mode of string;
  REAL BulkForce; # Restoring force due to stiffness;

#         PcBn is the amount of random noise to add to Yb. Bnf is the rate
          in Hz at which new noise samples are generated, with intermediate
          noise values obtained by linear interpolation.
;

  RECORD!POINTER(Sndfile) SndPtr, DefPtr;
  DEFINE In(x)=[Sndfile:x[SndPtr]];
  DEFINE Def(x)=[SndFile:x[DefPtr]];

# Input Parameters;

  PRINT(CrLf,"VS (Violin Simulation):  ",
   COMPILER!BANNER[LENGTH(SCANC(COMPILER!BANNER,Tab,"","sinz"))+11 FOR 17],CrLf);

  PRINT(CrLf,"Trace codes (any combination can be added together):
        1 - Display Body, string-velocity, applied-force waveforms.
        2 - Display Bow-string interaction graphical solver.
        4 - Print number of samples stuck or slipping, prin delay-line changes.
        8 - Print string displacement.
       16 - Initialize string with impulse if not reading initial state file.
       32 - Display running overlay of body output, applied force, and velocity.
  ");

  TrpIni('26);          # all except integer overflow (1) and real uflow ('18);
  SUPCT;                # Adjust line activation options;
  SETFORMAT(8,2);

  IF Fs LEQ 0 THEN
  BEGIN "defaults" # These are preserved across CALL and START;
    Nstall ← 5; # debug only;
    Dur←1;
    Lift←0.4;
    Fs←17857.14;
    Frq←196;     # Low G on violin;
#   Fs←18000;
#   Frq←100;     # Low G on violin;
    BowPosition ← 0.17;
#   BowPosition ← 0.1;
#   BowVelocity ← 50;
    BowVelocity ← 0;
    BowAccel ← .0001;
    BVtc ← 0;
#   BowPressure ← 1.5;
    BowPressure ← 1;
#   BPtc ← 0.01;
    BPtc ← 0;
    BPdtc ← Lift/2;
    BPfin ← BowPressure/2;
    Quiet ← TRUE;
    SlipF ← 10;
    PcPv ← .005;          # This times pitch is the max periodic vibrato excursion;
    PcRv ← .001;          # This times pitch is the max random vibrato excursion;
    Pvf ← 5.5;            # Periodic vibrato rate in Hz;
    Rvf ← 10;             # Random vibrato rate in Hz;
    PcBn ← 0.01;          # Bow noise amplitude;
    Bnf ← 10;             # Bow noise frequency;
    HypFric ← TRUE;       # Default friction curve ← hyperbolic;
#   Stiffness←1/500;      # Force/StringDisplacement;
    Stiffness←0;
  END "defaults";

# Set up default filters and friction curve;

  NiSr←NoSr←1; IcSr[1]←-1;  # Simple rigid termination for default nut;
  NiSl←2; NoSl←1; IcSl[1]←IcSl[2]←-0.49;  # Simple lowpass for default bridge;
  NiB←1; NoB←2; IcB[1]←.01; IcB[2]←0.99; # Default body is one-pole lowpass;
  Hwl←2; # Should be 0.5;
  Nf ← 512;
```

```
FOR i←1 Thru 256 DO Friction[i] ← MaxFriction/(257-i); # Hyperbolic default;
FOR i←257 Thru 512 DO Friction[i] ← MaxFriction/(256-i);

WHILE TRUE DO
BEGIN "OmniLoop"
  WHILE TRUE DO
  BEGIN "GetParameters"
    STRING Bucky,Arg2, Arg1,Cmd,Prompt;
    INTEGER BoolHak,Brk;

    Prompt ← CrLf&"Dur("&CYFS(Dur)&
            ") Lift("&Cvfs(Lift)&
            ") Pitch("&Cvfs(Frq)&
            ") Clockrate("&Cvfs(Fs)&
            ") MaxForce("&Cvfs(SlipF)&
            ") Trace("&CYS(Trace)&
            ")"&CrLf&"Velocity("&Cvfs(BowVelocity)&
            ",tau="&Cvfs(BVtc)&
            ") Acceleration("&Cvfs(BowAccel)&
            ") BowPos("&Cvfs(BowPosition)&
            ") Stiffness("&Cvfs(Stiffness)&
            ")"&CrLf&"Force("&Cvfs(BowPressure)&
            ",tau="&Cvfs(BPtc)&
            ") UltimateForceMit("&Cvfs(BPfin)&
            ",tau="&Cvfs(BPdtc)&
             DEFINE FN(x) = ((IF x THEN x ELSE "<Default>"));
            ")"&CrLf&"Input(Period = "&FN(PeriodFile)&
                    ", Friction = "&FN(FrictionFile)&","&CrLf&
                    " Nut = "&FN(NutFilterFile)&", Bridge = "&
                       FN(BridgeFilterFile)&","&CrLf&
                    " Body = "&FN(BodyFilterFile)&") or NoteSpec:";

    Read_Command (Prompt,Bucky,Arg2,Arg1,Cmd);

    CASE Cmd OF
    BEGIN "SetParameters"
        ["D"]   Dur←REALSCAN(Arg1,Brk);
        ["L"]   Lift←REALSCAN(Arg1,Brk);
        ["P"]   Frq←REALSCAN(Arg1,Brk);
        ["S"]   Stiffness←REALSCAN(Arg1,Brk);
        ["C"]   Fs←REALSCAN(Arg1,Brk);
        ["M"]   SlipF←REALSCAN(Arg1,Brk);
        ["F"]   BEGIN
                  IF NOT Arg1 THEN AinReal(BowPressure,"Middle Bow Pressure")
                    ELSE BowPressure←REALSCAN(Arg1,Brk);
                  IF NOT Arg2 THEN AinReal(BPtc,"Attack time constant")
                    ELSE BPtc←REALSCAN(Arg2,Brk);
                END;
["U"]   BEGIN
          IF NOT Arg1 THEN AinReal(BPfin,"Final Bow Pressure Loss")
            ELSE BPfin←REALSCAN(Arg1,Brk);
          IF NOT Arg2 THEN AinReal(BPdtc,"Decay time constant")
            ELSE BPdtc←REALSCAN(Arg2,Brk);
        END;
["V"]   BEGIN
          IF NOT Arg1 THEN AinReal(BowVelocity,"Final Bow Velocity")
            ELSE BowVelocity←REALSCAN(Arg1,Brk);
          IF NOT Arg2 THEN AinReal(BVtc,"Time constant")
            ELSE BVtc←REALSCAN(Arg2,Brk);
        END;
["A"]   BEGIN
          IF NOT Arg1 THEN AinReal(BowAccel,"(Constant) Bow Acceleration")
            ELSE BowAccel←REALSCAN(Arg1,Brk);
        END;
["B"]   BowPosition←REALSCAN(Arg1,Brk);
["I"]   BEGIN "Input"
          IF NOT Arg1 THEN
          BEGIN
            INTEGER Ttys;
            PRINT("Period, Friction, Nut, Bridge, Body:");
            Ttys ← TTYUP(TRUE);
            Arg1←INCHWL;
            TTYUP(Ttys);
          END;
          IF Arg1 = "P" THEN
          BEGIN
            PRINT("Initial String-Period");
            SndPtr←GETARC("INPUT.SND",NULL,Quiet);
            IF SndPtr NEQ NULL!RECORD THEN
            BEGIN
              Fs←In(Clock);
              Frq←Fs/In(Nsamps);
              PeriodFile ← In(Name);
            END;
          END
          ELSE IF Arg1="F" THEN
          BEGIN
            IF NOT AinInt(Nf←512,"Size of friction curve")
              OR Nf<2 THEN CONTINUE "GetParameters";
            BEGIN
```

BEST AVAILABLE COPY

```
                INTEGER i,Amp;
                REAL ARRAY Tmp[1:Nf];
                PRINT("Friction curve");
                FrictionFile ← GetArr(Tmp,Nf,"FRIC.SND",Quiet);
                HypFric ← (FrictionFile ≠ NULL);
                IF NOT HypFric THEN
                BEGIN
                  Amp ← MaxFriction/ABS(Tmp[Nf/2]); # Normalize peak;
                  FOR i←1 Thru Nf DO Friction[i] ← Amp×Tmp[i];
                END;
              END
            END
            ELSE IF Arg1="N" THEN
            BEGIN
              PRINT("Nut");
              IF NOT GetFlt(NiSr,NoSr,IcSr,OcSr,NutFilterFile,Quiet)
                THEN CONTINUE "GetParameters";
              AinInt((Hur ← NoSr-2 MAX 0),"Phase-Delay Offset for nut filter (samples)");
            END
            ELSE IF EQU(Arg1[1 FOR 2],"BR") THEN
            BEGIN
              IF NOT GetFlt(NiSl,NoSl,IcSl,OcSl,BridgeFilterFile,Quiet)
              THEN BEGIN BridgeFilterFile←NULL; CONTINUE "GetParameters" END;
              AinInt((Hul ← NoSl-2 MAX 0),"Phase-Delay Offset for bridge filter (samples)");
            END
            ELSE IF EQU(Arg1[1 FOR 2],"BO") THEN
            BEGIN
              IF NOT GetFlt(NiB,NoB,IcB,OcB,BodyFilterFile,Quiet)
              THEN BEGIN BodyFilterFile←NULL; CONTINUE "GetParameters" END;
            END
            ELSE IF Arg1="B" THEN PRINT(" Ambiguous input option",CrLf)
            ELSE PRINT(" No such input option",CrLf);
          END "Input";
      ["N"]  BEGIN "NoteSpec"
              AinReal(PcPv," Periodic vibrato relative amplitude");
              AinReal(Pvf," Periodic vibrato rate in Hz");
              AinReal(PcRv," Random vibrato relative amplitude");
              AinReal(Rvf," Random vibrato rate in Hz");
              AinReal(PcBn," Bow noise relative amplitude");
              AinReal(Bnf," Bow noise rate in Hz");
             END "NoteSpec";
      ["T"]  PRINT(CrLf," TRACE set to ",TRACE←INTSCAN(Arg1,Brk),CrLf);
      ["Q"]  Quiet ← ¬ (Arg1 ≠ BoolFalk);
      ["E"]  CALL(0,"EXIT");
      [";"]  ;      # For comments or command prompt refresh;
      [ALT]  DONE "OmniLoop";
      [CR]   DONE "GetParameters";
      ELSE PRINT(" what?",CrLf)
    END "SetParameters";
  END "GetParameters";

  N←FsmOur;
  Nl←NmLift;
  P←Fs/Frq + 0.5;
  Pl ← PmBowPosition-Hul+0.5; # Amount of string to left of bow (toward bridge);
  Pr ← P - Pl - Hur; # Amount of string to the right of the bow (toward nut);

  IF BPtc LEQ 0 THEN BPpr ← 0 ELSE
    BPpr ← EXP(-1/(BPtc×Fs)); # term ratio for exponential rise at time-constant;
  IF BVtc LEQ 0 THEN BVpr ← 0 ELSE
    BVpr ← EXP(-1/(BVtc×Fs));
  BPas ← BowPressure×(1-BPpr); # Additive constant to achieve asymptotic value;
  BVas ← BowVelocity×(1-BVpr);

  IF BPdtc LEQ 0 THEN BPdpr ← 0 ELSE
    BPdpr ← EXP(-1/(BPdtc×Fs));
  BPdas ← (BPfin/BowPressure)×(1-BPdpr);

  IF SndPtr≠NULL!RECORD THEN
  BEGIN
    DefPtr ← NEW!RECORD(SndFile);
    Def(Clock) ← Fs;
    Def(Pack)  ← 4; # 16-bit SAM format;
    Def(Spw)   ← 2; # 16-bit SAM format;
    Def(MaxAmp)← 1; # See to this before writing out;
    Def(Name)  ← "TEST.SND";
  END ELSE DefPtr←SndPtr;

# Set up the model;

  BEGIN "ALAR"
    REAL ARRAY BodyOut[1:N],Yinit[1:P]; # Output signal and initial string state;
    REAL ARRAY ForceOut,VelOut[1:N];
    REAL Yil,Yl,Yol,Yir,Yr,Yrm1,Yrm,Yor,Yb,Ybp;   # String velocities;

    # Below are the delay-lines used for ideal-string propagation;
    REAL ARRAY Sdl[1:Pl]; # Bridge to bow and back;
    REAL ARRAY Sdr[1:Prm(1+PcRv+PcPv)+1]; # Bow to nut and back;
```

BEST AVAILABLE COPY

```
# Below are the delay-lines used for internal filter delays;
REAL ARRAY XdSr [1:NiSr+1],YdSr [1:NoSr]; # Nut-side string filter state;
REAL ARRAY XdSl [1:NiSl+1],YdSl [1:NoSl]; # Bridge-side string filter state;
REAL ARRAY XdB  [1:NiB +1],YdB  [1:NoB ]; # Body-filter state;

# Below are pointers to the filter-state delay-lines;
INTEGER SdlPtr,SdrPtr,XdSlPtr,YdSlPtr,XdSrPtr,YdSrPtr,XdBPtr,YdBPtr;

y it:

SETFORMAT(8,5);

IF SndPtr NEQ NULL!RECORD THEN FOR i←1 STEP 1 UNTIL P DO Yinit[i]←In(Data)[i]
  ELSE IF Trace5 THEN Yinit[1]←1 ELSE ARRCLR(Yinit);

Yil ← Yl ← Yol ← Yir ← Yr ← Yr ← Yrml ← Yrm ← Yor ← 0; # Zero string state;
SdlPtr ← SdrPtr ← XdSlPtr ← YdSlPtr ← XdSrPtr ← YdSrPtr ← XdBPtr ← YdBPtr ← 1;
BP ← BY ← Disp ← tBp ← 0; tBpd←1; No10 ← N/10 MAX 1; Ppr←Pr;
Stuck ← TRUE;        # Zero intitial bow velocity => sticking initially;

FOR Samp←1 STEP 1 UNTIL N DO
BEGIN "PlayLoop"
  OWN INTEGER NPwait;
  IF Samp MOD No10 ← 0 THEN PRINT("s");

 following block handles vibrato;

   DEFINE Eps←"0.01"; # This avoids pole-zero cancellation in the allpass;
   DcPr ← PrmVibr(...SPmPcPv,BPmPcPv,Pvf,Rvf,Fs,Samp); # Desired current period;
   Cpr ← DcPr-Eps; # Floor to get integer part of desired delay;
   Pap ← DcPr-Cpr; # Difference in delay to get with allpass;
   Apc ← (1-Pap)/(1+Pap); # Allpass coefficient;
   IF Cpr←Ppr+1 THEN
   BEGIN
     IF Trace3 THEN PRINT(" increasing delay-line at time ",Samp/Fs,Crlf);
     FOR i←Cpr STEP -1 UNTIL SdrPtr+1 DO Sdr[i]←Sdr[i-1];
     Sdr[SdrPtr]←Yrml; # Add allpass delay cell to end of delay-line;
     Yrml ← 0; # Is this the best possible reset here?;
     Ppr ← Cpr;
   END
   ELSE IF Cpr←Ppr-1 THEN
   BEGIN
     IF Trace3 THEN PRINT(" decreasing delay-line at time ",Samp/Fs,Crlf);
     Yrml ← Sdr[SdrPtr]; # Pop last delay element into allpass;
     FOR i←SdrPtr Thru Cpr DO Sdr[i]←Sdr[i+1]; # Cover down;
     Ppr ← Cpr;
   END
   ELSE IF Cpr NEQ Ppr THEN PRINT(" Delay-line changed by ",Cpr-Ppr,Crlf);

 following block handles the exponential motion of force and velocity;

   BY ← BYas + BYprmBY; # Exponential from zero to final;
   BYas ← BYas + BowAccel; # Integrate acceleration;
   tBp ← BPas + BPprmtBp; # Attack;
   tBpd ← BPdas + BPdprmtBpd; # Decay;
   BP ← tBpmtBpd;

 for the string loop simulation;

   Ybp ← Yil + Yir; # String velocity under the bow;
   Disp ← Disp + Ybp; # Current displacement at the bowing point;
   BulkForce ← StiffnessmDisp; # Restoring force due to tension increase;
   IF ABS(BulkForce)>ABS(BP) THEN PRINT(Samp," $$$ Bulk force exceeds bow force $$$ ");
   IF Samp←N1 THEN PRINT("(((Lifting bow)))");
```

BEST AVAILABLE COPY

What is claimed is:

1. A real time tone generation system comprising:

means for providing a control signal, the value of which is variable within a range including plural non-zero values in accordance with performance variation, for initiating and thereafter controlling generation of a tone;

wave transmission means for transmitting wave signals, the wave transmission means including an input and an output, a first signal path for receiving signals from the input, a second signal path for providing signals to the output, the first signal path being coupled to the second signal path, and delay means in at least one of the signal paths for delaying signals;

junction means having a first input for receiving the control signal, a second input for receiving a signal from the output of the wave transmission means and an output for providing a signal as the input to the wave transmission means which is a function of at least the value of the control signal and the value of the signal received from the output of the wave transmission means so as to cause a tone signal to propagate in the wave transmission means and to vary in response to variation of the value of the control signal, wherein transmission characteristics of the wave transmission means and junction means determine the pitch of the tone signal; and tone signal extracting means for extracting a tone signal from at least one of the wave transmission means and junction means.

2. A tone generation system as in claim 1 including coupling means for at least partially coupling signals from the first path to the second path.

3. A tone generation system as in claim 2 wherein the coupling means couples less than all of the signal from the first path to the second path.

4. A tone generation system as in claim 2 wherein said coupling means includes a low pass filter.

5. A tone generation system as in claim 2 wherein said coupling means includes means for inverting signals.

6. A tone generation system as in claim 5 wherein the coupling means includes means for filtering signals passing therethrough.

7. A tone generation system as in claim 2 wherein the coupling means includes gain control means for controlling gain of signals passing therethrough.

8. A tone generation system as in claim 7 wherein the gain control means controls gain in accordance with a preselected tone color.

9. A tone generation system as in claim 2 wherein said coupling means includes means for inverting and controlling the gain of signals passing therethrough.

10. A tone generation system as in claim 1 wherein the junction means includes conversion means for converting the signal from the second path in accordance with a conversion characteristic and switching means for selecting the conversion characteristic in accordance with the value of the control signal.

11. A tone generation system as in claim 1 wherein the junction means includes non-linear conversion means which receives the signal from the second path and converts it to the signal provided to the first path in accordance with a non-linear characteristic.

12. A tone generation system as in claim 11 wherein the non-linear conversion means includes table means for storing values representative of the non-linear characteristic and addressing means for addressing the table means in accordance with the values of the control signal and the signal from the second path, wherein the output of the table means is employed to generate the output of the junction means.

13. A tone generation system as in claim 12 wherein the addressing means receives the control signal and the signal from the second path and addresses the table means in accordance with the difference between the signals.

14. A tone generation system as in claim 12 wherein the table means stores compressed data and further including modification means for modifying the compressed data read out from the table means to provide the output of the junction means.

15. A tone generation system as in claim 14 wherein the table means stores data of a predetermined number of bits and wherein the modification means includes means for operating on the output of the table means to provide expanded data of a number of bits greater than the predetermined number of bits.

16. A tone generation system as in claim 1 wherein the control signal generating means includes means for generating a control signal having a noise component.

17. A tone generation system as in claim 16 wherein said noise component is white noise.

18. A tone generation system as in claim 1 wherein said control signal generating means includes means for generating a control signal having a regularly varying repeating component to impart a desired musical effect to the tone to be generated.

19. A tone generation system as in claim 18 wherein said repeating component is a tremolo component.

20. A tone generation system as in claim 1 wherein said delay means includes means for modifying a signal passing through the delay means in addition to delaying the signal.

21. A tone generation system as in claim 20 wherein the means for modifying includes all-pass filter means for imparting phase changes to a signal passing through the delay means.

22. A tone generation system as in claim 14 wherein the non-linear modification means includes interpolation means for interpolating values between stored values.

23. A tone generation system comprising;

means for providing a control signal for initiating and thereafter controlling generation of a tone;

wave transmission means for transmitting wave signals, the transmission means including an input and an output, a first signal path for receiving signals from the input, a second signal path for providing signals to the output, the first signal path being coupled to the second signal path, and delay means in at least one of the signal paths for delaying signals;

coupling means for at least partially coupling signals from the first path to the second path, wherein the coupling means includes means for blocking DC signals;

junction means having a first input for receiving the control signal, a second input for receiving a signal from the second path and an output for providing a signal to the first path which is a function of at least the value of the control signal and the value of the signal received from the second path so as to cause a tone signal to propagate in the wave transmission means, wherein transmission characteristics of the wave transmission means and junction means determine the pitch of the tone signal; and tone signal extracting means for extracting a tone signal from at least one of the wave transmission means and junction means.

24. A real time tone generation system comprising:

means for providing a control signal, the value of which is variable within a range including plural non-zero values in accordance with performance variation, for initiating and thereafter controlling generation of a tone, wherein the value of the control signal is substantially independent of the pitch of a tone to be generated;

wave transmission means for receiving the control signal and electronically simulating wave transmission which occurs in a natural musical instrument so as to create at least one wave signal in the wave transmission means in response to the control signal, said wave signal interacting with the control signal so as to be sustained and varied in response to variation of the value of the control signal; and means for extracting a signal from the wave transmission means as a musical tone signal whose pitch is determined by transmission characteristics of the wave transmission means.

25. A tone generation system as in claim 24 wherein the natural musical instrument is a wind instrument and the control signal represents mouth pressure, wherein the wave transmission means includes a first end representing a mouthpiece which receives the control signal and a second end representing an opening end, wherein wave signals are generated and transmitted in the wave transmission means between the first and second ends in response to the control signal.

26. A tone generation system as in claim 24 wherein the wave transmission means further includes pitch control means for altering wave propagation characteristics in the wave transmission means so as to change the pitch of the musical tone signal.

27. A tone generation system as in claim 26 wherein the wave transmission means includes a network of plural wave transmission paths and wherein the pitch control means includes means for varying the transmission characteristics of different portions of the network.

28. A tone generation system as in claim 25 wherein the wave transmission means includes means for simulating wave transmission characteristics of a wind instrument having a bore whose diameter increases from the mouth piece to the opening end.

29. A tone generation system as in claim 25 wherein the natural musical instrument is a reed instrument.

30. A tone generation system as in claim 29 wherein the natural musical instrument is a clarinet.

31. A tone generation system as in claim 29 wherein the natural musical instrument is a saxophone.

32. A tone generation system as in claim 24 wherein the natural musical instrument is a stringed instrument and the wave transmission means includes first and second wave transmission sections for transmitting wave signals and junction means interconnecting the first and second wave transmission sections and receiving the control signal, wherein wave signals are created in both the first and second wave transmission sections.

33. A real time tone generation system comprising:

control means for providing a control signal for initiating and thereafter controlling tone generation;

at least first and second wave transmission means, each including an input and an output, a first signal path for receiving signals from the input, a second signal path for providing signals to the output, coupling means for coupling signals from the first path to the second path, and delay means in at least one of the signal paths for delaying signals propagating therethrough;

junction means having a first input for receiving the control signal, a plurality of second inputs each of which is connected to the output of a wave transmission means, and a plurality of outputs each of which is connected to the input of a wave transmission means, the junction means providing outputs whose values are functions of the values of the control signal and the outputs of the wave transmission means, said control signal causing periodic signals to be generated and propagate in the wave transmission means; and musical tone extracting means for extracting a musical tone signal from at least one of the junction means and wave transmission means, wherein transmission characteristics of the wave transmission means and junction means determine the pitch of the tone signal.

34. A tone generation system as in claim 33 wherein the junction means includes adding means for adding the signals from the outputs of the wave transmission means to provide an addition signal, the junction means providing outputs whose values are functions of the control signal and the addition signal.

35. A tone generation system as in claim 34 wherein the junction means includes subtracting means for subtracting the addition signal from the control signal to obtain a subtraction signal, the junction means providing outputs whose values are functions of the subtraction signal.

36. A tone generation system as in claim 35 further including table means for providing an output from a predetermined table in response to the subtraction signal, the junction means providing outputs whose values are functions of the output from the table.

37. A tone generation system as in claim 36 further including plural output adding means each having an output to a wave transmission means, each adding means for adding the output from the table with the output of at least one wave transmission means other than the one to which the output of the respective output adding means is connected, the outputs of the output adding means forming the outputs of the junction means.

38. A tone generation system as in claim 33 wherein the coupling means includes means for inverting signals passing from the first signal path to the second signal path.

39. A tone generation system as in claim 33 wherein the coupling means includes means for low pass filtering signals passing therethrough.

40. A tone generation system as in claim 33 wherein the coupling means includes means for introducing a loss into signals passing therethrough.

41. A tone generation system as in claim 33 wherein there are two wave transmission means.

42. A tone generation system as in claim 41 wherein each wave transmission means provide a predetermined amount of delay in order to provide a desired frequency content in the musical tone signal.

43. A tone generation system as in claim 33 wherein the system simulates a bowed string instrument and wherein the control signal represents bow velocity.

44. A tone generation system as in claim 43 including means providing a control signal which varies with time to represent bow velocity.

45. A tone generation system as in claim 33 wherein the first and second wave transmission means provide a predetermined ratio of delay amounts.

46. A real time tone generation system comprising:

control means for providing a control signal for initiating and thereafter controlling generation of a tone;

at least first and second wave transmission means, each including an input and an output, a first signal path for receiving signals from the input, a second signal path for providing signals to the output, coupling means for coupling signals from the first path to the second path, and delay means in at least one of the signal paths for delaying signals propagating therethrough;

junction means, having a first input for receiving the control signal, a second input which is connected to the output of a wave transmission means, and an output which is connected to the input of a wave transmission means, the junction means providing an output signal whose value is a function of the values of the control signal and an output signal of a wave transmission means, said control signal causing a periodic signal to be generated and propagate in the wave transmission means; and musical tone extracting means for extracting a musical tone signal from at least one of the junction means and the wave transmission means, wherein transmission characteristics of the wave transmission means and junction means determine the pitch of the tone signal.

47. A tone generation system as in claim 46 wherein the junction means includes operating means for processing the signal at the second input as a function of the control signal to provide an operation result to the output of the junction means.

48. A tone generation system as in claim 47 wherein the operating means includes adding means for adding signals from the outputs of the first and second wave transmission means to provide an addition signal, the junction means providing at least one output signal whose value is a function of the control signal and the addition signal.

49. A tone generation system as in claim 48 wherein the operating means includes subtracting means for subtracting the addition signal from the control signal to obtain a subtraction signal, the junction means providing at least one output signal whose value is a function of the subtraction signal.

50. A real time tone generation system comprising:

control means for providing a control signal for initiating and thereafter controlling generation of a tone;

a plurality of wave transmission sections each having a first end and a second end, a first signal path for propagating signals from the first end to the second end and a second signal path for propagating signals from the second end to the first end, wherein each wave transmission section includes at least one delay element in at least one of its signal paths;

a first junction connected to the first end of a first wave transmission section, the first junction receiving at least the control signal and a signal from the second signal path and providing a signal to the first path which is a function of the received signals;

at least one additional junction, each connected to a first end of wave transmission section and a second end of another wave transmission section so as to interconnect the wave transmission sections in a cascade fashion, each additional junction receiving signals from the wave transmission sections connected to it and partially transmitting the signals from the wave transmission section to the other wave transmission section and partially reflecting the signals back to the wave transmission section from which the signals were received;

means connected to the second end of at last wave transmission section for at least partially coupling signals from the first signal path to the second signal path of the last wave transmission section; and means for extracting a signal from at least one point in the cascaded wave transmission section and junction combination to provide a musical tone signal which is created and propagated within the wave transmission sections in response to the control signal, where transmission characteristics of the wave transmission section and junction combination determine the pitch of the tone signal.

51. A tone generation system as in claim 50 including means for controlling the transmission and reflection characteristics of at least one additional junction to control the pitch of the musical tone signal.

52. A tone generation system as in claim 50 wherein at least one of the additional junctions includes at least three ports including a first port connected to an end of one waveguide, a second port connected to an end of another waveguide and a third port, each of at least two ports from among the three ports having an input path to the junction and an output path from the junction, wherein a signal received at the input path of any particular port is partially transmitted to the output paths of the other ports and is partially reflected to the output path of the particular port.

53. A tone generation system as in claim 50 wherein at least one delay element includes means for modifying a signal passing therethrough in addition to delaying the signal.

54. A tone generation system as in claim 53 wherein the means for modifying includes an all-pass filter.

55. A tone generation system as in claim 50 wherein at least one wave transmission section includes means for varying transmission characteristics with a lapse of time.

56. A tone generation system as in claim 55 wherein at least one wave transmission section includes gain control means for controlling gain in at least one of the first and second signal paths and the means for varying includes means for changing the gain of the gain control means over time.

57. A real time tone generation system comprising:

wave transmission means having a first end having an input and an output, wave transmission path means for receiving signals at the input and transmitting them to the output, the path means including delay means for delaying signals propagating in the path means, the delay means providing an amount of delay corresponding to the pitch of a tone to be generated.

control means for generating a performer-variable control signal for initiating and thereafter controlling generation of a tone;

junction means having a first input connected to the control means to receive the control signal, a second input connected to the output of the wave transmission means and an output connected to the input of the wave transmission means, wherein the signal at the output is a function of the values of the signals at the inputs and wherein a periodic signal is generated and propagated in the wave transmission means in response to the control signal; and output means for extracting a signal from at least one of the wave transmission means and junction means as a musical tone signal, said musical tone signal having a pitch corresponding to the amount of delay imparted by the delay means.

58. A real time tone generation system comprising:

means for providing at least first and second independently variable control signals, said first control signal having a value which is variable within a range including plural non-zero values in accordance with performance variation, said first control signal initiating and thereafter controlling generation of a tone;

wave transmission means for transmitting signals including an input and an output, a first signal path for receiving signals from the input, a second signal path for providing signals to the output, the first signal path being coupled to the second signal path, and delay means in at least one of the signals paths for delaying signals;

junction means, having a first input for receiving the first control signal, a second input for receiving the second control signal, a third input for receiving a signal from the output of the wave transmission means and an output for providing a signal as the input to the wave transmission means which is a function of the value of the first and second control signals and the value of the signal received from the output of the wave transmission means so as to cause a periodic signal to propagate in the wave transmission means; and musical tone extracting means for extracting a musical tone signal from at least one of the wave transmission means and junction means, wherein transmission characteristics of the wave transmission means and junction means determine the pitch of the tone signal.

59. A tone generation system as in claim 58 wherein the junction means includes conversion means for converting the signal from the second path to the signal which is provided to the first path in accordance with a conversion characteristic in switching means for selecting the conversion characteristic in accordance with the value of the first and second control signals.

60. A real time tone generation system comprising:

control means for providing a control signal, the value of which is variable within a range including plural non-zero values in accordance with performance variation, for initiating and thereafter controlling generation of a tone;

a wave transmission section having first and second ends, a first signal path for propagating signals from the first end to the second end, and a second signal path for propagating signals from the second end to the first end;

a first junction connected to the second end of the wave transmission section, said first junction receiving a signal from the first path and transmitting signal to the second path;

wherein at least one of the first path, second path and first junction has at least one delay element therein;

a second junction connected to the first end of the wave transmission section, said second junction receiving at least the control signal and a signal from the second path and providing a signal to the first path which is a function of said received signals, wherein a periodic wave signal is created in the wave transmission section as a result of the interaction of the control signal and the signal received from the second path; and an output for providing an output signal from at least one of the wave transmission section or junctions as a tone signal wherein the pitch of the tone signal is determined by transmission characteristics of the wave transmission section and junctions.

61. A real time tone generation system comprising:

means for providing a control signal for initiating and thereafter controlling generation of a tone, said means including memory means for storing control signal values and addressing means for addressing the memory means to provide a control signal value corresponding to a tone to be generated;

wave transmission means for transmitting wave signals, the wave transmission means including an input and an output, a first signal path for receiving signals from the input, a second signal path for providing signals to the output, the first signal path being coupled to the second signal path, and delay means in at least one of the signal paths for delaying signals;

junction means having a first input for receiving the control signal, a second input for receiving a signal from the output of the wave transmission means and an output for providing a signal as the input to the wave transmission means which is a function of at least the value of the control signal and the value of the signal received from the output of the wave transmission means so as to cause a tone signal to propagate in the wave transmission means, wherein transmission characteristics of the wave transmission means and junction means determines the pitch of the tone signal; and tone signal extracting means for extracting a tone signal from at least one of the wave transmission means and junction means.

* * * * *

UNITED STATES PATENT AND TRADEMARK OFFICE

CERTIFICATE OF CORRECTION

PATENT NO. : 5,212,334

DATED : May 18, 1993

INVENTOR(S) : Julius O. Smith, III

It is certified that error appears in the above-indentified patent and that said Letters Patent is hereby corrected as shown below:

The title page should be deleted to appear as per attached title page. (Pages 1 and 2)

Columns 1-74 should be deleted to appear as per attached columns.

Signed and Sealed this

Fifteenth Day of November, 1994

Bruce Lehman

*Attest:*

BRUCE LEHMAN

*Attesting Officer*

*Commissioner of Patents and Trademarks*

United States Patent [19]

Smith, III

[11] Patent Number: 5,212,334

[45] Date of Patent: May 18, 1993

[54] DIGITAL SIGNAL PROCESSING USING CLOSED WAVEGUIDE NETWORKS

[75] Inventor: Julius O. Smith, III, Palo Alto, Calif.

[73] Assignee: The Board of Trustees of the Leland Stanford Jr. University

[21] Appl. No.: 568,609

[22] Filed: Aug. 16, 1990

Related U.S. Application Data

[60] Division of Ser. No. 414,646, Sep. 27, 1989, Pat. No. 4,984,276, which is a continuation of Ser. No. 275,620, Nov. 14, 1988, abandoned, which is a continuation of Ser. No. 920,701, Oct. 17, 1986, abandoned, which is a continuation-in-part of Ser. No. 859,868, May 2, 1986, abandoned.

[51] Int. Cl.[5] ..... G10H 1/02; G10H 1/12; G10H 1/46

[52] U.S. Cl. ..... 84/622; 84/629; 84/633; 84/DIG. 9; 84/DIG. 10

[58] Field of Search ..... 84/622–625, 84/629, 630, 633, 648, 661–665, 675–677, 699, 700, 707, 736–741, DIG. 9, DIG. 10, DIG. 11, DIG. 26

[56] References Cited

U.S. PATENT DOCUMENTS

| | | | |
|---|---|---|---|
| Re. 31,004 | 8/1982 | Niimi . | |
| 3,347,973 | 10/1967 | Freeman | 84/675 X |
| 3,838,202 | 9/1974 | Nakada . | |
| 4,130,043 | 12/1978 | Niimi . | |
| 4,475,229 | 10/1984 | Frese . | |
| 4,508,000 | 4/1985 | Suzuki | 84/675 X |
| 4,548,119 | 10/1985 | Wachi et al. | 84/DIG. 9 |
| 4,554,858 | 11/1985 | Wachi et al. | 84/DIG. 9 |
| 4,622,877 | 11/1986 | Strong . | |
| 4,633,500 | 12/1986 | Yamada et al. | 381/51 |
| 4,649,783 | 3/1987 | Strong et al. . | |

FOREIGN PATENT DOCUMENTS

| | | |
|---|---|---|
| 58-48109 | 10/1983 | Japan . |
| 58-58678 | 12/1983 | Japan . |
| 59-7396 | 2/1984 | Japan . |
| 59-19353 | 5/1984 | Japan . |
| 59-19354 | 5/1984 | Japan . |

OTHER PUBLICATIONS

"Piano Tone Synthesis by Computer Simulation–Digital Filter Method" by Isao Nakamura, Junichiro Yamaguchi, Apr. 1977.

"Extended Application of Digital /ilter Method to Plural Strings" by Isao Nakamura, Hironobu Takagi, Oct. 1981.

"Elimination of Limit Cycles and Overflow Oscillations in Time–Varying Lattice and Ladder Digital Filters", by Julius O. Smith, CCRMA, Dept. of Music, Stanford University.

"Waveguide Digital Filters", by Julius O. Smith, CCRMA, Dept. of Music, Stanford University.

"New Approach to Digital Reverberation using Closed Waveguide Networks", by Julius O. Smith, CCRMA, Dept. of Music, Stanford University.

"Functional Model of a Simplified Clarinet", by Stephen E. Stewart, et al., Department of Physics and Astronomy, Brigham Young University, accepted for publication Apr. 5, 1980, pp. 109–120.

"Self–Sustained Oscillations of the Clarinet: An Integral Equation Approach" by R. T. Schumacher, Dept. of Physics, Carnegie–Mellon University, pp. 298–309.

"Self–Sustained Oscillations of the Bowed String". by R. T. Schumacher, Dept. of Physica, Carnegie–Mellon University, pp. 111–120.

"On the Fundamentals of Bowed–String Dynamics", by M. E. McIntyre and J. Woodhouse, Department of Applied Mathematics and Theoretical Physics, University of Cambridge, vol. 43, No. 2, 1979, pp. 93–108.

"Air Flow and Sound Generation in Musical Wind Instruments", by N. H. Fletcher, Dept. of Physics, University of New England, 1979, pp. 123–146.

"Mechanism of Self–excited Feedback Oscillation in Clarinet", by Jun–ichi Saneyoshi, Tamagawa University.

"Regeneration in Brass Wind Instruments", by S. J. Elliott and J. M. Bowsher, Dept. of Physics, University of Surrey, Journal of Sount and Vibration, 1982 pp. 181–217.

"Synthesis of Bowed Strings", by Julius Orion Smith III, CCRMA, Dept. of Music, Stanford University.

"Techniques for Digital Filter Design and System Identification with Application to the Violin", by Julius O. Smith III, Stanford University, Jun., 1983.

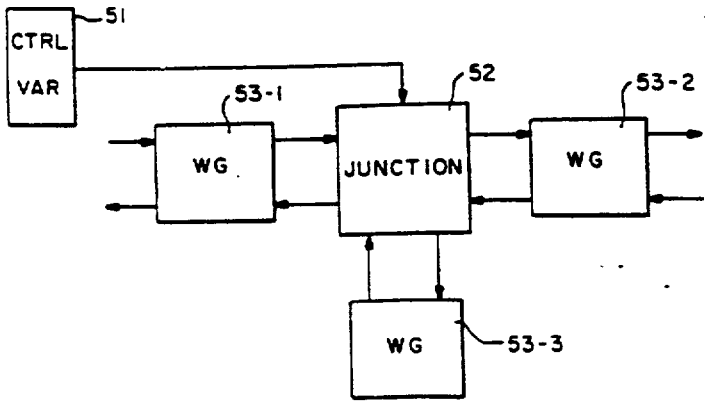

"On the Oscillations of Musical Instrument", by M. E. McIntyre Dept. of Applied Mathematics and Theoretical Physics, University of Cambridge, R. T. Schumacher, Dept. of Physics, Carnegie-Mellen University and J. Woodhouse, Topexpress Ltd., publised 1983. pp. 1325–1345.
"Extensions of the Karplus-Strong Plucked-String Algorithm", by David A. Jaffe and Julius O. Smith, CCRMA, Stanford University, Computer Music Journal, vol. 7, No. 2, 1983, pp. 56–69.
"Digital Synthesis of Plucked-String and Drum Timbres", by Kevin Karplus, Computer Science Dept., Cornell University and Alex Strong, Computer Science Dept., Stanford University, Computer Music Journal, vol. 7, No. 2, 1983, pp. 43–55.
"A VLSI Approach To Sound Synthesis", by John Wawrzynek, et al. ICMI '84 Proceedings, pp. 53–64.

*Primary Examiner*—Stanley J. Witkowski
*Attorney, Agent, or Firm*—Graham & James

[57] ABSTRACT

A tone generation system includes one or more digital waveguide networks coupled to one or more junctions, one of which receives a control signal for controlling tone generation. The control signal initiates and interacts with a wave signal propagating through the waveguide networks to form a tone signal. A non-linear junction may be employed which receives a signal from a waveguide, converts it in accordance with a non-linear function based upon the value of the control signal and provides it back to the waveguide. A tone signal whose pitch is determined by the wave transmission characteristics of the waveguide network is thereby produced.

61 Claims, 7 Drawing Sheets

DIGITAL SIGNAL PROCESSING USING CLOSED WAVEGUIDE NETWORKS

CROSS-REFERENCE TO RELATED APPLICATION

This is a division of application Ser. No. 07/414,646, now U.S. Pat. No. 4,984,276 filed on Sep. 27, 1989, which is a continuation of application Ser. No. 07/275,620, filed Nov. 14, 1988, abandoned, which is a continuation of application Ser. No. 06/920,701, filed Oct. 17, 1986, abandoned, which is a continuation-in-part of application Ser. No. 06/859,868, filed May 2, 1986, abandoned.

BACKGROUND OF THE INVENTION

This invention relates to the field of digital signal processing and particularly to signal processing useful in digital music synthesis and other applications.

Digital music synthesis has attracted increased interest as data processors have undergone new developments which provide increased performance capabilities. Digital music synthesis has many applications such as the synthesis of stringed, reed and other instruments and such as the synthesis of reverberation.

In actual practice, it has been difficult to provide satisfactory models of music instruments, based upon quantitative physical models, which can be practically synthesized on a real-time basis using present-day computers and digital circuitry.

Most traditional musical instruments such as woodwinds and strings, have been simulated by additive synthesis which consists of summing together sinusoidal harmonics of appropriate amplitude, or equivalently by repeatedly reading from a table consisting of one period of a tone (scaled by an "amplitude function") to "play a note." Another method consists of digitally sampling a real musical sound, storing the samples in digital memory, and thereafter playing back the samples under digital control. FM synthesis as described, for example, in U.S. Pat. No. 4,018,121, has also been successful in synthesizing many musical sounds including brasses, woodwinds, bells, gongs, and some strings. A few instruments have been simulated by "subtractive synthesis" which shapes the spectrum of primitive input signals using digital filters.

All of the foregoing methods (with the occasional exception of subtractive synthesis) have the disadvantage of not being closely related to the underlying physics of sound production. Physically accurate simulations are expensive to compute when general finite-element modeling techniques are used.

In accordance with the above background, there is a need for techniques for synthesizing strings, winds, and other musical instruments including reverberators in a manner which is both physically meaningful and computationally efficient. There is a need for the achievement of natural and expressive computer-controlled performance in ways which are readily comprehensible and easy to use.

SUMMARY OF THE INVENTION

The present invention is a signal processor formed using digital waveguide networks. The digital waveguide networks have signal scattering junctions. A junction connects two waveguide sections together or terminates a waveguide. The junctions are constructed from conventional digital components such as multipliers, adders, and delay elements. The number of multiplies and additions determines the number of signal-scattering junctions that can be implemented in the waveguide network, and the number of delays determines the total delay which can be distributed among the waveguides interconnecting the junctions in the waveguide network. The signal processor of the present invention is typically used for for synthesis of reed, string or other instruments.

The waveguides of the present invention include a first rail for conducting signals from stage to stage in one direction and a second rail for conducting signals from stage to stage in the opposite direction. The accumulated delay along the first rail is substantially equal to the accumulated delay along the second rail so that the waveguide is balanced. The first rail is connected to the second rail at junctions so that signals conducted by one rail are also conducted in part by the other rail.

Lossless waveguides used in the present invention are bi-directional delay lines which sometimes include embedded allpass filters. Losses are introduced as pure attenuation or lowpass filtering in one or both directions.

The signal processor in some applications includes a non-linear junction connected to provide an input signal to the first rail of the waveguide and to receive an output signal from the second rail of the waveguide. The non-linear junction in some embodiments receives a control variable for controlling the non-linear junction and the signals to and from the waveguide.

In one embodiment, a reed instrument is synthesized by a non-linear junction terminating a digital waveguide. A primary control variable, representing mouth pressure, is input to the non-linear junction (also controlled secondarily by embouchure variables). The junction simulates the reed while the digital waveguide simulates the bore of the reed instrument.

In another embodiment, a string instrument is synthesized. A primary control variable, representing the bow velocity, is input to the non-linear junction. The non-linear junction represents the bow-string interface (including secondary controls such as bow force, bow angle, bow position, and friction characteristics). In the stringed instrument embodiment, two digital lossless waveguides are connected to the non-linear junction. The first waveguide represents the long string portion (from the bow to the nut) and the other waveguide simulates the short string portion (from the bow to the bridge). A series of waveguides can also be used to implement the body of, for example, a violin, although in such a case there is normally no direct physical interpretation of the waveguide variables.

In particular embodiments, the reflection signal or signal coefficients introduced into the waveguides from the nonlinear junction are obtained from a table. In one embodiment, the nonlinearity to be introduced into the waveguides is $f(x)$ where $x$ is the table address and also the incoming signal sample in the waveguide (a travelling wave sample). In another embodiment, the values $g(x)=f(x)/x$ are stored in the table and the table is addressed by $x$. Each value of $g(x)$ addressed by $x$ from the compressed table (where $g(x)$ is called a coefficient) is then multiplied by $x$, $x*g(x)$ which thereby produces the desired value of $f(x)$.

In accordance with the above summary, the present invention captures the musically important qualities of natural instruments in digital music synthesis with digital processing techniques employing digital waveguides which are computationally efficient and therefore capable of inexpensive real-time operation.

The foregoing and other objects, features and advantages of the invention will be apparent from the following detailed description in conjunction with the drawings.

BRIEF DESCRIPTION OF THE DRAWINGS

FIG. 1 depicts a simple closed waveguide network.

FIG. 2 depicts a 3-port waveguide network.

FIG. 3 depicts a junction of two waveguides.

FIG. 4 depicts a cascade waveguide network in accordance with the present invention.

FIG. 5 depicts one embodiment of a cascade waveguide network section.

FIG. 6 depicts another embodiment of a cascade waveguide network section.

FIG. 7 depicts a third embodiment of a cascade waveguide network section.

FIG. 8 depicts a pipelined embodiment of a waveguide filter.

FIG. 9 depicts a travelling pressure wave at a general point within a waveguide section.

FIG. 10 depicts a normalized-waveguide digital filter.

FIG. 11 depicts a wave-normalized waveguide junction.

FIG. 12 depicts a transformer junction.

FIG. 13 depicts transformer-coupled waveguide junction.

FIG. 14 depicts a non-linear junction, controlled by a control variable, and connected through a plurality of ports to a plurality of waveguides.

FIG. 15 depicts a terminating non-linear junction controlled by a control variable and connected to a waveguide network.

FIG. 16 depicts further details of the non-linear junction of FIG. 9.

FIG. 17 depicts a block diagram representation of the waveguide of FIG. 9.

FIG. 18 depicts a non-linear junction connected to first and second waveguides.

FIG. 19 is a signal processor forming a music instrument using digital waveguides.

FIG. 20 is a graph of a waveform representing the data stored in the table of FIG. 16 for a reed instrument.

FIG. 21 is a graph of a waveform representing the data stored in the table of FIG. 16 for a string instrument.

DETAILED DESCRIPTION

Lossless Networks—FIG. 1

In FIG. 1 a network 10 is a closed interconnection of bi-directional signal paths 11. The signal paths 11 are called branches or waveguides, designated 11-1, 11-2, 11-3, 11-4, and 11-5 and the interconnection points are called nodes or junctions, designated 12-1, 12-2, 12-3, and 12-4. An example of a simple network is shown in FIG. 1 where each signal path is bi-directional, meaning that in each waveguide there is a signal propagating in one direction and an independent signal propagating in the other direction. When a signal reaches a junction, one component is partially reflected back along the same waveguide, and other components are partially transmitted into the other waveguides connected to the junction. The relative strengths of the components of the transmitted or "scattered" signals at each junction are determined by the relative characteristic impedances of the waveguides at the junction. In FIG. 1, the waveguides 11 intersect at the junctions 12.

A lossless waveguide, such as each of the waveguides in FIG. 1, is defined specifically as a lossless bi-directional signal branch. In the simplest case, each branch or waveguide 11 in a waveguide network 10 is merely a bi-directional delay line. The only computations in the network take place at the branch intersection points (nodes or junctions). More generally, a lossless waveguide branch may contain a chain of cascaded allpass filters. For practical reverberator and other designs, losses are introduced in the form of factors less than 1 and/or low pass filters with a frequency response strictly bounded above by 1 in magnitude.

A closed lossless network preserves total stored signal energy. Energy is preserved if, at each time instant, the total energy stored in the network is the same as at any other time instant. The total energy at any time instant is found by summing the instantaneous power throughout the network waveguides 11. Each signal sample within the network contributes to instantaneous power. The instantaneous power of a stored sample is the squared amplitude times a scale factor, g. If the signal is in units of "pressure", "force", or equivalent, then $g=1/Z$, where Z is the characteristic impedance of the waveguide 11 medium. If the signal sample instead represents a "flow" variable, such as volume-velocity, then $g=Z$. In either case, the stored energy is a weighted sum of squared values of all samples stored in the digital network 10.

N-Port Network—FIG. 2

In FIG. 2, an N-port network 14 is shown in which for $N=3$, three waveguides, called ports, leave the network with one port 15 designated for input and two ports 16-1 and 16-2 designated for output. Such a structure is suitable, for example, for providing stereo reverberation of a single channel of sound. Note, however, that really in FIG. 2 there are three inputs(15, 16-1, 16-2) and three outputs(15, 16-1, 16-2) because in an N-port, each waveguide connected to the network provides both an input and an output since each waveguide is bi-directional.

An N-port network 14 of FIG. 2 is lossless if at any time instant, the energy lost through the outputs, equals the total energy supplied through the inputs, plus the total stored energy. A lossless digital filter is obtained from a lossless N-port by using every port as both an input and an output. This filter is the general multi-input, multi-output allpass filter.

An N-port network 14 is linear if superposition holds. Superposition holds when the output in response to the sum of two input signals equals the sum of the outputs in response to each individual input signal. A network is linear if every N-port derived from it is linear. Only linear networks can be restricted to a large and well-understood class of energy conserving systems.

Lossless Scattering—FIG. 3

Consider a parallel junction of N lossless waveguides of characteristic impedance $Z_i$ (characteristic admittance $\Gamma_i=1/Z_i$) as depicted in FIG. 3 for $N=2$.

If in FIG. 3 the incoming traveling pressure waves are denoted by $P_i+$, where $i=1, \ldots, N$, the outgoing pressure waves are given by Eq.(1) as follows:

$$P_i^- = P_j - P_i^+ \quad \text{Eq.(1)}$$

where $P_j$ in Eq.(1) is the resultant junction pressure given as follows:

$$P_j = \sum_{i=1}^{N} \alpha_i P_i^+ \quad \text{Eqs. (2)}$$

$$\text{where } \alpha_i = (2\Gamma_i)/\left(\sum_{l=1}^{N} \Gamma_l\right)$$

For N=2, $$P_j = \alpha_1 P_1^+ + \alpha_2 P_2^+$$

$$\alpha_1 = (2\Gamma_1)/(\Gamma_1 + \Gamma_2)$$

$$\alpha_2 = 2 - \alpha_1$$

Define the reflection coefficient by $k = \alpha_1 - 1$, then from Eq. 1, $$\begin{aligned} P_1^- &= P_j - P_1^+ \\ &= (\alpha_1 - 1)P_1^+ + \alpha_2 P_2^- \end{aligned}$$

$$P_1^- = kP_1^+ + (1-k)P_2^+$$

$$P_2^- = \alpha_1 P_1^+ + (\alpha_2 - 1)P_2^+$$

$$P_2^- = (k+1)P_1^+ - kp_2^+$$

Thus, we have, for N=2, $$P_1^- = P_2^+ + k(P_1^+ - P_2^+)$$

$$P_2^- = P_1^+ + k(P_1^+ - P_2^+) \quad \text{Eqs. (3)}$$

which is the one-multiplier lattice filter section (minus its unit delay). More generally, an N-way intersection requires N multiplies and N−1 additions to obtain $P_j$, and one addition for each outgoing wave, for a total of N multiplies and 2N−1 additions.

The series flow-junction is equivalent to the parallel pressure-junction. The series pressure-junction or the parallel flow-junction can be found by use of duality.

Cascade Waveguide Chains—FIG. 4

The basic waveguide chain 25 is shown in FIG. 4. Each junction 26-1, 26-2, . . . , 26-i, . . . , 26-M enclosing the symbol $k_i(t)$ denotes a scattering junction characterized by $k_i(t)$. In FIG. 4, the junction 26-i typically utilizes multipliers (M) 8 and adders(+) 7 to form the junction. In FIG. 4, the multipliers 8-1, 8-2, 8-3 and 8-4 multiply by the factors $[1+k(i)]$, $[-k_i(t)]$, $[1-k_i(t)]$, and $[k_i(t)]$, respectively. An alternative junction implementation 26'-i of FIG. 13 requires only one multiply. The junction 26-2 in FIG. 4 corresponds, for example, to the junction 12 in FIG. 3. Similarly, the delays 27-1 and 27-2 in FIG. 4 correspond to the branches 15 and 16, respectively, in FIG. 3. The Kelly-Lochbaum junctions 26-i and one-multiply junction 26'-i (see FIG. 13) or any other type of lossless junction may be used for junction 26. In particular, the two-multiply lattice (not shown) and normalized ladder (FIG. 11) scattering junctions can be employed. The waveguide 25 employs delays 27 between each scattering junction 26 along both the top and bottom signal paths, unlike conventional ladder and lattice filters. Note that the junction 26-i of FIG. 4 employs four multipliers and two adds while junction 26'-i of FIG. 13 employs one multiply and three adds.

Waveguide Variations—FIGS. 4–14

Reduction of junction 26 to other forms is merely a matter of pushing delays 27 along the top rail around to the bottom rail, so that each bottom-rail delay becomes 2T seconds ($Z^{-2T}$) instead of T seconds $Z^{-T}$. Such an operation is possible because of the termination at the right by an infinite (or zero) characteristic impedance 6 in FIG. 4. In the time-varying case, pushing a delay through a multiply results in a corresponding time advance of the multiplier coefficient.

Imagine each delay element 27 in FIG. 4 being divided into halves, denoted by a delay of T/2 seconds. Then any waveguide can be built from sections such as shown in FIG. 5.

By a series of transformations, the two input-signal delays are pushed through the junction to the two output delays. A similar sequence of moves pushes the two output delays into the two input branches. Consequently, we can replace any waveguide section of the form shown in FIG. 5 by a section of the form shown in FIG. 6 or FIG. 7.

By alternately choosing the structure of FIG. 6 and 7, the structure of FIG. 8 is obtained. This structure has some advantages worth considering: (1) it consolidates delays to length 2T as do conventional lattice/ladder structures, (2) it does not require a termination by an infinite characteristic impedance, allowing it to be extended to networks of arbitrary topology (e.g., multiport branching, intersection, and looping), and (3) there is no long delay-free signal path along the upper rail as in conventional structures—a pipeline segment is only two sections long. This structure, termed the "half-rate waveguide filter", appears to have better overall characteristics than any other digital filter structure for many applications. Advantage (2) makes it especially valuable for modeling physical systems.

Finally, successive substitutions of the section of FIG. 6 and reapplication of the delay consolidation transformation lead to the conventional ladder or lattice filter structure. The termination at the right by a total reflection (shown as 6 in FIG. 4) is required to obtain this structure. Consequently, conventional lattice filters cannot be extended on the right in a physically meaningful way. Also, creating network topologies more complex than a simple series (or acyclic tree) of waveguide sections is not immediately possible because of the delay-free path along the top rail. For example, the output of a conventional structure cannot be fed back to the input.

Energy and Power

The instantaneous power in a waveguide containing instantaneous pressure P and flow U is defined as the product of pressure and flow as follows:

$$P = PU = (P^+ + P^-)(U^+ + U^-) = P^+ + P^- \quad \text{Eq.(4)}$$

where, $$P^+ = P^+ U^+ = Z(U^+)^2 = \Gamma(P^+)^2$$

$$P^- = P^- U^- = -Z(U^-)^2 = -\Gamma(P^-)^2 \quad \text{Eqs.(5)}$$

define the right-going and left-going power, respectively.

For the N-way waveguide junction, we have, using Kirchoff's node equations, Eq.(6) as follows:

$$P_j \triangleq \sum_{i=1}^{N} P_i U_i = \sum_{i=1}^{N} P_j U_i = P_j \sum_{i=1}^{N} U_i = 0 \quad \text{Eq. (6)}$$

Thus, the N-way junction is lossless; no net power, active or reactive, flows into or away from the junction.

Quantization Effects

While the ideal waveguide junction is lossless, finite digital wordlength effects can make exactly lossless networks unrealizable. In fixed-point arithmetic, the product of two numbers requires more bits (in general) for exact representation than either of the multiplicands. If there is a feedback loop around a product, the number of bits needed to represent exactly a circulating signal grows without bound. Therefore, some round-off rule must be included in a finite-precision implementation. The guaranteed absence of limit cycles and overflow oscillations is tantamount to ensuring that all finite-wordlength effects result in power absorption at each junction, and never power creation. If magnitude truncation is used on all outgoing waves, then limit cycles and overflow oscillations are suppressed. Magnitude truncation results in greater losses than necessary to suppress quantization effects. More refined schemes are possible. In particular, by saving and accumulating the low-order half of each multiply at a junction, energy can be exactly preserved in spite of finite precision computations.

Signal Power in Time-Varying Waveguides

The convention is adopted that the time variation of the characteristic impedance does not alter the traveling pressure waves $P_i\pm$. In this case, the power represented by a traveling pressure wave is modulated by the changing characteristic impedance as it propagates. The actual power becomes inversely proportional to characteristic impedance:

$$P_i(x,t) = P_i^+(x,t) + P_i^-(x,t) = \frac{[P_i^+(x,t)]^2 - [P_i^-(x,t)]^2}{Z_i(t)} \quad \text{Eq. (7)}$$

This power modulation causes no difficulties in the Lyapunov theory which proves absence of limit cycles and overflow oscillations because it occurs identically in both the finite-precision and infinite-precision filters. However, in some applications it may be desirable to compensate for the power modulation so that changes in the characteristic impedances of the waveguides do not affect the power of the signals propagating within.

Consider an arbitrary point in the $i^{th}$ waveguide at time t and distance $x=c\tau$ measured from the left boundary, as shown in FIG. 9. The right-going pressure is $P_i^+(x,t)$ and the left-going pressure is $P_i^-(x,t)$. In the absence of scaling, the waveguide section behaves (according to our definition of the propagation medium properties) as a pressure delay line, and we have $P_i^+(x,t)=P_i^+(0,t-\tau)$ and $P_i^-(x,t)=P_i^-(0,t+\tau)=P_i^-(cT,t-T+\tau)$. The left-going and right-going going components of the signal power are $[P_i^-(x,t)]^2/Z_i(t)$ and $[P_i^+(x,t)]^2/Z_i(t)$, respectively.

Below, three methods are discussed for making signal power invariant with respect to time-varying branch impedances.

Normalized Waveguides

Suppose the traveling waves are scaled as the characteristic impedance changes in order to hold signal power fixed. Any level can be chosen as a reference, but perhaps it is most natural to fix the power of each wave to that which it had upon entry to the section. In this case, it is quickly verified that the proper scaling is:

$$P_i^+(x,t)=[(Z_i(t))/(Z_i(t-\tau))]^{\frac{1}{2}}P_i^+(0,t-\tau),\ x=c\tau \quad \text{Eqs.(8)}$$

$$P_i^-(x,t)=[(Z_i(t))/(Z_i(t-T+\tau))]^{\frac{1}{2}}P_i^-(cT,t-T+\tau)$$

In practice, there is no need to perform the scaling until the signal actually reaches a junction. Thus, we implement $$P_i^+(cT,t)=g_i(t)P_i^+(0,t-T) \quad \text{Eqs.(9)}$$

$$P_i^-(0,t)=g_i(t)P_i^-(cT,t-T)$$

where $$g_i(t)=[(Z_i(t))/(Z_i(t-T))]^{\frac{1}{2}}$$

This normalization is depicted in FIG. 10. In FIG. 10, each of the multipliers 8 multiplies the signal by $g_i(t)$ as given by Eqs.(9). In the single-argument notation used earlier, Eqs.(9) become $$P_i^+(t-T)=g_i(t)P_i^+(t-T) \quad \text{Eqs.(10)}$$

$$P_i^-(t)=g_i(t)P_i^-(t)$$

This normalization strategy has the property that the time-varying waveguides (as well as the junctions) conserve signal power. If the scattering junctions are implemented with one-multiply structures, then the number of multiplies per section rises to three when power is normalized. There are three additions as in the unnormalized case. In some situations (such as in the two-stage structure) it may be acceptable to normalize at fewer points; the normalizing multiplies can be pushed through the scattering junctions and combined with other normalizing multiplies, much in the same way delays were pushed through the junctions to obtain standard ladder/lattice forms. In physical modeling applications, normalizations can be limited to opposite ends of a long cascade of sections with no interior output "taps."

To ensure passivity of a normalized-waveguide with finite-precision calculations, it suffices to perform magnitude truncation after multiplication by $g_i(t)$. Alternatively, extended precision can be used within the scattering junction.

Normalized Waves

Another approach to normalization is to propagate rms-normalized waves in the waveguide. In this case, each delay-line contains $$P_i^+(x,t)=P_i^+(x,t)/[Z_i(t)]^{\frac{1}{2}} \quad \text{Eqs.(11)}$$

$$P_i^-(x,t)=P_i^-(x,t)/[Z_i(t)]^{\frac{1}{2}}$$

We now consider P± (instead of P±) to be invariant with respect to the characteristic impedance. In this case, $$P_i^+(c,t)=P_i^+(cT,t)/[Z_i(t)]^{\frac{1}{2}}=P_i^+(0,t-T)/[Z_i(t-T)]^{\frac{1}{2}}=P_i^+(t-T)$$

The scattering equations become $$[Z_i(t)]^{\frac{1}{2}}\ P_i^+(0,t) = [1 + k_i(t)]\ [Z_{i-1}(t)]^{\frac{1}{2}}\ P_{i-1}^+(cT,t) - k_i(t)\ [Z_i(t)]^{\frac{1}{2}}\ P_i(0,t) \quad \text{Eqs. (12)}$$

$$[Z_{i-1}(t)]^{\frac{1}{2}}P_{i-1}^-(cT,t)= k_i(t)\ [Z_{i-1}(t)]^{\frac{1}{2}}P_{i-1}^+(ct,T)+ [1-k_i(t)][Z_i(t)]^{\frac{1}{2}}P_i^-(t)$$

or, solving for $P_i\pm$, $$P_i^+(0,t) = [1 + k_i(t)]\ [(Z_{i-1}(t))/(Z_i(t))]^{\frac{1}{2}}\ P_{i-1}^+(cT,t) - k_i(t)\ P_i^-(0,t) \quad \text{Eqs. (13)}$$

$$P_{i-1}^-(cT,t)= k_i(t)P_{i-1}^+(ct,T)+[1-k_i(t)][(Z_i(t))/(Z_{i-1}(t))]^{\frac{1}{2}}P_i^-(t)$$

But, $$(Z_{i-1}(t))/(Z_i(t))=(1-k_i(t))/(1+k_1(t)) \quad \text{Eq.(14)}$$

whence $$[1+k_i(t)][(Z_{i-1}(t)/(Z_i(t))]^{\frac{1}{2}}= [1-k_i(t)][(Z_i(t))/Z_{i-1}(t))]^{\frac{1}{2}}=[1-k_i^2(t)]^{\frac{1}{2}} \quad \text{Eq.(15)}$$

The final scattering equations for normalized waves are $$P_i^+(0,t)=c_i(t)P_{i-1}^+(cT,t)-s_i(t)\ P_i^-(0,t) \quad \text{Eqs.(16)}$$

$$P_{i-1}^-(cT,t)=s_i(t)P_{i-1}^+(ct,T)+c_i(t)\ P_i^-(t)$$

where $$S_i(t)\quad k_i(t) \quad \text{Eqs.(17)}$$

$$c_i(t)\quad [1-k_i^2(t)]^{\frac{1}{2}}$$

can be viewed as the sine and cosine, respectively, of a single angle $\theta_i(t)=\sin^{-1}[k_i(t)]$ which characterizes the junction. FIG. 11 illustrates the Kelly-Lochbaum junction as it applies to normalized waves. In FIG. 11, the multipliers 8-1, 8-2, 8-3, and 8-4 multiply by the factors $[1-k_i^2(t)]^{\frac{1}{2}}$, $-k_i(t)$, $[1-k_i^2(t)]^{\frac{1}{2}}$, and $k_i(t)$, respectively. In FIG. 11, $k_i(t)$ cannot be factored out to obtain a one-multiply structure. The four-multiply structure of FIG. 11 is used in the normalized ladder filter (NLF).

Note that normalizing the outputs of the delay lines saves one multiply relative to the NLF which propagates normalized waves. However, there are other differences to consider. In the case of normalized waves, duals are easier, that is, changing the propagation variable from pressure to velocity or vice versa in the $i^{th}$ section requires no signal normalization, and the forward and reverse reflection coefficients are unchanged. Only sign-reversal is required for the reverse path. Also, in the case of normalized waves, the rms signal level is the same whether or not pressure or velocity is used. While appealing from a "balance of power" standpoint, normalizing all signals by their rms level can be a disadvantage. In the case of normalized delay-line outputs, dynamic range can be minimized by choosing the smaller of pressure and velocity as the variable of propagation.

Transformer-Coupled Waveguides

Still another approach to the normalization of time-varying waveguide filters is perhaps the most convenient of all. So far, the least expensive normalization technique is the normalized-waveguide structure, requiring only three multiplies per section rather than four in the normalized-wave case. . Unfortunately, in the normalized-waveguide case, changing the characteristic impedance of section i results in a changing of the reflection coefficients in both adjacent scattering junctions. Of course, a single junction can be modulated in isolation by changing all downstream characteristic impedances by the same ratio. But this does not help if the filtering network is not a cascade chain or acyclic tree of waveguide sections. A more convenient local variation in characteristic impedance can be obtained using transformer coupling. A transformer joins two waveguide sections of differing characteristic impedance in such a way that signal power is preserved and no scattering occurs. It turns out that filter structures built using the transformer-coupled waveguide are equivalent to those using the normalized-wave junction described in the previous subsection, but one of the four multiplies can be traded for an addition.

From Ohm's Law and the power equation, an impedance discontinuity can be bridged with no power change and no scattering using the following relations:

$$[P_i^+]^2/[Z_i(t)]=[P_{i-1}^+]^2/[Z_{i-1}(t)] \quad \text{Eqs.(18)}$$

$$[P_i^-]^2/[Z_i(t)]=[P_{i-1}^-]^2/[Z_{i-1}(t)]$$

Therefore, the junction equations for a transformer can be chosen as $$P_i^+=g_i(t)P_{i-1}^+ \quad \text{Eqs.(19)}$$

$$P_{i-1}^-=g_i^{-1}(t)P_i^-$$

where, from Eq. (14)

$$g_i(t)\quad [(Z_i(t))/(Z_{i-1}(t))]^{\frac{1}{2}}=[(1+k_i(t))/(1-k_i(t)]^{\frac{1}{2}} \quad \text{Eq.(20)}$$

The choice of a negative square root corresponds to a gyrator. The gyrator is equivalent to a transformer in cascade with a dualizer. A dualizer is a direct implementation of Ohm's law (to within a scale factor) where the forward path is unchanged while the reverse path is negated. On one side of the dualizer there are pressure waves, and on the other side there are velocity waves. Ohm's law is a gyrator in cascade with a transformer whose scale factor equals the characteristic admittance.

The transformer-coupled junction is shown in FIG. 12. In FIG. 12, the multipliers 8-1 and 8-2 multiply by $g_i(t)$ and $1/g_i(t)$ where $g_i(t)$ equals $[Z_i(t)/Z_{i-1}(t)]^{\frac{1}{2}}$. A single junction can be modulated, even in arbitrary network topologies, by inserting a transformer immediately to the left (or right) of the junction. Conceptually, the characteristic impedance is not changed over the delay-line portion of the waveguide section; instead it is changed to the new time-varying value just before (or after) it meets the junction. When velocity is the wave variable, the co-efficients $g_i(t)$ and $g_i^{-1}(t)$ in FIG. 12 are swapped (or inverted).

So, as in the normalized waveguide case, the two extra multipliers 8-1 and 8-2 of FIG. 12 provide two extra multiplies per section relating to the unnormalized (one-multiply) case, thereby achieving time-varying digital filters which do not modulate stored signal energy. Moreover, transformers enable the scattering junctions to be varied independently, without having to propagate time-varying impedance ratios throughout the waveguide network.

In FIG. 13, the one-multiply junction 26'-i includes three adders 7-1, 7-2, and 7-3, where adder 7-3 functions to subtract the second rail signal, $P_i,(t)$, from the first rail signal, $[P_{i-1}+(t-T)][g_i(t))]$. Junction 26'-i also includes the multiplier 8 which multiplies the output from adder 7-3 by $k_i(t)$. FIG. 13 utilizes the junction of FIG. 12 in the form of multipliers 8-1 and 8-2 which multiply the first and second rail signals by $g_i(t)$ and $1/g_i(t)$, respectively, where $g_i(t)$ equals $[(1-k_i(t))/(1+k_i(t))]^{\frac{1}{2}}$.

It is interesting to note that the transformer-coupled waveguide of FIG. 13 and the wave-normalized waveguide (shown in FIG. 11) are equivalent. One simple proof is to start with a transformer and a Kelly-Lochbaum junction, move the transformer scale factors inside the junction, combine terms, and arrive at FIG. 11. The practical importance of this equivalence is that the normalized ladder filter (NLF) can be implemented with only three multiplies and three additions instead of four multiplies and two additions.

The limit cycles and overflow oscillations are easily eliminated in a waveguide structure, which precisely simulates a sampled interconnection of ideal transmissions line sections. Furthermore, the waveguide can be transformed into all well-known ladder and lattice filter structures simply by pushing delays around to the bottom rail in the special case of a cascade, reflectively terminated waveguide network. Therefore, aside from specific round-off error and time skew in the signal and filter coefficients, the samples computed in the waveguide and the samples computed in other ladder/lattice filters are identical (between junctions).

The waveguide structure gives a precise implementation of physical wave phenomena in time-varying media. This property is valuable in its own right for simulation purposes. The present invention permits the delay or advance of time-varying coefficient streams in order to obtain physically correct time-varying waveguide (or acoustic tube) simulations using standard lattice/ladder structures. Also, the necessary time corrections for the traveling waves, needed to output a simulated pressure or velocity, are achieved.

The waveguide structures of the present invention are useful for two distinct applications, namely, tone synthesis (the creation of a musical tone signal) and reverberation (the imparting of reverberation effects to an already existing audio signal). The present invention is directed to use of waveguide structures for tone synthesis. Use of such structures for reverberation is described in detail in U.S. Pat. No. 4,984,276, the disclosure of which is incorporated herein by reference.

Waveguide Networks with Non-Linear Junction—FIG. 14

In FIG. 14, a plurality of waveguides 53 are interconnected by a non-linear junction 52. In the particular embodiment of FIG. 14, the junction 52 has three ports, one for each of the waveguide networks 53-1, 53-2, and 53-3. However, junction 52 can be an N-port junction interconnecting N waveguides or waveguide networks 53. The control variable register 51 provides one or more control variables as inputs to the junction 52. In FIG. 14 when only a single waveguide is utilized, the single waveguide becomes a special case, single-port embodiment of FIG. 14. Single port examples of the FIG. 14 structure are described hereinafter in connection with reed instruments such as clarinets or saxophones. Multi-port embodiments of the FIG. 14 structure are described hereinafter in connection with stringed instruments such as violins. A multi-port variation of the FIG. 14 structure is also described hereinafter in connection with a reverberator. Many other instruments not described in detail can also be simulated in accordance with the present invention. For example, flutes, organs, recorders, basoons, oboes, all brasses, and ion instruments can be simulated by single or multi-port, linear or non-linear junctions in combination with one or more waveguides or waveguide networks.

Waveguide with Non-Linear Terminating Junction—FIG. 15

In FIG. 15, a block diagram representation of a waveguide 53 driven by a non-linear junction 52 is shown. The non-linear junction 52 provides the input on the first rail 54 to the waveguide 53 and receives the waveguide output from the second rail on lines 55. A control variable unit 51 provides a control variable to the non-linear junction 52. The FIG. 15 structure can be used as a musical instrument for simulating a reed instrument in which case the control variable unit 51 simulates mouth pressure, that is the pressure drop across a reed. The non-linear junction 52 simulates the reed and the waveguide 53 simulates the bore of the reed instrument.

Non-Linear Junction—FIG. 16

FIG. 16 depicts further details of a non-linear junction useful in connection with the FIG. 15 instrument for simulating a reed. The control register input on lines 56 is a control variable, such as mouth pressure. The control variable forms one input (negative) to a subtractor 57 which receives another input (negative) directly from the most significant bits of the waveguide second rail on lines 55. The subtractor 56 subtracts the waveguide output on lines 55 and the control variable on lines 56 to provide a 9-bit address on lines 69 to the coefficient store 70 and specifically the address register 58. The address register 58 provides the address on lines 68 to a table 59 and to a multiplier 62. The table 59 is addressed by the address, x, from address register 58 to provide the data, g(x), in a data register 61. The contents, g(x), in the data register 61 are multiplied by the address, x, from address register 58 in multiplier 62 to provide an output, x*g(x), in the multiplier register 63 which is equal to f(x). The output from the multiplier register 63 is added in adder 64 to the control variable to provide the first rail input on lines 54 to the waveguide 53 of FIG. 15.

In FIG. 16, table 59 in one embodiment stores 512 bytes of data and provides an 8-bit output to the data register 61. The multiplier 62 provides a 16-bit output to the register 63 The high order 8 bits in register 63 are added in saturating adder 64 to the 8 bits from the variable register 51' to provide a 16-bit output on lines 54. Similarly, the high order 8-bits from the 16-bit lines 55 are subtracted in subtractor 57.

The contents of the table 59 in FIG. 16 represent compressed data. If the coefficients required are f(x) from the compressed table 70, only a fewer number of values, g(x), are stored in the table 59. The values stored in table 59 are f(x)/x which are equal to g(x). If x is a 16-bit binary number, and each value of x represents one 8-bit byte of data for f(x), table 59 is materially reduced in size to 512 bytes when addressed by the high-order 9 bits of x. The output is then expanded to a full 16 bits by multiplication in the multiplier 62.

Further compression is possible by interpolating values in the table 59. Many table interpolation techniques are well known. For example, linear interpolation could be used. Interpolation can also be used to compress a table of f(x) values directly, thus saving a multiply while increasing the needed table size, for a given level of relative error Other examples include a double look-up, address normalization, root-power factorization, address and value quantization, address mapping to histogram. Other compression techniques can be employed.

The manner in which the data values for a reed instrument are generated is set forth in APPENDIX A.

In FIG. 17, further details of a schematic representation of the waveguide 53 are shown. The waveguide 53 includes a first rail receiving the input on lines 54 and comprising a delay 65. A terminator 67 connects the delay 65 to the second rail delay 66 which in turn provides the second rail output on lines 55.

In an embodiment where the FIG. 16 signal processor of FIGS. 16 and 17 simulates a reed instrument, the terminator 67 is typically a single pole low-pass filter. Various details of a clarinet reed instrument in accordance with the signal processor of FIGS. 16 and 17 appear in APPENDIX B.

To simulate clarinet tone holes, a three-port scattering junction is introduced into the waveguide. Typically, the first three or four adjacent open tone holes participate in the termination of the bore.

In FIG. 17, the terminator 67 includes a multiplier 74, an inverting low-pass filter 72 and a DC blocking circuit 73. The multiplier 74 multiplies the signal on line 75 from the delay 65 by a loss factor $g_1$ where $g_1$ is typically $1-2^{-4}=0.9375$ for a clarinet. The output from the multiplier 74 is designated $y_1(n)$ where n is the sampled time index. The output from the low-pass filter 72 is designated $y_2(n)$, and the output from the DC blocking unit 73 is designated $y_3(n)$.

For a clarinet, the low-pass filter 72 has a transfer function $H_{12}(Z)$ as follows:

$$H_{12}(Z)=-(1-g)/(1-gZ^{-1})$$

Therefore the signal $y_2(n)$ output from the low-pass filter 72 is given as follows:

$$y_2(n)=(g-1)y_1(n)+gy_2(n-1)$$

In the above equations, g is a coefficient which is typically determined as equal to $1-2^{-k}$ where k can be any selected value. For example, if k is 3, g is equal to 0.875 and g equal to 0.9 is a typical value. As another example, $1-2^{-3}+2^{-5}=0.90625$.

In FIG. 17, the transfer function, $H_{23}(Z)$, of the DC blocking circuit 73 is given as follows:

$$H_{23}(Z)=(1-Z^{-1})/(1-rZ^{-1})$$

With such a transfer function, the output signal $y_3(n)$ is given as follows:

$$y_3(n)=y_2(n)-y_2(n-1)+ry_3(n-1)$$

In simulations, the value of r has been set to zero. In actual instruments, DC drift can cause unwanted numerical overflow which can be blocked by using the DC block unit 73. Furthermore, when using the compressed table 70 of FIG. 16, the error terms which are produced are relative and therefore are desirably DC centered. If a DC drift occurs, the drift has the effect of emphasizing unwanted error components. Relative signal error means that the ratio of the signal error to signal amplitude tends to remain constant. Therefore, small signal values tend to have small errors which do not significantly disturb the intended operation.

In FIG. 17, for a clarinet, the delays 65 and 66 are typically selected in the following manner. One half the desired pitch period less the delay of the low-pass filter 72, less the delay of the DC block in unit 73, less the delay encountered in the non-linear junction 52 of FIG. 16.

When a saxophone is the reed instrument to be simulated by the FIG. 16 and FIG. 17 devices, a number of changes are made. The non-linear junction of FIG. 16 remains the same as for a clarinet. However, the waveguide network 53 of FIG. 15 becomes a series of cascaded waveguide sections, for example, of the FIG. 4 type. Each waveguide section represents a portion of the bore of the saxophone. Since the bore of a saxophone has a linearly increasing diameter, each waveguide section simulates a cylindrical section of the saxophone bore, with the waveguide sections representing linearly increasing diameters.

For a saxophone and other instruments, it is useful to have a non-linear bore simulation. Non-linearity results in excess absorption and pressure-dependent phase velocity. In order to achieve such non-linear simulation in accordance with the present invention, one method is to modify the delays in the waveguide structure of FIG. 8. In FIG. 8, each of the delays, $Z^{-2T}$, includes two units of delay. In order to introduce a non-linearity, one of the two units of delay is replaced by an all-pass filter so that the delay D changes from $Z^{-2T}$ to the following:

$$D=[Z^{-T}][(h+Z^{-T})/(1+hZ^{-T})]$$

With such a delay, the output signal, $y_2(n)$ is given in terms of the input signal, y (n) as follows:

$$y_2(n)=h*y_1(n-1)+y_1(n-2)-h*y_2(n-1)$$

In the above equations, in order to introduce the non-linearity, the term h is calculated as a function of the instantaneous pressure in the waveguide, which is the sum of the travelling-wave components in the first rail and the second rail. For example, the first rail signal input to the delay, $y_1^+(n)$ is added to second rail signal $y_1^-(n)$ and then utilized by table look up or otherwise to generate some function for representing h as follows:

$$h=f[y_1^+(n)+y_1^-(n)]$$

The delay of the first-order all-pass as a function of h can be approximated by $(1-h)/(1+h)$ at low frequencies relative to the sampling rate Typically, h is between $1-\epsilon$ and 0 for some small positive $\epsilon$ (the stability margin).

Using the principles described, simulation of a nonlinear waveguide medium (such as air in a clarinet bore) is achieved. For clarinet and other instruments, the bore which is modeled by the waveguides of the present invention, includes tone holes that are blocked and unblocked to change the pitch of the tone being played. In order to create the equivalent of such tone holes in the instruments using waveguides in accordance with the present invention, a three-port junction can be inserted between cascaded waveguide sections. One port connects to one waveguide section, another port connects to another waveguide section, and the third port is unconnected and hence acts as a hole. The signal into the third port is represented as $P_3^+$ and this signal is equal to zero. The radiated signal from the third port, that is the radiated pressure, is denoted by $P_3^-$. The three-port structure for the tone hole simulator is essentially that of FIG. 14 without the waveguide 53-3 and without any control variable 51 input as indicated by junction 52 in FIG. 14. The junction 52 is placed as one of the junctions, such as junction 26-i in FIG. 4. With such a configuration, the junctions pressure, $P_J$, is given as follows:

$$P_J = \sum_{i=1}^{3} \alpha_i P_i^+$$

where, $\alpha_i = 2\Gamma_i/(\Gamma_1+\Gamma_2+\Gamma_3)$, $\Gamma_i$ = characteristic admittance in $i^{th}$ waveguide $P_i^- = P_J - P_i^+$ $P_J = \alpha_1 P_1^+ + \alpha_2 P_2^+ = \alpha_1 P_1^+ + (2-\alpha_1-\alpha_3)P_2^+$ $P_1^- = P_J - P_1^+ = (\alpha_1 - 1)P_1^+ + \alpha_2 P_2^+$ $P_2^- = P_J - P_2^+ = \alpha_1 P_1^+ + (\alpha_2 - 1)P_2^+$ $P_3^- = P_J - P_3^+ = P_J$ (tone hole output)

Let, $$\Gamma_3 = \begin{cases} (\Gamma_1 + \Gamma_2)/2, \text{ open hole} \\ 0, \text{ closed hole} \end{cases}$$

Then, $$\alpha_3 = \begin{cases} 1, \text{ open hole} \\ 0, \text{ closed hole} \end{cases}$$

$$\alpha_2 = \begin{cases} 1 - \alpha_1, \text{ open hole} \\ 2 - \alpha_1, \text{ closed hole} \end{cases}$$

Then, with $P_\Delta^+ = P_1^+ - P_2^+$, we obtain the one multiply tone-hole simulation:

$$P_2^- = \alpha_1 P_\Delta^+,\ P_1^- = P_2^- - P_\Delta^+, \text{ (open hole)}$$

In a smooth bore, $\Gamma_1 = \Gamma_2 = \Gamma$ and $\Gamma_3 = \beta\Gamma$, where $\beta$ is the cross-sectional area of the tone hole divided by the cross-sectional area of the bore. For a clarinet, $\beta = 0.102$ and for a saxophone, $\beta = 0.436$, typically. So we have:

$$\Gamma_3 \overset{\Delta}{=} \beta\Gamma = \begin{cases} \beta\Gamma, \text{ open} \\ 0, \text{ closed} \end{cases}$$

Then, $$\alpha_1 = \alpha_2 2\Gamma/(2\Gamma+\beta\Gamma) = 2/(2+\beta)\Delta\alpha$$

$$\alpha_3 = 2\beta/(2+\beta) = \beta\alpha,$$

There is now a single parameter $$\alpha = \begin{cases} 2/(2+\beta), \text{ open} \\ 1, \text{ closed} \end{cases}$$

So, the tone hole simulation is given by $P_J = \alpha(P_1^+ + P_2^+)$ (if open)

$P_1^- = P_J - P_2^+ = \alpha P_2^+ + (\alpha - 1)\ P_1^+ = P_2^+$ (if closed)

$P_2^- = P_J - P_1^+ = \alpha P_1^+ + (\alpha - 1)\ P_2^+ = P_1^+$ (if closed)

Summary:

$$\alpha = \begin{cases} 0.95, \text{ clarinet} \\ 0.821, \text{ saxophone} \end{cases}$$

$\Gamma_3 = \beta\Gamma$ $P_J = \alpha(P_1^+ + P_2^+)$ $P_1^- = P_J - P_1^+$ $P_2^- = P_J - P_2^+$ $$\alpha = \begin{cases} 2/(2+\beta), \text{ open} \\ 1, \text{ closed} \end{cases}$$

a = bore radius b = hole radius $$\beta = b^2/a^2 = \begin{cases} 0.102, \text{ clarinet} \\ 0.436, \text{ saxophone} \end{cases}$$

$\alpha = (2a^2)/(2a^2+b^2)$ – hole open $\alpha = 1$ – hole closed $P_J$ is radiated away spherically from the open hole with a (1/R) amplitude attenuation.

Reed Simulation

In FIG. 20, a graph is shown representing the data that is typically stored in the table 59 of FIG. 16 for a reed instrument. The output signal $R^-(n)$ on line 54 is as follows:

$$R^-(n) = k^* P_\Delta^+/2 + P_m(n)/2$$

The control variable input on line 56 is $P_m(n)/2$ and the input on line 68 to the table 59 is $$(P_\Delta^+)/2 = (R^+(n) - P_m(n)/2)$$

where $R^+(n)$ is the signal sample on line 55 of FIG. 16.

The table 59 is loaded with values which, when graphed, appear as in FIG. 23. The curve 92 in FIG. 23 has a maximum value of one and then trails off to a minimum value of zero. The maximum value of one occurs between $(P_{\Delta,min}^+)/2$ and $(P_{\Delta,c}^+)/2$. The value $(P_{\Delta,c}^+)/2$ corresponds to the closure of the reed. From $(P_{\Delta,c}^+)/2$ to $(P_{\Delta,max}^+)/2$ the curve 92 decays gradually to zero. The equation for the curve 92 is given as follows, $$\text{Curve}=[(P_{\Delta,max}{}^{+}-P_{\Delta}{}^{+})/(P_{\Delta,max}{}^{+}-P_{\Delta,c}{}^{+})]^{l}$$

where l=1, 2, 3, . . .

The output from the table 59 is the variable k as given in FIG. 20, that is, $$k=k[(P_{\Delta}{}^{+})/2]$$

Bowed-String Simulation

In FIG. 21, a graph is shown representing the data that is typically stored in the coefficient table 59 of the signal table 70 (see FIG. 16) of FIG. 18. The output signals $V_{s,l}-$on line 54 and $V_{s,r}-$ on line 49 are as follows:

$$V_{s,l}{}^{-}=k(V_{\Delta}{}^{+})*V_{\Delta}{}^{+}+V_{s,r}{}^{+}$$

$$V_{s,r}{}^{-}=k(V_{\Delta}{}^{+})*V_{\Delta}{}^{+}+V_{s,l}{}^{+}$$

The control variable input on line 56 is bow velocity, $V_b$, and the input on line 68 to the table 59 is $$V_{\Delta}{}^{+}=V_b-(V_{s,l}{}^{+}+V_{s,r}{}^{+})$$

where $V_{s,l}{}^{+}$is the signal sample on line 55 and $V_{s,r}{}^{+}$ is signal sample on line 50 of FIG. 18.

The table 59 is loaded with values which, when graphed, appear as in FIG. 24. The curve 93 in FIG. 24 has a maximum value of one and then trails off to a minimum value of zero to the left and right symmetrically. The maximum value of one occurs between $-V_{\Delta,c}{}^{+}$and $+V_{\Delta,c}{}^{+}$. From $(V_{\Delta,c}{}^{+})$ to $(V_{\Delta}{}^{+},_{max})$ the curve 93 decays gradually to zero. The equation for the curve 93 is given as follows, $$\text{Curve}=[(V_{\Delta,max}{}^{+}-V_{\Delta}{}^{+})/(V_{\Delta,max}{}^{+}-V_{\Delta,c}{}^{+})]^{l}$$

where l=1, 2, 3, . . .

The output from the table 59 is the reflection coefficient k as given in FIG. 24, that is, $$k=k[(V_{\Delta}{}^{+})]$$

Compressed Table Variations

The compressed table 59 of FIG. 16 containing g(x)=f(x)/x is preferable in that quantization errors are relative. However, alternatives are possible. The entire table compressor 70 of FIG. 16 can be replaced with a simple table. In such an embodiment, the round off error is linear and not relative. For linear errors, the error-to-signal ratio tends not to be constant. Therefore, for small signal amplitudes, the error tends to be significant so that the error may interfere with the intended operation. In either the table compressor embodiment 70 of FIG. 16 or a simple table previously described, the tables can employ compression techniques such as linear, Lagrange and quadratic interpolation with satisfactory results. In a linear interpolation example, the curve 92 of FIG. 20 would be replaced by a series of straight line segments thereby reducing the amount of data required to be maintained in the table.

Also table 59, address register 58 and data register 61 of FIG. 16 each have inputs 94, 95 and 96 from processor 85 (FIG. 19).

The inputs from processor 85 function to control the data or the access of data from the table 59. Modifications to the data in the table can be employed, for example, for embouchure control for reed synthesis. Similarly, articulation control for bowed-string synthesis is possible. In one example, the address register 58 has high order address bits, bits 10 and 11, which are supplied by lines 95 from the processor. In this manner, the high order bits can be used to switch effectively to different subtables within the table 59. This switching among subtables is one form of table modification which can be used to achieve the embouchure and articulation modifications.

Non-Linear Junction with Plural Waveguides—FIG. 18

In FIG. 18, further details of another embodiment of a non-linear junction is shown connected between a first waveguide 76 and a second waveguide 77. The non-linear junction 78 receives an input from the control variable register 51' and provides inputs to the waveguide 76 on lines 54 and receives an output on lines 55. Also the non-linear junction 78 provides an output to the waveguide 77 on lines 49 and receives an input on lines 50.

In FIG. 18, the non-linear junction 78 includes an adder 57 receiving as one input the control variable from the control variable register 51' on lines 56. The other input to the subtractor 57 is from the difference register 79 which in turn receives an output from an adder 80. The adder 80 adds the inputs on lines 55 from the waveguide 76 and lines 50 from the waveguide 77.

The output from the subtractor 57 on lines 68 is input to the table compressor 70. The table compressor 70 of FIG. 12 is like the table compressor 70 of FIG. 10 and provides an output on lines 69. The output on lines 69 connects as one input to each of the adders 81 and 82. The adder 81 receives as the other input the input from lines 50 from the waveguide 77 to form the input on lines 54 to the first waveguide 76. The second adder 82 receives the table compressor signal on lines 69 and adds it to the input from the first waveguide 76 on lines 55. The output from adder 82 connects on lines 49 as the input to the second waveguide 77.

In FIG. 18, the waveguide 76 includes the top rail delay 65-1 and the bottom rail delay 66-1 and a terminator 67-1.

Similarly, the second waveguide 77 includes a top rail delay 65-2 and a bottom rail delay 66-2 and a terminator 67-2.

In the case of a violin in which the long string portion is approximately one foot and the short string portion is one-fifth of a foot, the waveguides of FIG. 18 are as follows. The terminator 67-1 is merely an inverter which changes the sign of the first rail value from delay 65-1 going into the delay 66-1. For example, the changing the sign is a 2's complement operation in digital arithmetic. Each of the delays 65-1 and 66-1 is the equivalent of about fifty samples in length for samples at a 50 KHz frequency. The terminator 67-2 in the waveguide 77 is typically ten samples of delay at the 50 KHz sampling rate. The terminator 67-2 can be a single pole low-pass filter. Alternatively, the terminator can be a filter having the empirically measured bridge reflectance cascaded with all source of attenuation and dispersions for one round trip on the string. Various details of a violin appear in APPENDIX C.

Musical Instrument—FIG. 19

In FIG. 19, a typical musical instrument, that is signal processor, employing the waveguide units of the present invention is shown. In FIG. 19, a processor 85, such as a special purpose or general purpose computer, generates a digital signal representing the sound to be produced or a control variable for a synthesizer. Typically, the processor 85 provides an address for a random access memory such as memory 86. Memory 86 is addressed and periodically provides a digital output representing the sound or control variable to be generated. The digital sample from the memory 86, typically at a sampling rate $T_s$ (usually near 50 KHz), is connected to the waveguide unit 87. Waveguide unit 87 processes the digital signal in accordance with the present invention and provides an output to the digital-to-analog (D/A) converter 88. The converter 88 in turn provides an analog output signal through a filter 89 which connects to a speaker 90 and produces the desired sound.

When the signal processor of FIG. 19 is a reed instrument, the structure of FIGS. 15, 16 and 17 is typically employed for waveguide unit 87. In FIG. 15, the control variable 51 is derived from the processor 85 and the memory 86 of FIG. 19. The structure of FIGS. 15, 16 and 17 for a clarinet uses the FIG. 17 structure for waveguide 53 with a simple inverter (−1) for terminator 67. For a saxophone, the waveguide 53 is more complex, like FIG. 4.

When the signal processor of FIG. 19 is a bowed-string instrument, the waveguide unit 87 in FIG. 19 typically employs the structure of FIG. 18. The control variable input to register 51' of FIG. 18 comes from the memory 86 of FIG. 19. The output from the waveguide unit of FIG. 18 is derived from a number of different points, for example, from the terminals 54 and 55 for the waveguide 76 or from the terminals 49 and 50 from the waveguide 77 of FIG. 18. In one typical output operation, an adder 71 adds the signals appearing at terminals 49 and 50 to provide an input at terminal 20 to the D/A converter 88 of FIG. 19. The sum of the signals in adder 71 corresponds to the string velocity at the location of the bow on the instrument.

When reed and other instruments are employed, it has been found useful to introduce white noise summed with the control variable input to register 51' of FIG. 16. Additionally, the introduction of tremolo and other musical effects into the control variable enhances the quality of the sound produced.

TABLE 1

$N_1T_s = 5$ ms.
$N_2T_s = 17$ ms.
$N_3T_s = 23$ ms.
$N_4T_s = 47$ ms.
$N_5T_s = 113$ ms.
$T_s = 20$ microseconds
$\epsilon = 0.9$ where $|\epsilon| \leq 1$ $\sum_{i=1}^{5} = 2$ (lossless condition)
where $0 \leq \alpha_i \leq 2$ For time-varying reverberation:

$\alpha_1 = 1$
$\alpha_2 = \beta_1/2$
$\alpha_3 = (1 - \beta_1)/2$
$0 = \beta_1 \leq 1$
$\alpha_4 = \beta_2/2$
$0 \leq \beta_2 \leq 1$
$\alpha_5 = (1 - \beta_2)/2$

APPENDIX A

COPYRIGHT 1986 - THE BOARD OF TRUSTEES OF THE LELAND STANFORD JUNIOR UNIVERSITY

```
COMMENT Plot reed flow versus differential pressure:
COMMENT Version 0 - V3 with mouth-pressure-independent table:
BEGIN "Reed"

COMMENT                          Clarinet structure

                                                  0---------------------0
P (n) -->o------------------>(+)----> P (n) --->| Waveguide, Length N |--->o--> Out
 b                            ↑        b         0---------------------0
-----                         |                                  | |        |
  Z                           |                                  | |        |
                              |                                  ↓ ↓        |
                   0------0   |                                  ↓ ↓        0----+-------0
                   | RC   |RC(n)|                Output signal <---(+)<------|(-) Lowpass |
                   |Table <--->(*)                (two tone-holes)  ↑ ↑  1-LP 0----+-------0
                   |      |    ↑ *                (this example)    | |   out      | LP out
                   0--↑---0    | P (n)/2                           | |            |
                      o<---------o  *                              | |            ↓
                              |                  0---------------------0
                              ↓                  |                    ↓
                   o------------------>(+)<---- P (n) <---| Waveguide, Length N |<---o
                                        ↑         b        0---------------------0

O Pm - Mouth pressure (constant)
O Lowpass Gain is close to (-1) at all frequencies, with
    increasing attenuation at high frequencies.
O Bell output is complementary highpass. (If H(z) is the lowpass
    transfer function, bell output is 1-H(z).
    (Bell is a frequency-dependent bass splitter.)
O When tone hole(s) opened, delay line gets a reflection
    at each open tone hole. Consequently, much less energy gets to bell.
    In high registers, both holes and bell get a good-sized signal level.
O Reflection coefficient RC is 1 from 2aPop-Pm between -1 and -.1 or so,
    then falls to .5 around 0, and decreases thereafter pretty slowly.

:

  REQUIRE "||<>" DELIMITERS;
  DEFINE #="COMMENT";
  REQUIRE "JOSLIB.REQTLIB.JOS]" SOURCE'FILE;
  REQUIRE "RECORD.REQTLIB.JOS]" SOURCE'FILE;
  REQUIRE "MYIO.REQTLIB.JOS]" SOURCE'FILE;
  REQUIRE "DISPLA.REQTLIB.JOS]" SOURCE'FILE;
```

```
  INTEGER PROCEDURE Sign(REAL Val); RETURN(IF Val=0 THEN 0 ELSE IF Val>0 THEN 1 ELSE -1);

BOOLEAN PROCEDURE FindZero(REFERENCE REAL Z; REAL PROCEDURE F;
        REAL Xmin,Xmax,X0,dX);
COMMENT Find first zero of F(X) starting at X0, stepping dX;
BEGIN "FindZero"
  INTEGER cs,os;
  REAL X;
  X←X0;
  cs←os←Sign(F(X));
  CASE (cs+1) OF BEGIN
    (1) BEGIN Z←X; RETURN(TRUE) END;
    (0) WHILE (X←X+dX) LEQ Xmax AND cs←-1 DO cs←Sign(F(X));
    (2) WHILE (X←X-dX) GEQ Xmin AND cs←1 DO cs←Sign(F(X));
    ELSE PRINT(" FindZero: Procedure Sign is broken")
  END;
  Z ← X;
  IF NOT (Xmin LEQ X LEQ Xmax) THEN
  BEGIN
    Z ← (XMin MAX X MIN XMax);
    RETURN(FALSE);
  END;
  RETURN(TRUE);
END "FindZero";

# Configuration constants and declarations;

  DEFINE NPd="1024";        # Number of mouth-to-bore differential pressures;
  DEFINE NPdp="1024";       # Number of incoming pressure wave values to try;
  DEFINE NEmb="2";          # Number of embouchures to try;

  DEFINE RealBot = "1e-38";
  INTEGER Trace;
  DEFINE Debug(x) = ( (Trace LAND 2↑x) );
  DEFINE DpyEd1 = ( IF Debug(1) THEN DpyEd );
  DEFINE DpyEd2 = ( IF Debug(2) THEN DpyEd );

  REAL ARRAY Garr,Xarr,ACarr[1:NPd*NEmb];
  REAL ARRAY RCarr,PdArr[1:NEmb*NPdp];
  STRING Pstr,Xstr;
  INTEGER iPd,j,iEmb,i;
  REAL P,Pdc,Pd,dPd,Uflow,Amp,Alpha,Pdmin,Pdmax,Emb,x0,x0m,Emin,Emax,dE,EFmax;
  REAL C,Zb,Rho,A0,Pi,Rb,Sr,Pdr,Beta,APdc,PdpMin,PdpMax,StepReduce;
  BOOLEAN TestMode;

  IF Trace=0 THEN Trace←7;
  IF StepReduce=0 THEN StepReduce←.01;
  SETFORMAT(0,2);
  IF Pi LEQ 0 THEN
  BEGIN "SetUp"
    Pi ← 4*ATAN(1);
    C ← 1050*12*2.54;     # Air speed in cm/sec. Dry, 20 degrees C, 1 atm;
    Rho ← 0.00129;        # Air density in g/cm↑3, same conditions;
    Rb ← 0.746;           # Radius of clarinet bore in cm;
    Uflow ← 37;           # Reed flow amplitude (cm↑3/sec) for Pd==1;
    Sr ← 1.4e-6;          # Reed stiffness in dyne/cm↑3 (dyne=gm cm/sec↑2);
  # x0 ← 0.05;            # Reed opening (cm) at rest (Backus);
    x0 ← 0.15;            # Reed opening (cm) at rest (my measurement);
    Pdr ← 1e-8;           # Fraction of pressure drop felt by reed (!);
                          #   Physically, the value here is bizarre;
                          #   It has been set to give the desired behavior;
    EFmax ← .02*Sr;       # Pressure applied to reed at maximum embouchure;
  END "SetUp";

  A0 ← Pi*Rb↑2;           # Cross-sectional area of clarinet bore in cm↑2;
  Zb ← Rho*C/A0;          # Characteristic impedance of clarinet bore;
  Alpha ← Pdr/Sr;         # Alpha*Pd = Change in reed position (cm) vs. pr. drop;
  Beta ← EFmax/Sr;        # Beta*Pd = Change in reed position at max emb. (=1);
  Pdc←-x0/Alpha;          # Reed closure pressure (dyne/cm↑2);
  APdc ← ABS(Pdc);        # We guesstimate pressure in units of reed-closure pressure;
# Amp ← Zb*Uflow;         # Convert reed-aperture flow into traveling bore pressure;

  IF Amp LEQ 0 THEN Amp ← 1;
  AinReal(Amp,"Scale f:- ReedAdmittance/BoreAdmittance (- for resistor test)");
  IF Amp<0 THEN
  BEGIN
    PRINT("Replacing reed by fixed aperture of specific admittance=",Amp←-Amp,CrLf);
    TestMode←TRUE;
    IF Amp>1 THEN PRINT("You have set reed admittance greater than bore's!!",CrLf);
    PRINT(" Solution is ",CrLf,CrLf," Pbm = ",(1-Amp)/(1+Amp)," * Pbp  +  ",
        Amp/(1+Amp)," * Pm",CrLf,CrLf);
    PRINT(" Reflection coefficient is RC = ",(1-Amp)/(1+Amp),CrLf);
  END ELSE TestMode←FALSE;

  Pdmin ← -Sr*x0/Alpha;   # Reed closure pressure is -x0/Alpha;
  Pdmax ← -Pdmin;         # Max differential pressure (Shouldn't go positive often?);
  PdpMin ← 2*Pdc;         # Minimum incoming pressure wave is twice reed closure;
  PdpMax ← -PdpMin;       # Maximum incoming pressure can be a reflection of min;
```

```
Esin←0;  Esax←1;        # Embouchure (0:1). 0 => light embouchure. 1 => tight;
dE ← (Esax-Esin)/(NEmb-1);
FOR iEmb←1 STEP 1 UNTIL NEmb DO
BEGIN "Eloop"
  Emb ← Esin+(iEmb-1)×dE;      # Current embouchure;
  dPd←(Pdmax-Pdmin)/(NPd-1);
  FOR iPd←1 STEP 1 UNTIL NPd DO
  BEGIN "Iloop"
    REAL G,x;
    i←iPd+(iEmb-1)×NPd;
    Pd ← Pdmin + (iPd-1)×dPd; # Pressure drop across reed, bore to mouth;
    x ← x0 + Alpha×Pd;          # Reed position due to pressure drop;
    x ← x - Beta×Emb;           # Embouchure is an added force on reed "spring";
    x ← x MAX 0;                # 0 is reed closure, x0 is reed pos. at rest;
    Xarr[i] ← x;
    IF TestMode THEN G ← Amps×ABS(Pd)  # Plain resistor;
      ELSE G ← Amps(ABS(Pd)×x↑2)↑.67; # Zb=ReedFlowGivenPressureDrop=Pd;
    Garr[i] ← (IF Pd>0 THEN G ELSE -G);
  END "Iloop";
END "Eloop";

Pstr ← "  Alpha="&Cvfs(Alpha)&
       ", Pdc="&Cvfs(Pdc)&", P="&Cvfs(P)&", X0="&Cvfs(X0)&
       ", Pd (dyne/cm↑2)";

IF NOT TestMode THEN DpyEdl(Xarr,NPd,Pstr,"X position (cm)",Pdmin,Pdmax);

DpyEdl(Garr,NPd,Pstr,"Pressure G (dyne/cm↑2)",Pdmin,Pdmax,Pdflin,Pdflax);

COMMENT Plot AC reflection gain vs. PM;

FOR iEmb←1 STEP 1 UNTIL NEmb DO
BEGIN
  FOR iPd←2 STEP 1 UNTIL NPd DO
  BEGIN
    REAL Gp; # Estimate of derivative of G;
    REAL ACgain; # AC gain is (1-Gp)/(1+Gp);
    INTEGER i;
    Pd ← Pdmin + (iPd-1)×dPd; # Current "operating point";
    i←iPd+(iEmb-1)×NPd;
    Gp ← (Garr[i]-Garr[i-1])/dPd;
    ACgain ← (1-Gp)/(1+Gp); # AC reflection coefficient at current op pt;
    ACarr[i] ← ACgain;
  END;
  ACarr[1+(iEmb-1)×NPd] ← ACarr[2+(iEmb-1)×NPd]; # Extrapolate 1 sample left;
END;

DpyEdl(ACarr,NPd,"ACgain(Pd)"&Pstr,"Ptbe/Ptbp",Pdmin,Pdmax);

BEGIN "DpyAC"
  INTEGER Id,iEmb;
  STRING Ts;
  REAL Ymin,Ymax;
  REAL ARRAY Buf[1:NPd];
#  Ymin ← MinArr(NPd×NEmb,ACarr);
  Ymin ← 0;
  Ymax ← 1.1×MaxArr(NPd×NEmb,ACarr);
  IF Ymin GEQ Ymax THEN
  BEGIN PRINT(" AC gain PLOT IS CONSTANT = ",Ymin,CrLf); CALL(0,"EXIT") END;
  DPYOVL(ACarr,NPd,Id←0," AC Pbe/Pbp vs. Pd","AC RC",Ymin,Ymax,Pdflin,Pdflax,FALSE,TRUE,NEmb×NPd←1888);
  FOR iEmb←2 STEP 1 UNTIL NEmb DO
  BEGIN "DpyLoop"
    ARRBLT(Buf[1],ACarr[(iEmb-1)×NPd+1],NPd);
    DPYOVL(Buf,NPd,Id,NULL,"  ",Ymin,Ymax,Pdflin,Pdflax,TRUE,FALSE);
    [illegible]";

  WHILE TRUE DO
  BEGIN
    IF (Ts←INCHWL)="u" OR Ts="U" THEN DpyWrt(Id,"ACRC.PLT")
    ELSE IF Ts="R" OR Ts="r" THEN BEGIN QUICK!CODE PGIOT 2, END; MWrite(Id,0) END
    ELSE DONE
  END;
  Drels(Id);
END "DpyAC";

COMMENT Toward the solution of G(Pd) + Pd - Pdp = 0,
        Replace G(Pd) by G(Pd) + Pd
        (which is approximately Pd
        since G=(Zb/Za)×Pd and Zb<<Za)

;
  FOR iEmb←1 STEP 1 UNTIL NEmb DO
    FOR iPd←1 STEP 1 UNTIL NPd DO
      Garr[i←iPd+(iEmb-1)×NPd] ← Garr[i] + (Pd - Pdmin - (iPd-1)×dPd);

  DpyEdl(Garr,NPd,Pstr,"G+Pd",Pdmin,Pdmax);

COMMENT Now solve for aperture reflection coefficient;

  FOR iEmb←1 STEP 1 UNTIL NEmb DO
  BEGIN "Solv"
```

```
REAL PROCEDURE GPdpPd(REAL Pd; INTEGER iEsb);
# Return G(Pd)+Pd using Garr[1:NPd] for a coarse result,
  and use linear interpolation between samples:
# Return Garr[1+(Npd-1)*((Pd-PdMin)/(PdMax-PdMin))+(iEsb-1)*Npd];
BEGIN "GPdpPd"
  INTEGER i1,i2,iof;
  OWN BOOLEAN Inited;
  OWN REAL a,b;
  REAL g,rndx,ri1;
  IF NOT Inited THEN
  BEGIN "Init"
    Inited←TRUE;
    a ← (Npd-1)/(PdMax-PdMin);
    b ← 1-(Npd-1)*PdMin/(PdMax-PdMin);
  END "Init";
  rndx ← a*Pd+b; # Desired lookup index;
# Do linearly interpolated lookup;
  i1 ← rndx;
  IF Trace AND NOT (1 LEQ i1 LEQ Npd)
    THEN PRINT(" 2*Pdp-PM exceeds PdMin or PdMax",CrLf,
              " For Pd=",Pd,", indx = ",i1,CrLf);
  ri1 ← i1;
  g ← rndx - ri1;
  i1 ← (1 MAX i1 MIN Npd);
  i2 ← (i1 + 1) MIN Npd;
  iof ← (iEsb-1)*Npd;
  i1 ← i1 + iof;
  i2 ← i2 + iof;
  RETURN(Garr[i1]+g*(Garr[i2]-Garr[i1]));
END "GPdpPd";

# We now find the solution Pd of the equation G(Pd) + Pd - Pdp = 0,
  for the complete range of Pdp values to be supported in operation,
  using a general local zero finder. For astable operation of the reed,
  the wave-impedance line should intersect the negative-resistance
  portion of the reed impedance curve in only one place. This means
  G(Pd)+Pd should be strictly increasing which implies the existence
  of only one zero.

INTEGER iPdp,i;
REAL PROCEDURE GPdpPdmPdp(REFERENCE REAL Pd); RETURN(GPdpPd(Pd,iEsb)-Pdp);

Esb ← Esmin+(iEsb-1)*dE;      # Current embouchure;
PRINT(" Solving fixed-point problem for embouchure ",Esb,CrLf);
dPdp←(Pdpmax-Pdpmin)/(NPdp-1);

Xstr ← " Esb=",&Cvfs(Esb)&", Pdc=",&Cvfs(Pdc)&"; Pd (dyne/cm^2)";

Pd←(PdMin MAX 0 MIN PdMax); # First search set to midpoint in sym. case;
Pdp ← PdpMin-dPdp;
FOR iPdp←1 STEP 1 UNTIL NPdp DO
BEGIN "PdpLoop"
  Pdp ← Pdp + dPdp;
  # Search from previous solution for new solution;
  IF NOT FindZero(Pd,GPdpPdmPdp,PdMin,PdMax,Pd,dPd)
    THEN PRINT(" No zero",CrLf);
  # Repeat at reduced step size (assumes interpolation in GPdpPd);
  IF NOT FindZero(Pd,GPdpPdmPdp,PdMin,PdMax,Pd,dPd*StepReduce)
    THEN PRINT(" No zero",CrLf);
  i ← iPdp+(iEsb-1)*NPdp;
  PdArr[i] ← Pd;
  rc ← (IF ABS(Pdp) GEQ dPd*StepReduce THEN 2*(Pd/Pdp)-1 ELSE rc);
  RCarr[i] ← rc;

  IF Debug(3) AND ABS(Pdp) LEQ (PdpMax-PdpMin)/20 THEN
  BEGIN "seeG"
     REAL ARRAY TapArr[1:NPd*NEsb];
     INTEGER jEsb,jPd,i;
     FOR jEsb←1 STEP 1 UNTIL NEsb DO
     BEGIN
       INTEGER ndx,iof;
       FOR jPd←1 STEP 1 UNTIL NPd DO
         TapArr[i←(jPd+(jEsb-1)*NPd)] ← Garr[i] - Pdp;
       ndx←1+(Npd-1)*((Pd-PdMin)/(PdMax-PdMin));
       IF NOT (1 LEQ ndx LEQ Npd) THEN BEGIN PRINT(" REALITY FAILURE ");
          ndx ← (1 MAX ndx MIN Npd) END;
       iof←(jEsb-1)*Npd;
       TapArr[ndx+iof]←TapArr[1+iof]; # Mark found zero-crossing;
     END;
     OpyEd(TapArr,NPd,"G(Pd)+Pd-Pdp vs. Pd for Pdp=",&Cvfs(Pdp)&",",&Xstr,
          "G+Pd-Pdp",PdMin,PdMax);
  END "seeG";
 END "PdpLoop";
END "Solv";

OpyEd2(PdArr,NPdp,"Pd(Pdp):",&Xstr,"Pd",PdpMin,PdpMax,PdpMin,PdpMax);
OpyEd2(RCarr,NPdp,"Reflection coeff vs. Pdp for",&Xstr,"RC",PdpMin,PdpMax);
```

```
COMMENT PRACTICAL NOTE
        RCarr is written out (using the write-file option of DpyEd) to
        a disk file which is subsequently read by JCLA (after suitable
        format conversion) and used for the clarinet simulation reed table.
;
  BEGIN "DpyAll"
    INTEGER Id,i;
    STRING Ts,Xstr;
    REAL Ymin,Ymax;
    REAL ARRAY Buf[1:NPdp];

    Xstr = " Emp="&Cvfs(Emp)&
           ", Pdc="&Cvfs(Pdc)&": Pdp (dyne/cm^2)";
  # Ymin = MinArr(NPdp*NEmp,PdArr);
  # Ymax = MaxArr(NPdp*NEmp,PdArr);
    Ymin = PdpMin;
    Ymax = PdpMax;
    IF Ymin GEQ Ymax THEN
    BEGIN PRINT(Xstr,CrLf," PLOT IS CONSTANT = ",Ymin,CrLf); CALL(0,"EXIT") END;
    DPYOVL(PdArr,NPdp,Id=0,"Pd(Pdp)","&Xstr,"Pd",Ymin,Ymax,PdpMin,PdpMax,FALSE,TRUE,NEmp*NPdp+1000);
    FOR i=2 STEP 1 UNTIL NEmp DO
    BEGIN "DpyLoop"
      ARRBLT(Buf[1],PdArr[(i-1)*NPdp+1],NPdp);
      DPYOVL(Buf,NPdp,Id,NULL,NULL,Ymin,Ymax,PdpMin,PdpMax,TRUE,FALSE);
    END "DpyLoop";
    WHILE TRUE DO
    BEGIN
      IF (Ts←INCHWL)="w" OR Ts="W" THEN DpyWrt(Id,"PD"&CVS(iEmp)&".PLT")
      ELSE IF Ts="R" OR Ts="r" THEN BEGIN QUICK!CODE PGIOT 2, END; MWrite(Id,0) END
      ELSE DONE
    END;
    Drele(Id);

    Ymin = MinArr(NPdp*NEmp,RCArr);
    Ymax = 1.1*MaxArr(NPdp*NEmp,RCArr);
    IF Ymin GEQ Ymax THEN
    BEGIN PRINT(Xstr,CrLf," PLOT IS CONSTANT = ",Ymin,CrLf); CALL(0,"EXIT") END;
    DPYOVL(RCArr,NPdp,Id=0,"Pbe/Pdp:","&Xstr,"R.C.",Ymin,Ymax,PdpMin,PdpMax,FALSE,TRUE,NEmp*NPdp+1000);
    FOR i=2 STEP 1 UNTIL NEmp DO
    BEGIN "DpyLoop"
      ARRBLT(Buf[1],RCArr[(i-1)*NPdp+1],NPdp);
      DPYOVL(Buf,NPdp,Id,NULL,NULL,Ymin,Ymax,PdpMin,PdpMax,TRUE,FALSE);
    END "DpyLoop";
    WHILE TRUE DO
    BEGIN
      IF (Ts←INCHWL)="w" OR Ts="W" THEN DpyWrt(Id,"RC"&CVS(iEmp)&".PLT")
      ELSE IF Ts="R" OR Ts="r" THEN BEGIN QUICK!CODE PGIOT 2, END; MWrite(Id,0) END
      ELSE DONE
    END;
    Drele(Id);
  END "DpyAll"
END "ReedF";
```

APPENDIX B

COPYRIGHT 1986 - THE BOARD OF TRUSTEES
OF THE LELAND STANFORD JUNIOR UNIVERSITY

```
COMMENT Experimental Clarinet

Modification history:

3-MAR-86 version is first test (used with JCLA.JET at that time).
16-MAR-86 - Added bell output highpass filter and changed LI scaling.
16-MAR-86 - Placed DC blocking "cap" in bore.
25-MAR-86 - Added easier breakpoint control of RC table Rf.
TO DO ::: - Add clipper.


        To run:
                .R JETSAM
                *Jcla=Jcla
                *<CALL>
                EX Jcla

READ JETSAM for more information.

Relevant files:

SPECS/D
JETSAM/D
JETINS/D
JETSAM.SAI[LIB,BIL]
UDP2:JETINS.SAI[LIB,BIL]
MODES.TBL[LIB,BIL]
LOWER.DEF[NEW,MUS]
```

```
SAFLIB/D
:

REQUIRE "<><>" DELIMITERS;
REDEFINE #="COMMENT";
REDEFINE Thru=< step 1 until >,ALT=<'175>,CR=<'15>,CRLF=<('15&'12)>,TAB=<('11&"")>;
REDEFINE Ck=<(IF Tr THEN Report ELSE Null(Message)>;
DEFINE WriteMode = "Write'Data+Gl'minus'GO+Sine";

INTEGER Tr;

REQUIRE " Need DPYENV.REL[SAM,JDS]" MESSAGE;
REQUIRE "DPYENV.REL[SAM,JDS]" LOAD'MODULE;

PROCEDURE pgclr; Quick'code pgiot 2, end;  COMMENT clear all pieces of glass;

PROCEDURE Where(STRING Arg(NULL));
BEGIN "Where"
  IF Arg=NULL THEN
  BEGIN "Where"
      INTEGER i;
      DEFINE Nmax="60", j="i=i+1";
      STRING ARRAY W[1:Nmax];
      OWN INTEGER Seed;
      IF Seed = 0 THEN BEGIN Seed = MEMORY['17]; Seed=999999=RAN(Seed); END;
      i=0;
      W[j]="in the morning paper";
      W[j]="on the bathroom wall";
      W[j]="upstairs";
      W[j]="on the bumper";
      W[j]="in the event of results";
      W[j]="where you least expect it";
      W[j]="between samples";
            on the tombstone";
            in the wizards' mail";
      W[j]="in the obituaries";
      W[j]="on the bottle";
      W[j]="as a disclaimer";
      W[j]="encrypted without a password";
      W[j]="elsewhere";
      W[j]="loosely speaking";
      W[j]="as it were";
      W[j]="in the core dump";
      W[j]="on your forehead";
      W[j]="in the fortune cookie";
      W[j]="along with floating underwear messages";
      W[j]="where it will never be read";
      W[j]="somewhere";
      W[j]="somewhere reasonable";
      W[j]="as a token of our appreciation";
      W[j]="a little bit to the left";
      W[j]="as a reminder of Jezebella";
      W[j]="under the boardwalk";
      W[j]="in tribute to the bit bucket";
      W[j]="in an artificially intelligent place";
      W[j]="on your W2 forms";
      W[j]="in your credit file";
      W[j]="in your letters home";
      W[j]="in the ICMC abstracts";
      W[j]="under consideration";
      W[j]="in Patte's mail file";
      W[j]="in a bug-report to BIL";
      W[j]="in DAJ's floor space";
      W[j]="in escrow";
      W[j]="and then unplaced";
      W[j]="where you wish";
      PRINT(W[RAN(@)mi+.45 MAX 1]);
    END "Where"
    ELSE PRINT(" Where else?");
  END "Where";
  COMMENT TbLook - table lookup object
  ;
  INTEGER_OBJECT TbLook(ArgStr);
  BEGIN
  INTEGER i,DlyAdr,Scal,DlyPort,Mod1,InLoc,OutLoc,DlyLen;
  BOOLEAN GotPos,GotOut,GotAdr;
  POINTER CurArg;
  REAL QuitTime;
  DlyPort=Mod1=InLoc=OutLoc=DlyAdr=InValid_pe;
  DlyLen=QuitTime=-1;
  GotPos=TRUE;
  GotOut=FALSE;
  GotAdr=FALSE;
  FOR i=1 STEP 1 UNTIL ArgNum DO
    BEGIN
    CurArg=GetArg;
    IF CurArg=NULL_RECORD
```

```
THEN
  CASE IntMsg:Msg[CurArg] OF
    BEGIN
    [#Report]
    [#Null_Message] ;
    [#Address]          DlyAdr←IntMsg:Val[CurArg];
    [#Scale]            Scal←IntMsg:Val[CurArg];
    [#InputA]           InLoc←IntMsg:Val[CurArg];
    [#Output]           OutLoc←IntMsg:Val[CurArg];
    [#Len]              DlyLen←IntMsg:Val[CurArg];
    [#UsePatch]
        BEGIN "Patch"
        IF PeType(SpecMsg:i1[CurArg])=Modifier_pe
          THEN
            BEGIN
            Mod1←SpecMsg:i1[CurArg];
            DlyPort←SpecMsg:i2[CurArg];
            END
          ELSE
            BEGIN
            Mod1←SpecMsg:i2[CurArg];
            DlyPort←SpecMsg:i1[CurArg];
            END;
        IF PeType(DlyPort)≠Delay_pe THEN BoxError("Patch list delay is invalid");
        IF PeType(Mod1)≠Modifier_pe THEN BoxError("Patch list modifier is invalid:"&CYOS(Mod1));
        GotPes←FALSE;
        END "Patch";
    [#QuitAt]           QuitTime←RlMsg:Val[CurArg];
    [#Duration]         QuitTime←RlMsg:Val[CurArg]+Pass/Srate;
    ELSE BoxError("Tblook cannot handle "&GetMethodName(IntMsg:Msg[CurArg]))
    END
  ELSE DONE;
  END;
IF PeCheck(DlyPort)=invalid_pe THEN DlyPort←Get(Delay_pe,-1,"TblDly");
IF PeCheck(Mod1)=invalid_pe THEN Mod1←Get(Modifier_pe,-1,"TblMod");
IF PeCheck(OutLoc)=invalid_pe
  THEN BEGIN GotOut←TRUE; OutLoc←Get(ModSum_pe,-1,"TblOutLoc"); END;
IF DlyAdr=invalid_pe
  THEN
    IF DlyLen>0
      THEN
        BEGIN
        DlyAdr←Get(DsAddr_pe,DlyLen,"TblMem");
        GotAdr←TRUE;
        END
    ELSE BoxError("Tblook got neither a valid delay address, nor a delay length");
SaeDly(Use(DlyPort),Address(DlyAdr),Mode(Rounded_Lookup),Scale(Scal));
SaeMod(Use(Mod1),InputA(InLoc),Mode(Delay_Unit),Delay(DlyPort),Output(OutLoc));
IF QuitTime>0
  THEN
    BEGIN
    IF GotPes THEN FreeAll(QuitTime,DlyPort,Mod1);
    IF GotAdr THEN Free(QuitTime,DlyAdr);
    IF GotOut THEN Free(QuitTime,OutLoc);
    END;
RETURN(OutLoc);
END;
COMMENT Impulse, Constant, Noise;

COMMENT Impulse Instrument;

    PROCEDURE Impulse(REAL Beg,Dur,Amp; INTEGER OutLoc);
    BEGIN "Impulse"
        StopUntil(Beg);
        # One zero.  S := L1*M1 + L0*M0; L0 := L1; L1 := A;
        SaeMod (Mode(One_Zero),QuitAt(Beg+Dur),
                Term0((Amp*(1 LSH 19)-1)),
                Gain0(1),Output(OutLoc),Etc);
    END "Impulse";

COMMENT Step Instrument;

    PROCEDURE Constant(REAL Beg,Dur,Amp; INTEGER OutLoc);
    BEGIN "Constant"
        StopUntil(Beg);
        IF Pe[illegible] .Et
          [illegible]
        ELSE IF PeType(OutLoc)=GenSum_Pe THEN
            SaeGEN(QuitAt(Beg+Dur),Amplitude(ZeAmp),Output(OutLoc),
                Phase(90),Frequency(0),Etc)
        ELSE PRINT(" Constant: OutLoc is not a sum memory location' ");
    END "Constant";

COMMENT Noise Instrument;

    PROCEDURE Noise(REAL Beg,Dur,Amp; INTEGER OutLoc, Seed(0));
    BEGIN "Noise"
        INTEGER RanSum;
        StopUntil(Beg);
        RanSum ← (IF Amp=1 THEN OutLoc ELSE Get(ModSum:Pe,-1,"NoiseOut"));
```

```
        SawMod(QuitAt(Beg+Dur), Mode(Uniform_noise),
            InputA(Zero),InputB(Zero),Output(RanSum),
            Coeff0('1254635 LSH 18), Coeff1(0), Scale0(2),Scale1(0),
            Term0('668623),Term1('1777777aRAN(Seed)), Etc);
        IF Amp NEQ 1 THEN
            MixSig(QuitAt(Beg+Dur),Output(OutLoc),InputA(RanSum),Gain(Amp),Etc);
    END "Noise":

COMMENT Woodwind Bore with output at bell and internal DC blocking:

    INTEGER PROCEDURE Bore(REAL Beg,Dur,Lg,Fg,Rp,Rz:
                           INTEGER L1,PopSum,PbeSum):

    BEGIN "Bore"
        DEFINE Q=< QuitAt(Beg+Dur) >:
        INTEGER FltIn,FltOut,Cap1,Cap2,Cap3,DelLen,OutSum,Out1:
        DelLen = (L1-5)/2; # L1 = delay from PbeSum to PopSum:
        StopUntil(Beg):
        FltIn = DlyLin(Q,InputA(PbeSum),Len(DelLen-3),Etc);
# RgwPe = Get(DelayPel), FltIn = DlyLin(...,Use(RgwPel));
        FltOut = OnePole(Q,Gain(-Lg*(1-ABS(Fg))),Coeff(Fg),InputB(FltIn),Etc);
        Cap1 = OneZero(Q,Coeff(Rz),Gain(1/(1+Rz)),InputA(FltOut),Etc);
        Cap2 = OnePole(Q,Gain(1+Rp),Coeff(Rp),InputB(Cap1),Etc);
        DlyLin(Q,InputA(Cap2),Len(DelLen-3),Output(PopSum),Etc);
        Out1 = OneZero(Q,Coeff(1),Gain(0.5),InputA(FltIn),Etc);
        OutSum = OnePole(Q,Gain(Fg),Coeff(Fg),InputB(Out1),Etc); # Bell:
        RETURN(OutSum):
    END "Bore":

COMMENT Reed Mouthpiece
:
    INTEGER PROCEDURE Reed(REAL Beg,Dur: INTEGER TblAdr,TblPur2,Pa2Sum,PopSum):
    BEGIN "Reed"
        INTEGER TblIn,TblOut,TblLen,MidSum,PopSum,PopdSum,Pa2dSum,TapSum,PbeSum,MaxIn,MinIn:
        REAL EndT: EndT=Beg+Dur:
        StopUntil(Beg):
        TblLen = 2↑TblPur2:      # Table lookup length in samples:
        PopSum = MixSig(QuitAt(EndT),InputA(PopSum),Gain0(1),
                        InputB(Pa2Sum),Gain1(-1),Etc); # Input is Pa/2:
        PopdSum = DlyLin(QuitAt(EndT),InputA(PopSum),Len(4-3),Etc); # Pipe correction:
#       MidSum = SawGEN(QuitAt(EndT),Frequency(0),Phase(90),
                Amplitude(2*(TblLen*0.5)/(2↑28)),Etc);
        MidSum = LatchSig(QuitAt(EndT),Term1(TblLen*2),Etc);
        MaxIn = MixSig(QuitAt(EndT),InputA(MidSum),Gain0(1),
                InputB(PopSum),Coeff1(TblLen*2 LSH 18),Etc); # 18=DX len:
                InputB(PopSum),Gain1((TblLen/2)/2↑19),Etc);
#       MinIn = MaxSig(QuitAt(EndT),InputA(Zero),InputB(MaxIn),Gain1(1),Etc);
        TblIn = MinSig(QuitAt(EndT),InputA(MidSum),Gain0(2-2↑(1-TblPur2)),
                InputB(MinIn),Gain1(1),Etc);
        TblOut = TbLook(QuitAt(EndT),InputA(TblIn),
                        Scale(8),Address(TblAdr),Len(TblLen));
        PbeSum = MulSig(QuitAt(EndT),InputA(TblOut),InputB(PopdSum),Gain1(1),Etc);
        DlyLin(QuitAt(EndT),Output(PbeSum),InputA(Pa2S
        RETURN(PbeSum):
    END "Reed":

COMMENT Pipeline delays not counting sub sequent interconnect:
MixSig  0
DlyLin  3
RevSig  1
TbLook  3
MulSig  1
OnePole 0
OneZero 1
:
End(Instruments:
COMMENT Global variables:

INTEGER PopSum,PbeSum,L1,RcT:
REAL Beg,Dur,Lg,Fg,Ta,Pa,Fs,Eps,Rp,Rz,Rn,Ng,Esb,Stif,AMa,AMf:
BOOLEAN Rt,It,Wd:
STRING What,SAFfile:
EXTERNAL INTEGER NoCYOS:

INTEGER TblAdr,Pa2Sum:
DEFINE TblPur2="18",Nrc="2↑TblPur2":
INTEGER ARRAY RC[0:Nrc]; # Extra 1st Wd used by DelayArray for wcsa:

DEFINE RTflag = "(IF Rt THEN RealTime ELSE Null(Message)":
DEFINE StdOpen=<SetSrate(Fs),RTflag,Channels(2),Optimize(CombineBit),DvStop,Etc>:

DEFINE WDfile(x)=<(IF Wd AND NOT Rt THEN WriteDataFile(x) ELSE NULL(MESSAGE)>:
DEFINE RTreport=<(IF NOT Rt THEN Report ELSE NULL(MESSAGE)>:

DEFINE Q=< QuitAt(Beg+Dur) >:

POINTER Pf,Rf:

PROCEDURE CkEnv: IF Esb NEQ 0 THEN Rf=MakEnv("0 1 "&CYF(Esb*188)&" 1 188 "&CYF(Stif)):
```

```
COMMENT GetRCtable - Load Reflection-Coefficient Table:
PROCEDURE GetRCtable(INTEGER ARRAY RC; INTEGER N):
BEGIN "GetRCtable"
    INTEGER i,Chan,Brk,Eof:
    IF RcT=1 THEN
    BEGIN
        FOR i=1 STEP 1 UNTIL N DO RC[i]=Ta*(2↑19-1); # 1-Epsilon;
        PRINT("RC table is constant = ",Ta,CrLf);
    END
    ELSE IF RcT=2 THEN
    BEGIN
        STRING Ts:
        IF SATfile=NULL THEN
        BEGIN
            PRINT("Length ",N," input SAT file = ");
            SATfile = INCHWL;
        END ELSE
        BEGIN
            PRINT("Using previous table SATfile = ",SATfile,CrLf,
                  " (Set NULL to override)",CrLf);
            RETURN
        END;
        OPEN(Chan=GetChan,"DSK","17,0,2,0,Brk,Eof); IF Eof THEN PRINT("open failed");
        LOOKUP(Chan,SATfile,Eof);                   IF Eof THEN PRINT("LOOKUP failed");
        ARRYIN(Chan,RC[0],N+1);
        RELEASE(Chan);
        PRINT("File ",SATfile," loaded.",CrLf);
    END
    ELSE
    BEGIN
        RcT=3;
        FOR i=1 STEP 1 UNTIL N DO RC[i] = (2↑19-1)*EnvY((i-1)*100/(N-1),Rf) MAX 0;
        PRINT("RC table set to current Rf function.",CrLf);
    END;
END "GetRCtable";
COMMENT PutRCtable - Generate Reflection-Coefficient Table;

PROCEDURE PutRCtable;
BEGIN "PutRCtable"
    INTEGER i,Chan,Brk,Eof;
    STRING Onase;
    GetRCtable(RC,Nrc);
    PRINT("Output SAT file = ");
    Onase = INCHWL;
    OPEN(Chan=GetChan,"DSK","17,0,2,0,Brk,Eof); IF Eof THEN PRINT("open failed");
    ENTER(Chan,Onase,Eof);                      IF Eof THEN PRINT("enter failed");
    ARRYOUT(Chan,RC[0],Nrc+1);
    RELEASE(Chan);
    PRINT("File ",Onase," written.",CrLf);
END "PutRCtable";

COMMENT Dtest - Delay-line test;

PROCEDURE Dtest;
BEGIN "Dtest"
    StartSam(StdOpen,File("Dtest.Sam"),WDfile("Dtest.snd")); PRINT(CrLf);
    Bind(Sambox,SetPass(Beg*Srate));
    PbaSum = DACModSum[0];  PbpSum = DACModSum[1];
    DlyLin(Q,Len(L1-3),InputA(PbpSum),Output(PbaSum),Etc);
    DlyLin(Q,Len(L1-3),InputA(PbaSum),Output(PbpSum),Etc);
    IF It THEN Impulse(Beg+Eps,Dur,Ta,PbpSum)
        ELSE Noise(Beg+Eps,Beg+2*L1/Srate,Ta,PbpSum);
    IF Wd THEN WriteSig(Q,InputA(PbpSum),Etc);
    StopSam(Q,RTreport);
END "Dtest";

COMMENT Btest - Bore test;

PROCEDURE Btest;
BEGIN "Btest"
    StartSam(StdOpen,File("Btest.Sam"),WDfile("Btest.snd")); PRINT(CrLf);
    Bind(Sambox,SetPass(Beg*Srate));
    PbaSum = DACModSum[0];  PbpSum = DACModSum[1];
    IF Wd THEN WriteSig(Q,InputA(PbpSum),Etc);
    DlyLin(Q,Len(G-3),InputA(PbpSum),Output(PbaSum),Etc);
    Bore(Beg,Dur,Lg,Fg,Rp,Rz,L1,PbpSum,PbaSum);
    IF It THEN Impulse(Beg+Eps,Dur,Ta,PbpSum)
        ELSE Noise(Beg+Eps,Beg+2*L1/Srate,Ta,PbpSum);
    StopSam(Q,RTreport);
END "Btest";

COMMENT Rtest - Reed test;

PROCEDURE Rtest;
BEGIN "Rtest"
    INTEGER i,OutSum,NoiSum,MixSum,PaZSum,AbgSum,PfaSum;
    StartSam(StdOpen,File("Rtest.Sam"),WDfile("Rtest.Snd"),HogSam); PRINT(CrLf);
    TblAdr=GetF(Beg+Dur,DaAddr_pe,Nrc,"RCtable");
    IF Rt THEN BEGIN
        GetRCtable(RC,Nrc);
```

```
        DelayArray(RC,TblAdr,Nrc);
    END ELSE PRINT("TblAdr=",cvos(PeNumber(TblAdr)),CrLf);
    Bind(Samox,SetPass(BegaSr
    OutSum - DACModSum(1);
    PfaSum - SawGEN(Q,AmpEnv(SclEnv(Pf,Pa)),Frequency(B),Phase(SB),Gshift(gs_off),Etc);
    NoiSum - OnePole(Q,Gain(Ngs(1-Rn)),Coeff(Rn),InputB(NoiSig(Q,Etc)),Etc);
    MixSum - MixSig(Q,InputA(PfaSum),Gain0(1),InputB(NoiSum),Gain1(1),Etc);
    AegSum - SawGEN(Q,Amplitude(AMa),Frequency(AMf),Gshift(gs_off),Etc);
    PaZSum - SawMOD(Q,Mode(Am),Gain1(2-AMa),InputA(MixSum),InputB(AegSum),Etc);
    PbaSum - Reed(Beg,Dur,TblAdr,TblPur2,PaZSum,PbpSum);
    OutSum - Bore(Beg,Dur,Lg,Fg,Rp,Rz,Ll,PbpSum,PbaSum);
    IF Wd THEN WriteSig(Q,InputA(PbaSum),Etc);
    IF Ta>0 THEN IF It THEN Impulse(Beg+Eps,Dur,Ta,PbpSum)
                        ELSE Constant(Beg+Eps,Dur,Ta,MixSum);
    StopSam(Q,RTreport);
END "Rtest";

COMMENT KeyTest - Test playing from the keyboard;

PROCEDURE KeyTest;
BEGIN "KeyTest"
    INTEGER i,OutSum,NoiSum,MixSum,PaZSum,AegSum,PfaSum;
    StartSam(StdOpen,File("KeyTest.Sam"),WDfile("KeyTest.Snd"),HogSam); PRINT(CrLf);
    TblAdr=GetF(Beg+Dur,DmAdr_pe,Nrc,"RCtable");
    IF Rt THEN BEGIN
        GetRCtable(RC,Nrc);
        DelayArray(RC,TblAdr,Nrc);
    END ELSE PRINT("TblAdr=",cvos(PeNumber(TblAdr)),CrLf);
    Bind(Samox,SetPass(BegaSrate));
    PbpSum - DACModSum(B);
    OutSum - DACModSum(1);
    PfaSum - SawGEN(Q,AmpEnv(SclEnv(Pf,Pa)),Frequency(B),Phase(SB),Gshift(gs_off),Etc);
    NoiSum - OnePole(Q,Gain(Ngs(1-Rn)),Coeff(Rn),InputB(NoiSig(Q,Etc)),Etc);
    MixSum - MixSig(Q,InputA(PfaSum),Gain0(1),InputB(NoiSum),Gain1(1),Etc);
    AegSum - SawGEN(Q,Amplitude(AMa),Frequency(AMf),Gshift(gs_off),Etc);
    PaZSum - SawMOD(Q,Mode(Am),Gain1(2-AMa),InputA(MixSum),InputB(AegSum),Etc);
    PbaSum - Reed(Beg,Dur,TblAdr,TblPur2,PaZSum,PbpSum);
    OutSum - Bore(Beg,Dur,Lg,Fg,Rp,Rz,Ll,PbpSum,PbaSum);
    IF Wd THEN WriteSig(Q,InputA(PbaSum),Etc);
    IF Ta>0 THEN IF It THEN Impulse(Beg+Eps,Dur,Ta,PbpSum)
                        ELSE Constant(Beg+Eps,Dur,Ta,MixSum);
    PRINT("Entering play loop:",CrLf);
    WHILE TRUE DO
    BEGIN
    StopSam(Q,RTreport);
END "KeyTest";

COMMENT Who, Save;

PROCEDURE Who;          COMMENT Print globals;
BEGIN "Who"
    REDEFINE SemiCrLf=c(":"&"15&"12)&;
    PRINT(Tab,"Rt=",(IF Rt THEN "TRUE" ELSE "FALSE"),SemiCrLf);
    IF Rt THEN Wd=FALSE;
    PRINT(Tab,"Wd=",(IF Wd THEN "TRUE" ELSE "FALSE"),SemiCrLf);
    PRINT(Tab,"Pf=MakEnv(""",PrtEnv(Pf),""")",SemiCrLf);
    PRINT(Tab,"Rf=MakEnv(""",PrtEnv(Rf),""")",SemiCrLf);
    IF RcT=2 THEN PRINT(Tab,"SATfile=""",SATfile,""""",SemiCrLf);
    PRINT(CrLf);
    PRINT(Tab,"RcT=",RcT,SemiCrLf);
    PRINT(Tab,"Beg=",Beg,SemiCrLf);
    PRINT(Tab,"Dur=",Dur,SemiCrLf);
    PRINT(Tab,"Ll=",Ll,": COMMENT Pitch = "&CYF(Fs/Ll)&";",CrLf);
    PRINT(Tab,"Pa=",Pa,SemiCrLf);

    PRINT(Tab,"Lg=",Lg,SemiCrLf);
    PRINT(Tab,"Fg=",Fg,SemiCrLf);
    PRINT(Tab,"Rp=",Rp,SemiCrLf);
    PRINT(Tab,"Rz=",Rz,SemiCrLf);
    PRINT(Tab,"Ng=",Ng,SemiCrLf);
    PRINT(Tab,"Rn=",Rn,SemiCrLf);
    PRINT(Tab,"Tr=",Tr,SemiCrLf);
    PRINT(Tab,"AMa=",AMa,SemiCrLf);
    PRINT(Tab,"AMf=",AMf,SemiCrLf);
    PRINT(Tab,"Eso=",Eso,SemiCrLf);
    PRINT(Tab,"Stif=",Stif,SemiCrLf);
    PRINT(Tab,"Fs=",CYS(Fs),SemiCrLf);
    IF Ta>0 THEN
    BEGIN
        PRINT(Tab,Tab,"It=",(IF It THEN "TRUE" ELSE "FALSE"),SemiCrLf);
        PRINT(Tab,Tab,"Eps=",Eps,SemiCrLf);
    END;
END "Who";

PROCEDURE Save(STRING Fnam("JCLA"));   COMMENT Save globals;
BEGIN "Save"
    IF Fnam=NULL THEN BEGIN  Print("Output JET file:"); Fnam=INCHUL END;
    IF Fnam=NULL THEN RETURN;
    SETPRINT(Fnam,"B"); Who; SETPRINT(NULL,"T")
END "Save";
```

```
COMMENT Set up defaults and try it:

    PROCEDURE E(STRING F(NULL)); EvalF("DSX",(IF F THEN F ELSE "JCLA.JET")); E;

    REDEFINE r="Rtest"; # I hate to type:
    REDEFINE dr = "dpyenv(rf)";
    REDEFINE da = "dpyenv(pf)";

    PRINT(CrLf,"JCLA:  ",
     COMPILER'BANNER[LENGTH(SCANC(COMPILER'BANNER,"116"",",""sinz"))+11 FOR 17],CrLf);
    SETFORMAT(8,3);
    NoCYOS = TRUE; COMMENT If Evaluator doesn't recognize type, don't print;
    Ta = 0;
      It = FALSE;
      Eps = 0.01;
    Tr = 0;
    Rc1=3;
    AMa=0;
    AMf=0;

    What = "Who,What,":"&CrLf&"OpenFile(name),CloseFile,Btest,Rtest";

    WHILE TRUE DO SAILError(0,"Who,What,Where, or ":"",""):

    Save;

  END "JetSam";

  JCLA

  Determine if pipe corrections are needed
  How to get proper clipping?
  Noise may need 1pole lowpass or so. Should sound normal.
  Fix DC onset slap in JCLA
  Try bigger table
  Flare bell
  Sum output correctly for tone holes
  Future: two bores

  #28-Mar-86  1839          JDS
  Clip and delay-change control

  Reason for signal heat w rc=0 at right: At + signal extreme, all of
  mouth pressure gets gated in, and since mouth pressure is maximum,
  this yields largest possible reflection signal. Perhaps key thing
  is whether slope exceeds -1 or some such.


  #22-Mar-86  0819          JDS      JCLA

  COMMENT T1 Make a clarinet double toot:

  Pf=MakEnv("0 0  25 1  50 0  75 1  100 0"):
  Rf=MakEnv("0 1  25 1  65.0  .85  100 .82"):

  L1=91; Beg= .0; Dur= 5.00; Pa= 1.00; Ta= .0; Lg= .950; Fg= .700; Rp= .0;
  Rz= 1.00; Ng= 0; Rn= .9; Tr=0; Fs=40000;


  COMMENT T2 = T1 except reduce Rf at right and dampen bore:

          Pf=MakEnv("0 0  25 1  50 0  75 1  100 0"):
          Rf=MakEnv("0 1  25 1  100 0"):

  L1=31; Beg= 0; Dur= 5.0; Pa= 1.0; Ta= 0; Lg=.95; Fg= .700; Rp= 0;
  Rz=1.0; Ng= 0; Rn= 0; Tr=0; Fs=40000;

  COMMENT

  OutSum (bell output) WAY too faint. Also, it's not much brighter.
  Bore signal is strong but too bassy.
  Signal is very sensitive to breakpoint loc. Moving left or right worsens.
  Decreasing rightmost rc in Rf makes the note louder! We can compensate
    by decreasing Lg as we have done here.
  Noise added to mouth pressure didn't change anything fundamental (Ng>0).
    Oddly, the noise level gets modulated somehow by the note amplitude.
  Brightness: Set Fg from .7 to .1
    Fg=.7 is not bright enough.
    Fg=-.1 gives highpass in loop. Less than this does not sound.
  :


  COMMENT T3 (wow) = T2 except less lowpass, hotter bore, Pa noise:

          Rt=TRUE;
          Wo=FALSE;
          Pf=MakEnv("  0  0  25 1  50 0  75 1 100 0"):
          Rf=MakEnv("  0  1  25 1  100 0"):
```

```
Li←91; Beg← 0; Dur← 5.0; Pa← 1.0; Ta← 0; Lg← .970; Fg← .500; Rp← 0;
Rz←1.0; Ng← .85; Rn← 0; Tr←0; Fs←40000;
```

COMMENT In this case, amazingly, the first note almost "overblows" to yield the 3rd harmonic (a fifth up). The two notes are identical but for what the noise is doing, yet the second note has a solid fundamental and sounds completely different wrt timbre.
:

8/23/86 (it's been a while!)

Wrote GENSAT.SAI to try some other RC functions. First repeated the function in wow.jet and got identical results. Next tried order 2: Found that threshold blowing pressure (TBP) dropped to about Pa=0.5, and at Pa=0.8, the note duration was about the same as before.
JCLA examples

```
821-Mar-86  0151          JOS
COMMENT Make a clarinet double toot:

        Rt←TRUE:          Wd←FALSE:
        Pf←MakEnv("0 0  25 1  50 0  75 1  100 0");
        Rf←MakEnv("0 1  25 1  65.0  .88  100 .82");

        Li←100; Beg← .0; Dur← 5.00; Pa← 1.00; Ta← .0; Lg←.99;
        Fg← .700; Rp← .0; Rz← 1.00; Tr←0; Fs←40000;
```

Winning impulse test of reed and bore

```
    RT ← FALSE:
    WD ← TRUE:
    Beg ← 0:
    Dur ← .1:
    PmF ← MakEnv("0 0 1 0 2 1 100 1"):
    RcF ← MakEnv("0 1 25 1 65 .88 100 .82"):
    Fs ← 30000:
    LoopLen ← 10:
    PmAmp ← 0:
    TestAmp ← .01:
      ImpTest ← TRUE:
      Eps ← 0.01:
    Trace ← 0:
    LoopGain ← 1:
    FbGain ← 0:
```

Winning Step test

```
    RT ← FALSE:
    WD ← TRUE:
    Beg ← 0:
    Dur ← .1:
    PmF ← MakEnv("0 0 1 0 2 1 100 1"):
    RcF ← MakEnv("0 1 25 1 65 .88 100 .82"):
    Fs ← 30000:
    LoopLen ← 10:
    PmAmp ← 0:
    TestAmp ← .4:
      ImpTest ← FALSE:
      Eps ← 0.01:
    Trace ← 0:
    LoopGain ← 1:
    FbGain ← 0:
```

Step test w[illegible]

```
    RT ← FALSE:
    WD ← TRUE:
    Beg ← 0:
    Dur ← .1:
    PmF ← MakEnv("0 0 1 0 2 1 100 1"):
    RcF ← MakEnv("0 1 25 1 65 .88 100 .82"):
    Fs ← 30000:
    LoopLen ← 10:
    PmAmp ← .4:
    TestAmp ← 0:
      ImpTest ← FALSE:
      Eps ← 0.01:
    Trace ← 0:
    LoopGain ← 1:
    FbGain ← 0:
```

First working toot test, 3/1/86. Main problem is big DC step

```
    Fs ← 30000:
    RT ← TRUE:
    WD ← FALSE:
```

```
PmF ← MakEnv("0 0 28 1 80 1 100 0");
RcF ← MakEnv("0 1 25 1 65 .83 100 .82");

Beg ← 0;
Dur ← 1;
LoopLen ← 35;
PmAmp ← 1;
LoopGain ← .99;
FbGain ← .7;
```

```
Filnam Ext  PPN     Size  Written  Time Pro    Writer      Reference--I Dumped  Off
SE1    JET SAMJOS    115 12-Sep-86 0927 000   1JOS JCLA    07-Oct-86 04 P287>
JCLA   JET SAMJOS    256 22-Mar-86 0056 000   1JOS E       07-Oct-86 05 P273>
ICYC86 JET SAMJOS     91 29-Aug-86 2349 000   1JOS JETSAM  07-Oct-86 10 P286>
BRIGHT JET SAMJOS     78 03-Apr-86 1223 000 TXT AM JCLA    07-Oct-86 01 P273>
TEST   JET SAMJOS    256 21-Mar-86 0038 000   1JOS E       07-Oct-86 01 P273>
BASSAX JET SAMJOS     85 29-Aug-86 2316 000   1JOS JCLA    07-Oct-86 07 P286>
SE2    JET SAMJOS     90 12-Sep-86 0931 000   1JOS JCLA    07-Oct-86 04 P287>
SE3    JET SAMJOS     90 12-Sep-86 0935 000   1JOS JCLA    07-Oct-86 04 P287>
TOOT2  JET SAMJOS    128 21-Mar-86 0032 000   1JOS E       07-Oct-86 01 P286>
WOW    JET SAMJOS    128 22-Mar-86 0122 000   1JOS E       07-Oct-86 05 P273>
NOLOSS JET SAMJOS     92 30-Aug-86 0015 000   1JOS JETSAM  07-Oct-86 02 P286>
SIMPC  JET SAMJOS     92 30-Aug-86 0034 000   1JOS JETSAM  07-Oct-86 02 P286>
SE4    JET SAMJOS     91 12-Sep-86 0937 000   1JOS JCLA    07-Oct-86 04 P287>
SE5    JET SAMJOS     91 12-Sep-86 0938 000   1JOS JCLA    07-Oct-86 04 P287>
       Total=   3.3

SE1    JET SAMJOS    115 12-Sep-86 0927 000   1JOS JCLA    07-Oct-86 04 P287>
        Rt←TRUE;
        Wo←FALSE;
        Pf←MakEnv("  .0000000  .0000000  12.5000000  1.0000000  37.5000000  1.0000000  50.0000000  .0000000
62.5000000  1.0000000  87.5000000  1.0000000  100.0000000  .0000000");
        Rf←MakEnv("  .0000000  1.0000000  25.0000000  1.0000000  100.0000000  .0000000");
        SATfile←"o4.sat";
        Rc1←2;
        Dur← 5.000000    ;
        L1←91; COMMENT Pitch = 439.5684400;
        Pa← .5000000    ;
        Ta← .0000000    ;
        Lg← .9700000    ;
        Fg← .1000000    ;
        Rp← .0000000    ;
        Hg← .1000000e-2 ;
        Rn← .0000000    ;
        Tr←2;
        Amp← .0000000    ;
        Amr← .0000000    ;
        Fs←40000;

JCLA   JET SAMJOS    256 22-Mar-86 0056 000   1JOS E       07-Oct-86 05 P273>
COMMENT Make a clarinet double toot, reduce Rf at right and dampen bore;
        REDEFINE r←"Rtest";
        REDEFINE dr = "dpyenv(rf)";
        REDEFINE da = "dpyenv(pf)";
        Rt←TRUE;
        Wo←FALSE;
        Pf←MakEnv("0 0  25 1  50 0  75 1  100 0");
        Rf←MakEnv("0 1  25 1  100 0");
        L1←91; COMMENT Pitch approx 440;
        Beg← .0;
        Dur← 5.00;
        Pa← 1.00;
        Ta← .0;
        Lg← .95;
        Fg← .700;
        Rp← .0;
        Rr← 1.00;
        Hg← 0;
        Rn← 0;
        Tr←0;
        Fs←40000;

ICYC86 JET SAMJOS
COMMENT OutSum (be[ ... was too faint. Also, it's not such brighter.
Bore signal is strong but too bassy.

Signal is very sensitive to breakpoint loc. Moving left or right worsens.
Decreasing rightmost rc in Rf makes the note louder! We can compensate
  by decreasing Lg as we have done here.
Noise added to mouth pressure didn't change anything fundamental (Ng>0).
  Oddly, the noise level gets modulated somehow by the note amplitude.
Brightness: Set Fg from .7 to .1
  Fg=.7 is not bright enough.
  Fg=.1 gives highpass in loop. Less than this does not sound.;
        Rt←TRUE;
        Wo←FALSE;
        Pf←MakEnv("  .000  .000  12.500  1.000  37.500  1.000  50.000  .000  62.500  1.000  87.500  1.000  10
0.000  .000");
        Rf←MakEnv("  .000  1.000  25.000  1.000  100.000  .000");
        L1←91; COMMENT Pitch = 439.560;
        Beg← .000    ;
```

```
      Dur← 5.00    :
      Pa← .500     :
      Ta← .000     :
      Lg← .970     :
      Fg← .100     :
      Rp← .000     :
      Rz← 1.00     :
      Ng← .100e-2  :
      Rn← .000     :
      Tr←2:
      Emo← .000    :
      Stif← .000   :
      Fs←40000:

BRIGHT JET SAMJOS     78 03-Apr-86 1223 000 TXT AN JCLA   07-Oct-86 01 P273>
      Rt←TRUE:
      Wo←FALSE:
      Pf←MakEnv('  .000  .000  25.000  1.000  50.000  .000  75.000  1.000  100.000  .000'):
      Rf←MakEnv('  .000  1.000  25.000  1.000  100.000  .000'):
      L1←91: COMMENT Pitch = 439.560:
      Beg← .000    :
      Dur← 5.00    :
      Pa← 1.00     :
      Ta← .000     :
      Lg← .995     :
      Fg← .300     :
      Rp← .000     :
      Rz← .000     :
      Ng← .500e-2  :
      Rn← .000     :
      Tr←0:
      Fs←40000:

TEST   JET SAMJOS    256 21-Mar-86 0030 000   1JOS E      07-Oct-86 01 P273>
COMMENT Impulse-in-lossless-loop test:
    Fs ← 30000:
    RT ← TRUE:
    WO ← FALSE:
    PF ← MakEnv('0 0 20 1 80 1 100 0'):
    RF ← MakEnv('0 1 25 1 65 .88 100 .82'):
    Beg ← 0:
    Dur ← .1:
    LL ← 35:
    PA ← 0:
    TA ← 1.0:
    LG ← 1:
    FG ← 0:
    Rp←Rz←0:

BASSAX JET SAMJOS     85 29-Aug-86 2316 000   1JOS JCLA   07-Oct-86 07 P286>

      Rt←TRUE:
      Wo←FALSE:
      Pf←MakEnv('  .000  .000  12.500  1.000  37.500  1.000  50.000  .000  62.500  1.000  87.500  1.000  10
0.000  .000'):
      Rf←MakEnv('  .000  1.000  25.000  1.000  100.000  .000'):
      L1←150: COMMENT Pitch = 266.667:
      Beg← .000    :
      Dur← 3.00    :
      Pa← .550     :
      Ta← .000     :
      Lg← .970     :
      Fg← .500     :
      Rp← .000     :
      Rz← 1.00     :
      Ng← .100e-2  :
      Rn← .000     :
      Tr←2:
      Fs←40000:

SE2   JET SAMJOS     90 12-Sep-86 0931 000   1JOS JCLA   07-Oct-86 04 P287>
      Rt←TRUE:
      Wo←FALSE:
      Pf←MakEnv('  .000  .000  12.500  1.000  37.500  1.000  50.000  .000  62.500  1.000  87.500  1.000  10
0.000  .000'):
      Rf←MakEnv('  .000  1.000  25.000  1.000  100.000  .000'):
      SATfile←'>4.sat':
      RcT←2:
      Dur← 5.00    :
      L1←91: COMMENT Pitch = 439.560:
      Pa← .500     :
      Ta← .000     :
      Lg← .970     :
      Fg← .100     :
      Rp← .000     :
      Ng← .100e-2  :
      Rn← .000     :
      Tr←2:
      AMa← .500e-1 :
      AMf← 5.00    :
      Fs←40000:
```

```
SE3     JET SAMJOS      90 12-Sep-86 0935 000   1JOS JCLA   07-Oct-86 04 P287>
        Rt←TRUE:
        Wd←FALSE:
        Pf←MakEnv(" .000  .000  12.500  1.000  37.500  1.000  50.000  .000  62.500  1.000  87.500  1.000  10
0.000  .000"):
        Rf←MakEnv(" .000  1.000  25.000  1.000  100.000  .000"):
        SATfile←"o4.sat":
        RcT←2:
        Dur← 5.00    :
        L1←91: COMMENT Pitch = 439.560:
        Pa← .000    :
        Ta← .000    :
        Lg← .570    :
        Fg← .100    :
        Rp← .000    :
        Ng← .100e-2 :
        Rn← .000    :
        Tr←2:
        AMa← 1.00    :
        AMf← 4.00    :
        Fs←40000:

TOT2    JET SAMJOS      128 21-Mar-86 0032 000   1JOS E      07-Oct-86 01 P286>
COMMENT Make a basic toot, this time using DC block in loop:

        Rt←TRUE:
        Wd←FALSE:
        Pf←MakEnv(" .000  .000  20.000  1.000  80.000  1.000  100.000  .000"):
        Rf←MakEnv(" .000  1.000  25.000  1.000  65.000  .000  100.000  .020"):
        L1←100: COMMENT Pitch = 400.000:
        Beg← .000:
        Dur← 1.00:
        Pa← 1.00:
        Ta← .000:
        Lg← .550:
        Fg← .700:
        Rp← .000:
        Rz← 1.00:
        Tr←0:
        Fs←40000:

WOW     JET SAMJOS      128 22-Mar-86 0122 000   1JOS E      07-Oct-86 05 P273>
COMMENT Make a clarinet double toot, reduce Rf at right and deepen bore:
        Rt←TRUE:
        Wd←FALSE:
        Pf←MakEnv(" 0  0  25 1  50 0  75 1 100 0"):
        Rf←MakEnv(" 0  1  25 1  100 0"):
        L1←91: COMMENT Pitch = 439.560:
        Beg← 0:
        Dur← 5.0:
        Pa← 1.0:
        Ta← 0:
        Lg← .970:
        Fg← .500:
        Rp← 0:
        Rz← 1.0:
        Ng← .05:
        Rn← 0:
        Tr←0:
        Fs←40000:

NOLOSS  JET SAMJOS      92 30-Aug-86 0015 000   1JOS JETSAM 07-Oct-86 02 P286>
        Rt←TRUE:
        Wd←FALSE:
        Pf←MakEnv(" .000  .000  12.500  1.000  37.500  1.000  50.000  .000  62.500  1.000  87.500  1.000  10
0.000  .000"):
        Rf←MakEnv(" .000  1.000  25.000  1.000  100.000  .000"):

        L1←400: COMMENT Pitch = 100.000:
        Beg← .000    :
        Dur← 10.0    :
        Pa← .500    :
        Ta← .000    :
        Lg← 1.00    :
        Fg← .000    :
        Rp← .000    :
        Rz← 1.00    :
        Ng← .100e-2 :
        Rn← .000    :
        Tr←2:
        Emb← .000    :
        Stif← .000    :
        Fs←40000:

SIMPC   JET SAMJOS      92 30-Aug-86 0034 000   1JOS JETSAM 07-Oct-86 02 P286>
        Rt←TRUE:
        Wd←FALSE:
        Pf←MakEnv(" .000  .000  12.500  [illegible]  37.500  1.000  50.000  .000  62.500  1.000  87.500  1.000  10
[illegible]
        Rf←MakEnv(" .000  1.000  25.[illegible]  100.000  .000"):
```

```
L1←100: COMMENT Pitch = 400.000;
Beg← .000    :
Dur← 2.00    :
Pa← .450     :
Ta← .000     :
Lg← 1.00     :
Fg← .000     :
Rp← .000     :
Rz← .000     :
Ng← .100e-2  :
Rn← .000     :
Tr←2:
Esc← .000    :
Stif← .000   :
Fs←48000:
Rt←TRUE:
Ws←FALSE:
Pf←MakEnv(" .000  .000  12.500  1.000  37.500  1.000  50.000  .000  62.500  1.000  87.500  1.000  10
0.000  .000");
Rf←MakEnv(" .000  1.000  25.000  1.000  100.000  .000");
SATfile←"o4.sat":

SE4   JET SAFLOS     91 12-Sep-86 0937 000   1JOS JCLA   07-Oct-86 04 P287>
RcT←2:
Dur← 3.00    :
L1←150: COMMENT Pitch = 266.667;
Pa← .550     :
Ta← .000     :
Lg← .970     :
Fg← .500     :
Rp← .000     :
Ng← .100e-2  :
Rn← .000     :
Tr←2:
Afla← .500e-1 :
Afif← 5.00   :
Fs←48000:
Rt←TRUE:
Ws←FALSE:
Pf←MakEnv(" .000  .000  12.500  1.000  37.500  1.000  50.000  .000  62.500  1.000  87.500  1.000  10
0.000  .000");
Rf←MakEnv(" .000  1.000  25.000  1.000  100.000  .000");
SATfile←"o4.sat":

SE5   JET SAFLOS     91 12-Sep-86 0938 000   1JOS JCLA   07-Oct-86 04 P287>
RcT←2:
Dur← 3.00    :
L1←300: COMMENT Pitch = 133.333;
Pa← .550     :
Ta← .000     :
Lg← .970     :
Fg← .500     :
Rp← .000     :
Ng← .100e-2  :
Rn← .000     :
Tr←2:
Afla← .500e-1 :
Afif← 5.00   :
Fs←48000:
```

APPENDIX C

COPYRIGHT 1986 - THE BOARD OF TRUSTEES
OF THE LELAND STANFORD JUNIOR UNIVERSITY

```
COMMENT Violin Simulation software.

Modification history:

Original file was V.SAI[SAM,JOS], ca. Oct. '82.
Then it became   VS.SAI[SID,JOS], from November '82 to April '83.
No substantial changes were installed over the next couple of years.

12/11/85 - Changed Trace usage. Installed bulk string restoring force.
           Added velocity and bow-string force output files.


BUGS:

        Allpass reset for vibrato is not perfect. You can hear
        little glitches once per period (when delay line increases?)
        Need a careful review of this. Perhaps restore old version
        to see if it happened way back when. I thought not! (12/11/85)

        The bow friction curve used in HyperBow is not sufficiently
        realistic.  The pure discontinuity should be replaced
        by a finite slope.
```

```
        The bow-string solver does not correctly implement
        hysteresis behavior.  Need a stick-slip hysteresis
        memory bit. Currently, the smallest velocity
        perturbation is selected which can be wrong in the
        stuck case. It has been observed that when negative
        velocity pulse returns to bow from nut, we seem to be
        jumping to slipping without getting over the friction
        curve peak.

;
BEGIN "YS"

  REQUIRE "()<>" DELIMITERS;
  DEFINE # = { COMMENT }, thru = { STEP 1 UNTIL }, CrLf = [("15)&("12)],
         Tab = ("11&""), Alt = ("175&""), Cr = [("15)&""], Sat = 0;

  EXTERNAL INTEGER 'SKIP';
  INTERNAL INTEGER Trace, Quiet;

  REQUIRE "JOSLIB.REQ(LIB,JOS)" SOURCE'FILE;
  REQUIRE "RECORD.REQ(LIB,JOS)" SOURCE'FILE;
  REQUIRE "MYIO.REQ(LIB,JOS)" SOURCE'FILE;
  REQUIRE "FLTIO.REQ(LIB,JOS)" SOURCE'FILE;
  REQUIRE "DISPLA.REQ(LIB,JOS)" SOURCE'FILE;
  EXTERNAL PROCEDURE TrpIni(INTEGER CODE); # JAMLIB floating-point traps;

 DEFINE Trace1="(Trace LAND 1)",
        Trace2="(Trace LAND 2)",
        Trace3="(Trace LAND 4)",
        Trace4="(Trace LAND 8)",
        Trace5="(Trace LAND 16)",
        Trace6="(Trace LAND 32)";

 # Filter and Delay-Line routines;

   SIMPLE INTEGER PROCEDURE Index(INTEGER Ptr,Len);
       RETURN(IF Ptr>Len THEN Ptr-Len ELSE IF Ptr LEQ 0 THEN Ptr+Len ELSE Ptr);

   REAL PROCEDURE DlyLin(REAL ARRAY D; REFERENCE INTEGER Ptr;
                         INTEGER Len; REAL InSig(0));
   COMMENT Places InSig into delay line of length Len and returns current output;
   BEGIN "DlyLin"

       REAL Output;
       IF Ptr LEQ 0 THEN BEGIN ARRCLR(D); Ptr=1; END;  # Initialize;
       Output = D[Ptr];
       D[Ptr] = InSig;
       Ptr = Index(Ptr+1,Len); # Ptr always points to end of delay-line;
       RETURN(OutPut);
   END "DlyLin";

   REAL PROCEDURE Filter(INTEGER Ni,No; REAL ARRAY Ic,Oc,Px,Py;
                 REFERENCE INTEGER Iptr,Optr; REAL X(0));

   COMMENT
           Place Input X into filter and return output. See FLTIO.SAI(LIB,JOS)
           for filter documentation (Ni,No,Ic,Oc). Px[1:Ni+1],Py[1:No] are
           history arrays for the filter. Iptr, Optr are used internally.

;
   BEGIN "Filter"
       INTEGER i,j;
       REAL Acc;
       Acc = 0;
       DlyLin(Px,Iptr,Ni,X);    # Push input;
       j=Iptr;                  # Points one past input;
       FOR i = 1 thru Ni DO Acc = Acc + IC[i]*Px[j-Index(j-1,Ni)];
       j=Optr;
       FOR i = 2 thru No DO Acc = Acc + OC[i]*Py[j-Index(j-1,No)];
       DlyLin(Py,Optr,No,Acc); # Output;
       RETURN(Acc);
   END "Filter";

   real procedure MAXABSARR(integer n; real array y);
   begin "MaxArr"
       real yaax,ay;
       integer i, MinX;
       MinX = ARRINFO(y,1);     Comment Lower subscript bound;
       yaax=ABS(y[MinX]);
       for i=1 step 1 until n-1 do if (ay=ABS(y[i+MinX])) > yaax then yaax=ay;
       return(yaax);
   end "MaxArr";

 # Vibrato;

 REAL PROCEDURE Vibrato(REAL PcPv,PcRv,Pvf,Rvf,Fs; INTEGER Time);
 BEGIN "Vibrato"
   DEFINE PI="3.141592653589793";
   OWN REAL Ang,Dang,Rsct,Rrsct,Cranv,Pranv,Ranv,RiScl;
   OWN INTEGER Rcnt,Ri;
   REAL Factor;
```

```
IF Time LEQ 1 THEN
BEGIN
  Ang←0;
  Dang←P1×2×Pvf/Fs;
  Rscl←2×PcRv;
  Rcnt←Fs/Rvf+0.5; # Period of random vibrato;
  Rrscl←1.0/Rcnt;
  Ri←0;
END;

IF (PcRv=0) AND (PcPv=0) THEN RETURN(1);

Factor ← 1 + PcPv×SIN(Ang) + Cranv;
Ang ← Ang + Dang;
IF Ri=0 THEN
BEGIN
  Pranv ← Ranv;

  Ranv ← Rscl×(RAN(0)-0.5);
  Cranv ← Pranv;
  RiScl ← (Ranv-Pranv)×Rrscl;
END
ELSE
  Cranv ← Pranv + Ri×RiScl;

Ri ← Ri+1;
IF Ri GEQ Rcnt THEN Ri←0;

RETURN(Factor);

END "Vibrato";

# Bow noise;

REAL PROCEDURE BowNoise(REAL PcBn,Bnf,Fs; INTEGER Time);
BEGIN "BowNoise"
  OWN REAL Rscl,Rrscl,Cranv,Pranv,Ranv,RiScl;
  OWN INTEGER Rcnt,Ri;
  REAL Factor;

  IF PcBn=0 THEN RETURN(0);

  IF Time LEQ 1 THEN
  BEGIN
    Rscl←2×PcBn;
    Rcnt←Fs/Bnf+0.5; # Period of random BowNoise;
    Rrscl←1.0/Rcnt;
    Ri←0;
  END;

  IF Ri=0 THEN
  BEGIN
    Pranv ← Ranv;
    Ranv ← Rscl×(RAN(0)-0.5);
    Cranv ← Pranv;
    RiScl ← (Ranv-Pranv)×Rrscl;
  END
  ELSE
    Cranv ← Pranv + Ri×RiScl;

  Ri ← Ri+1;
  IF Ri GEQ Rcnt THEN Ri←0;

  RETURN(Cranv);

END "BowNoise";
# Fixed-point finder;

  INTEGER PROCEDURE FP(INTEGER ARRAY F; INTEGER Nf,b,Res(1); REAL Amp(1);
                       BOOLEAN Sym(FALSE));

  COMMENT
    Solve F(x) = x + b for x. F is declared [1:Nf] but considered centered
        about x=0. F[n] is assumed positive for n in [1:MidLoc].
    If Sym is TRUE, F[n] assumed positive everywhere.
        Otherwise it is assumed negative in the right half [MidLoc+1:Nf].
        (Sym is TRUE for clarinet, flute, and organ, FALSE for bowed string.)
    Res is the desired accuracy in x.
    Note that the Friedlander instability is not necessarily resolved
        for the case Sym=FALSE.

  ;
  BEGIN "FP"
    INTEGER Lb,Ub,i,Dx,Fx;
    INTEGER x; # In = (and b) should be real, but here we want speed;

    INTEGER MidLoc; # Middle point of F curve;

    MidLoc ← Nf LSH -1; # F should be discontinuous at midloc,midloc+1 if not Sym;
    Lb← MidLoc-b; # Slope of line is always positive;
    IF Lb<1 THEN  PRINT(" FP: lb = ",Lb," Now set to ",Lb←1,CrLf);
    IF Lb>Nf THEN  PRINT(" FP: ub = ",Lb," Now set to ",Lb←Nf,CrLf);
```

```
    Ub ← (IF Sym THEN MidLoc+b ELSE MidLoc); # Upper limit of search:
    IF Lb>MidLoc THEN
    BEGIN "swap"
      i←Lb;
      Lb←(IF Sym THEN Ub ELSE MidLoc+1);
      Ub←i;
    END "swap";

    x ← (Ub-Lb) LSH -1; # middle;
    Dx ← (Ub-Lb) LSH -1; # First step-size times 2;
    b ← b - MidLoc; # View this as translating x to center at 0 below;

    WHILE Dx>Res DO
    BEGIN "Bisect"
      Dx ← Dx LSH -1; # Halve the step-size;
      IF AmpsF[x]>x+b THEN x ← x+Dx MIN Ub ELSE x ← x-Dx MAX Lb; # Slope positive;
    END "Bisect";

    IF Trace2 THEN
    BEGIN "look"
      STRING Ts;
      INTEGER Id,i,DpySiz;
      OWN INTEGER Nwait;
      REAL ARRAY DpyBuf[1:Nf];
      REAL dmax,dmin;
      IF Nwait LEQ 0 THEN
      BEGIN
        FOR i←1 STEP 1 UNTIL Nf DO DpyBuf[i] ← AmpsF[i];
        Id←0;
        DpySiz ← 3×Nf+1000;
        dmax ← MaxArr(NF,DpyBuf) MAX NF+b;
        dmin ← MinArr(NF,DpyBuf) MIN 1+b;
        DpyOvl(DpyBuf,Nf,Id,"VELOCITY","VELOCITY",dmin,dmax,-512,512,
          FALSE,TRUE,DpySiz);
        FOR i←1 STEP 1 UNTIL Nf DO DpyBuf[i] ← i+b;
        DpyOvl(DpyBuf,Nf,Id,NULL,NULL,dmin,dmax,-512,512,FALSE,FALSE);
        ARRCLR(DpyBuf);
        DpyBuf[x]←AmpsF[x];
        DpyOvl(DpyBuf,Nf,Id,NULL,NULL,dmin,dmax,-512,512,TRUE,FALSE);
        IF (Ts←INCHWL)="w" OR Ts="W" THEN DpyWrt(Id,"FRIC.PLT")
        ELSE Nwait ← INTSCAN(Ts,0);
        IF Nwait<0 THEN Trace ← Trace XOR Trace2; # Turn off this trace;
        DRELS(Id);
      END;
      IF Nwait>0 THEN Nwait ← Nwait-1;
    END "look";

    RETURN(x-MidLoc);

  END "FP";

# Bow-string interaction:

  REAL PROCEDURE BowEffect(INTEGER ARRAY Friction; INTEGER NF,V,Vb(256);
                           REAL Pb(1));
  COMMENT
          Compute the additive velocity imparted to the string from the bow
          on the basis of current string velocity (V), bow velocity (Vb),
          and bow pressure (Pb). The two basic effects used to determine
          this are bow friction and string wave impedance. The array
          Friction[1:Nf] is assumed to contain friction-times-wave-admittance
          as a function of velocity, with zero velocity corresponding to
          the middle of the array (Nf/2).
  ;
  BEGIN "BowEffect"
    REAL Vip,Vo;

    Vip ← Vb - V;  # Wave admittance line is always through (-Vip,Vip):
    IF Pb=0 THEN RETURN(0);
#   Vo ← FP(Friction,Nf,Vip,1,Pb)+Vip; # Find Vp+Vip intersect Friction(Vp):
    Vo ← FP(Friction,Nf,Vip,1,Pb); # Play loop adds in Vi:
    RETURN(Vo);

  END "BowEffect";

# Simplified Bow-string interaction - Hyperbolic friction curve:

  REAL PROCEDURE HyperBow(REAL Vi,Vb,Pb);
  COMMENT
          Compute the additive velocity imparted to the string from the bow
          on the basis of current string velocity (Vi), bow velocity (Vb),
          and bow pressure (Pb). The two basic effects used to determine
          this are bow friction and string wave impedance.
          The equations which must be simultaneously satisfied are

                Y f = dV
                  f = F(V-Vb)
                    = F(Vi+dV-Vb)
```

where Y is the characteristic admittance of the string, f is the force of the bow on the string, and
F(V) is the force V, velocity friction curve for the bow and string.
Here we use Y F(V) = -Pb/V as the friction curve normalized by Y. Thus dV is found as the solution to dV = -Pb/(dV+Vi-Vb). It is returned as the amount to add to the incident string velocity Vi to comply with the physical constraints of bow friction and string wave impedance.

```
:
BEGIN "HyperBow"
  REAL Vib,dV,V1,V2,Rad,Tmp;
  OWN INTEGER StCnt,Slipping,WasSlipping;

  Vib = Vi - Vb;  # Wave admittance line is always through (-Vbi,Vbi);

  IF Pb=0 THEN RETURN(0);
  Rad = Vib*Vib - 4*Pb;
  IF Rad<0 THEN
  BEGIN "Stuck"
    dV = -Vib; # Cancel differential velocity. String is stuck to bow;
  END "Stuck"
  ELSE
  BEGIN "Slip"
    Rad = SQRT(Rad)/2;
    Tmp = -Vib/2;
    V1 = Tmp + Rad;      # Two real solutions to the quadratic (have same sign);
    V2 = Tmp - Rad;
    dV = (IF V1>0 THEN V2 ELSE V1); # Always take the smallest solution;
#
 The above statement is oversimplified. A bit should be maintained which
 indicates whether the string is stuck or slipping relative to the bow.
 Then we always take the solution which leaves us in the same state if
 possible. It is possible to have two stuck solutions in which case the
 above rule (i.e., choose the smaller change in velocity) works properly.
 The "least-action" rule can fail when the string is in the stuck state,
 taking it out of that state too soon.

  END "Slip";

  IF Trace3 THEN
  BEGIN
    WasSlipping=Slipping;
    Slipping = (IF ABS(Vi+dV - Vb) < 0.000001 THEN FALSE ELSE TRUE);
    IF WasSlipping AND NOT Slipping THEN BEGIN PRINT(StCnt," SLIPS",CrLf);
      StCnt=0; END ELSE
    IF NOT WasSlipping AND Slipping THEN BEGIN PRINT(StCnt," STICKS",CrLf);
      StCnt=0; END;
    StCnt=StCnt+1;
  END;

  IF Trace2 THEN
  BEGIN "hlook"
    STRING Ts;
    INTEGER Id,i,DpySiz;
    OWN INTEGER Nwait;
    REAL Xscl,Ymax,Ymin,Xmin,Xmax;
    INTEGER Mid;
    DEFINE Ndpy="512";
    REAL ARRAY DpyBuf[1:Ndpy];
    IF Nwait LEQ 0 THEN
    BEGIN "plot"
      # Stuck: Scale [1:Ndpy] to be [-2*Pb,2*Pb] = [Xscl*(1-Mid),Xscl*(Ndpy-Mid)];
      # Slip: Scale [1:Ndpy] to be [-2*Vib,2*Vib]=[Xscl*(1-Mid),Xscl*(Ndpy-Mid)];
      SIMPLE REAL PROCEDURE ItoV(INTEGER i); RETURN((Xscl*(i-Mid)));
      SIMPLE INTEGER PROCEDURE Vtoi(REAL V);
        RETURN((V/Xscl) + Mid + 0.5 MAX 1 MIN Ndpy);
      Mid = Ndpy/2;
      Ymax = (IF NOT Slipping THEN 2*Pb ELSE ABS(2*(Vi-Vb)));
      Ymin = -Ymax;
#     Xmax = (IF NOT Slipping THEN 2*Pb ELSE ABS(2*(Vi-Vb)));
      Xmax = 2*(ABS(Vb) MAX ABS(Vi) MAX ABS(Vi+dV));
      Xmin = -Xmax;
      Xscl = Xmax/(Mid-1);
      FOR i=1 STEP 1 UNTIL Ndpy DO
        DpyBuf[i] = (IF ABS(ItoV(i)-Vb)>0.000001 THEN -Pb/((ItoV(i)-Vb)) ELSE 0);
      DpySiz = 3*Ndpy+1000;
      DpyOvl(DpyBuf,Ndpy,Id=0,(IF Slipping THEN "SLIP" ELSE "STUCK")&" VELOCITY",
        "VELOCITY",Ymin,Ymax,Xmin,Xmax,FALSE,TRUE,DpySiz);
      FOR i=1 STEP 1 UNTIL Ndpy DO DpyBuf[i] = ItoV(i)-Vi; # Wave impedance line;
      DpyOvl(DpyBuf,Ndpy,Id,NULL,NULL,Ymin,Ymax,Xmin,Xmax,FALSE,FALSE);
      ARRCLR(DpyBuf);
      DpyBuf[Vtoi(dV+Vi)] = dV; # Evaluate solution on impedance line;
      DpyOvl(DpyBuf,Ndpy,Id,NULL,NULL,Ymin,Ymax,Xmin,Xmax,TRUE,FALSE);
      IF (Ts=INCHWL)="w" OR Ts="W" THEN DpyWrt(Id,"X.PLT")
      ELSE Nwait = INTSCAN(Ts,0);
      IF Nwait<0 THEN Trace = Trace XOR Trace2; # Turn off this trace;
      DRELS(Id);
    END "plot";
    IF Nwait>0 THEN Nwait = Nwait-1;
  END "hlook";
```

```
  RETURN(dY);

 END "HyperBow":

# Declarations:

 DEFINE FltMax=[88];
 DEFINE NfMax = [48596], MaxFriction = [128];
 INTEGER ARRAY Friction[1:NfMax]; # Bow-string friction curve:
 REAL ARRAY lcSl,OcSl,lcSr,OcSr,lcB,OcB[1:FltMax]; # Filter coefficients:
 INTEGER NiSl,NoSl,NiSr,NoSr,NiB,NoB; # Filter orders (+1):
 INTEGER P,Pl,Pr,Cpr,Ppr,Mul,Mur,i,j,Samp,N,Nf,Nl,Type,BowPos,Nstall,NolB:
 BOOLEAN HyperFric;
 STRING NutFilterFile,BridgeFilterFile,BodyFilterFile,PeriodFile,FrictionFile,Ts;
 REAL Fs,Dur,Frq,Lift;
 REAL BowPosition,BowVelocity,BowPressure,BP,BV,BowAccel;
 REAL BVtc,BPtc,BVpr,BPpr,BVas,BPas; # Time constants of attack plus assoc. vars.:
 REAL BPdtc,BPdpr,BPdas,BPfin,tBp,tBpd; # Time consts of decay plus assoc. vars.:
 REAL Disp,SlipF; # String displacement and Slip force:
 REAL PcPv,FcRv,Pvf,Rvf,Apc,DcPr,Pap; # Vibrato parameters:
 REAL PcBn,Bnf; # Bow noise parameters:
 REAL Stiffness; # Stiffness of tension-mode of string:
 REAL BulkForce; # Restoring force due to stiffness:

#        PcBn is the amount of random noise to add to Vb. Bnf is the rate
         in Hz at which new noise samples are generated, with intermediate
         noise values obtained by linear interpolation.

:

  RECORD!POINTER(Sndfile) SndPtr, DefPtr;
  DEFINE In(x)=[Sndfile:x[SndPtr]];
  DEFINE Def(x)=[SndFile:x[DefPtr]];

# Input Parameters:

  PRINT(CrLf,"VS (Violin Simulation): ",
   COMPILER!BANNER[LENGTH(SCAN(COMPILER!BANNER,Tab,"","sinz"))+11 FOR 17],CrLf):

  PRINT(CrLf,"Trace codes (any combination can be added together):
        1 - Display Body, string-velocity, applied-force waveforms.
        2 - Display Bow-string interaction graphical solver.
        4 - Print number of samples stuck or slipping, prin delay-line changes.
        8 - Print string displacement.
       16 - Initialize string with impulse if not reading initial state file.
       32 - Display running overlay of body output, applied force, and velocity.
  ");

  TrpInt(26);          # all except integer overflow (1) and real uflow (10);
  SUPCT:               # Adjust line activation options:
  SETFORMAT(0,2);

  IF Fs LEQ 0 THEN
  BEGIN "defaults" # These are preserved across CALL and START:
    Nstall = 5; # debug only:
    Dur=1;
    Lift=0.4;
    Fs=17857.14;
    Frq=196;     # Low G on violin;
#   Fs=10000;
#   Frq=100;     # Low G on violin;
    BowPosition = 0.17;
#   BowPosition = 0.1;
#   BowVelocity = 50;
    BowVelocity = 0;
    BowAccel = .0001;
    BVtc = 0;
#   BowPressure = 1.5;
    BowPressure = 1;
#   BPtc = 0.01;
    BPtc = 0;
    BPdtc = Lift/2;
    BPfin = BowPressure/2;
    Quiet = TRUE;
    SlipF = 10;
    PcPv = .005;          # This times pitch is the max periodic vibrato excursion;
    PcRv = .001;          # This times pitch is the max random vibrato excursion;
    Pvf = 5.5;            # Periodic vibrato rate in Hz;
    Rvf = 10;             # Random vibrato rate in Hz;
    PcBn = 0.01;          # Bow noise amplitude;
    Bnf = 10;             # Bow noise frequency;
    HyperFric = TRUE;     # Default friction curve = hyperbolic;
#   Stiffness=1/500;      # Force/StringDisplacement;
    Stiffness=0;
  END "defaults":

# Set up default filters and friction curve:

    NiSr=NoSr=1; lcSr[1]=-1;  # Simple rigid termination for default nut;
    NiSl=2; NoSl=1; lcSl[1]=lcSl[2]=-0.49;  # Simple lowpass for default bridge;
    NiB=1; NoB=2; lcB[1]=.01; lcB[2]=0.99; # Default body is one-pole lowpass;
    Mul=2; # Should be 0.5;
    Nf = 512;
```

```
FOR i=1 Thru 256 DO Friction[i] ← MaxFriction/(257-i); # Hyperbolic default;
FOR i=257 Thru 512 DO Friction[i] ← MaxFriction/(256-i);

WHILE TRUE DO
BEGIN "OmniLoop"
  WHILE TRUE DO
  BEGIN "GetParameters"
    STRING Bucky,Arg2, Arg1,Cmd,Prompt;
    INTEGER BoolNum,Brk;

    Prompt ← CrLf&"Dur("&CVFS(Dur)&
            ") Lift("&Cvfs(Lift)&
            ") Pitch("&Cvfs(Frq)&
            ") Clockrate("&Cvfs(Fs)&
            ") MaxForce("&Cvfs(SlipF)&
            ") Trace("&CVS(Trace)&
            ")"&CrLf&"Velocity("&Cvfs(BowVelocity)&
            ",tau="&Cvfs(BVtc)&
            ") Acceleration("&Cvfs(BowAccel)&
            ") BowPos("&Cvfs(BowPosition)&
            ") Stiffness("&Cvfs(Stiffness)&
            ")"&CrLf&"Force("&Cvfs(BowPressure)&
            ",tau="&Cvfs(BPtc)&
            ") UltimateForceMult("&Cvfs(BPfin)&
            ",tau="&Cvfs(BPdtc)&
              DEFINE FN(x) = ((IF x THEN x ELSE "<Default>"));
            ")"&CrLf&"Input(Period = "&FN(PeriodFile)&
                    ", Friction = "&FN(FrictionFile)&", "&CrLf&
                    " Nut = "&FN(NutFilterFile)&", Bridge = "&
                       FN(BridgeFilterFile)&", "&CrLf&
                    " Body = "&FN(BodyFilterFile)&") or NoteSpec:";

    Read_Command (Prompt,Bucky,Arg2,Arg1,Cmd);

    CASE Cmd OF
    BEGIN "SetParameters"
        ["D"]   Dur←REALSCAN(Arg1,Brk);
        ["L"]   Lift←REALSCAN(Arg1,Brk);
        ["P"]   Frq←REALSCAN(Arg1,Brk);
        ["S"]   Stiffness←REALSCAN(Arg1,Brk);
        ["C"]   Fs←REALSCAN(Arg1,Brk);
        ["M"]   SlipF←REALSCAN(Arg1,Brk);
        ["F"]   BEGIN
                  IF NOT Arg1 THEN AinReal(BowPressure,"Middle Bow Pressure")
                    ELSE BowPressure←REALSCAN(Arg1,Brk);
                  IF NOT Arg2 THEN AinReal(BPtc,"Attack time constant")
                    ELSE BPtc←REALSCAN(Arg2,Brk);
                END;

["U"]   BEGIN
          IF NOT Arg1 THEN AinReal(BPfin,"Final Bow Pressure Loss")
            ELSE BPfin←REALSCAN(Arg1,Brk);
          IF NOT Arg2 THEN AinReal(BPdtc,"Decay time constant")
            ELSE BPdtc←REALSCAN(Arg2,Brk);
        END;
["V"]   BEGIN
          IF NOT Arg1 THEN AinReal(BowVelocity,"Final Bow Velocity")
            ELSE BowVelocity←REALSCAN(Arg1,Brk);
          IF NOT Arg2 THEN AinReal(BVtc,"Time constant")
            ELSE BVtc←REALSCAN(Arg2,Brk);
        END;
["A"]   BEGIN
          IF NOT Arg1 THEN AinReal(BowAccel,"(Constant) Bow Acceleration")
            ELSE BowAccel←REALSCAN(Arg1,Brk);
        END;
["B"]   BowPosition←REALSCAN(Arg1,Brk);
["I"]   BEGIN "Input"
          IF NOT Arg1 THEN
          BEGIN
            INTEGER Ttys;
            PRINT("Period, Friction, Nut, Bridge, Body:");
            Ttys ← TTYUP(TRUE);
            Arg1←INCHWL;
            TTYUP(Ttys);
          END;
          IF Arg1 = "P" THEN
          BEGIN
            PRINT("Initial String-Period");
            SndPtr←GETARC("INPUT.SND",NULL,Quiet);
            IF SndPtr NEQ NULL!RECORD THEN
            BEGIN
              Fs←In(Clock);
              Frq←Fs/In(Nsamps);
              PeriodFile ← In(Name);
            END;
          END
          ELSE IF Arg1="F" THEN
          BEGIN
            IF NOT AinInt(Nf←512,"Size of friction curve")
              OR Nf<2 THEN CONTINUE "GetParameters";
            BEGIN
```

```
            INTEGER :,Amp;
            REAL ARRAY Tmp[1:Nf];
            PRINT("Friction curve");
            FrictionFile ← GetArr(Tmp,Nf,"FRIC.SND",Quiet);
            HypFric ← (FrictionFile ≠ NULL);
            IF NOT HypFric THEN
            BEGIN
              Amp ← MaxFriction/ABS(Tmp[Nf/2]); # Normalize peak;
              FOR i←1 Thru Nf DO Friction[i] ← AmpxTmp[i];
            END;
          END
        END
        ELSE IF Arg1="N" THEN
        BEGIN
          PRINT("Nut");
          IF NOT GetFlt(NiSr,NoSr,IcSr,OcSr,NutFilterFile,Quiet)
            THEN CONTINUE "GetParameters";
          AinInt(Hur ← NoSr-2 MAX 0),"Phase-Delay Offset for nut filter (samples)");
        END
        ELSE IF EQU(Arg1[1 FOR 2],"BR") THEN
        BEGIN
          IF NOT GetFlt(NiSl,NoSl,IcSl,OcSl,BridgeFilterFile,Quiet)
          THEN BEGIN BridgeFilterFile←NULL; CONTINUE "GetParameters" END;
          AinInt(Hul ← NoSl-2 MAX 0),"Phase-Delay Offset for bridge filter (samples)");
        END
        ELSE IF EQU(Arg1[1 FOR 2],"BO") THEN
        BEGIN
          IF NOT GetFlt(NiB,NoB,IcB,OcB,BodyFilterFile,Quiet)
          THEN BEGIN BodyFilterFile←NULL; CONTINUE "GetParameters" END;
        END
        ELSE IF Arg1="B" THEN PRINT(" Ambiguous input option",CrLf)
        ELSE PRINT(" No such input option",CrLf);
      END "Input";
  ["N"]  BEGIN "NoteSpec"
          AinReal(PcPv," Periodic vibrato relative amplitude");
          AinReal(Pvf," Periodic vibrato rate in Hz");
          AinReal(PcRv," Random vibrato relative amplitude");
          AinReal(Rvf," Random vibrato rate in Hz");
          AinReal(PcBn," Bow noise relative amplitude");
          AinReal(Bnf," Bow noise rate in Hz");
        END "NoteSpec";
  ["T"]  PRINT(CrLf," TRACE set to ",TRACE←INTSCAN(Arg1,Brk),CrLf);
  ["Q"]  Quiet ← ¬ (Arg1 = BoolFalse);
  ["E"]  CALL(0,"EXIT");
  [":"]  ;      # For comments or command prompt refresh;
  [ALT]  DONE "OmniLoop";
  [CR]   DONE "GetParameters";
  ELSE PRINT(" what?",CrLf)
 END "SetParameters";
END "GetParameters";

NoFreqOur;
Ni←NutLift;
P←Fs/Frq + 0.5;
Pl ← PmBowPosition-Hul+0.5; # Amount of string to left of bow (toward bridge);
Pr ← P - Pl - Hur; # Amount of string to the right of the bow (toward nut);

IF BPtc LEQ 0 THEN BPpr ← 0 ELSE
  BPpr ← EXP(-1/(BPtcxFs)); # term ratio for exponential rise at time-constant;
IF BVtc LEQ 0 THEN BVpr ← 0 ELSE
  BVpr ← EXP(-1/(BVtcxFs));
BPas ← BowPressure(1-BPpr); # Additive constant to achieve asymptotic value;
BVas ← BowVelocity(1-BVpr);

IF BPdtc LEQ 0 THEN BPdpr ← 0 ELSE
  BPdpr ← EXP(-1/(BPdtcxFs));
BPdas ← (BPfin/BowPressure)x(1-BPdpr);

IF SndPtr≠NULL!RECORD THEN
BEGIN
  DefPtr ← NEW!RECORD(SndFile);
  Def(Clock) ← Fs;
  Def(Pack)  ← 4; # 16-bit SAM format;
  Def(Spw)   ← 2; # 16-bit SAM format;
  Def(MaxAmp)← 1; # See to this before writing out;
  Def(Name)  ← "TEST.SND";
 END ELSE DefPtr←SndPtr;

# Set up the model;

  BEGIN "ALAR"
    REAL ARRAY BodyOut[1:N],Yinit[1:P]; # Output signal and initial string state;
    REAL ARRAY ForceOut,VelOut[1:N];
    REAL Yil,Yl,Yol,Yir,Yr,Yr,Yrsl,Yrs,Yor,Yb,Ybp;   # String velocities;

    # Below are the delay-lines used for ideal-string propagation;
    REAL ARRAY Sdl[1:Pl]; # Bridge to bow and back;
    REAL ARRAY Sdr[1:Prs(1+PcRv+PcPv)+1]; # Bow to nut and back;
```

```
# Below are the delay-lines used for internal filter delays:
REAL ARRAY XdSr [1:NiSr+1],YdSr [1:NoSr]; # Nut-side string filter state:
REAL ARRAY XdSl [1:NiSl+1],YdSl [1:NoSl]; # Bridge-side string filter state:
REAL ARRAY XdB  [1:NiB +1],YdB  [1:NoB ]; # Body-filter state:

# Below are pointers to the filter-state delay-lines:
INTEGER SdlPtr,SdrPtr,XdSlPtr,YdSlPtr,XdSrPtr,YdSrPtr,XdBPtr,YdBPtr;

y it:

SETFORMAT(8,5);

IF SndPtr NEQ NULL!RECORD THEN FOR i=1 STEP 1 UNTIL P DO Yinit[i]=In(Data)[i]
  ELSE IF TraceS THEN Yinit[1]=1 ELSE ARRCLR(Yinit);

Yil = Yl = Yol = Yir = Yr = Yr = Yral = Yra = Yor = 0; # Zero string state:
SdlPtr = SdrPtr = XdSlPtr = YdSlPtr = XdSrPtr = YdSrPtr = XdBPtr = YdBPtr = 1;
BP = BV = Disp = tBp = 0; tBpd=1; NoI8 = N/18 MAX 1; Ppr=Pr;
Stuck = TRUE;        # Zero intitial bow velocity => sticking initially:

FOR Samp=1 STEP 1 UNTIL N DO
BEGIN "PlayLoop"
  OWN INTEGER NPwait;
  IF Samp MOD NoI8 = 0 THEN PRINT("s");

; following block handles vibrato:

   DEFINE Eps="0.01"; # This avoids pole-zero cancellation in the allpass:
   DcPr = PrsVibr[...:BPsPcPv,BPsPcRv,Pvf,Rvf,Fs,Samp]; # Desired current period:
   Cpr = DcPr-Eps; # Floor to get integer part of desired delay:
   Pap = DcPr-Cpr; # Difference in delay,to get with allpass:
   Apc = (1-Pap)/(1+Pap); # Allpass coefficient:
   IF Cpr=Ppr+1 THEN
   BEGIN
     IF Trace3 THEN PRINT(" increasing delay-line at time ",Samp/Fs,Crlf);
     FOR i=Cpr STEP -1 UNTIL SdrPtr+1 DO Sdr[i]=Sdr[i-1];
     Sdr[SdrPtr]=Yral; # Add allpass delay cell to end of delay-line:
     Yral = 0; # Is this the best possible reset here?:
     Ppr = Cpr;
   END
   ELSE IF Cpr=Ppr-1 THEN
   BEGIN
     IF Trace3 THEN PRINT(" decreasing delay-line at time ",Samp/Fs,Crlf);
     Yral = Sdr[SdrPtr]; # Pop last delay element into allpass:
     FOR i=SdrPtr Thru Cpr DO Sdr[i]=Sdr[i+1]; # Cover down:
     Ppr = Cpr;
   END
   ELSE IF Cpr NEQ Ppr THEN PRINT(" Delay-line changed by ",Cpr-Ppr,Crlf);

e following block handles the exponential motion of force and velocity:

    BV = BVss + BVprsBV; # Exponential from zero to final:
    BVss = BVss + BowAccel; # Integrate acceleration:
    tBp = BPss + BPprstBp; # Attack:
    tBpd = BPdss + BPdprstBpd; # Decay:
    BP = tBpstBpd;

w for the string loop simulation:

    Ybo = Yil + Yir; # String velocity under the bow:
    Disp = Disp + Ybo; # Current displacement at the bowing point:
    BulkForce = StiffnessDisp; # Restoring force due to tension increase:
    IF ABS(BulkForce)>ABS(BP) THEN PRINT(Samp," $$$ Bulk force exceeds bow force $$$ ");
    IF Samp=N1 THEN PRINT("(((Lifting bow)))");
```

What is claimed is:

1. A real time tone generation system comprising:

means for providing a control signal, the value of which is variable within a range including plural non-zero values in accordance with performance variation, for initiating and thereafter controlling generation of a tone;

wave transmission means for transmitting wave signals, the wave transmission means including an input and an output, a first signal path for receiving signals from the input, a second signal path for providing signals to the output, the first signal path being coupled to the second signal path, and delay means in at least one of the signal paths for delaying signals;

junction means having a first input for receiving the control signal, a second input for receiving a signal from the output of the wave transmission means and an output for providing a signal as the input to the wave transmission means which is a function of at least the value of the control signal and the value of the signal received from the output of the wave transmission means so as to cause a tone signal to propagate in the wave transmission means and to vary in response to variation of the value of the control signal, wherein transmission characteristics of the wave transmission means and junction means determine the pitch of the tone signal; and tone signal extracting means for extracting a tone signal from at least one of the wave transmission means and junction means.

2. A tone generation system as in claim 1 including coupling means for at least partially coupling signals from the first path to the second path.

3. A tone generation system as in claim 2 wherein the coupling means couples less than all of the signal from the first path to the second path.

4. A tone generation system as in claim 2 wherein said coupling means includes a low pass filter.

5. A tone generation system as in claim 2 wherein said coupling means includes means for inverting signals.

6. A tone generation system as in claim 5 wherein the coupling means includes means for filtering signals passing therethrough.

7. A tone generation system as in claim 2 wherein the coupling means includes gain control means for controlling gain of signals passing therethrough.

8. A tone generation system as in claim 7 wherein the gain control means controls gain in accordance with a preselected tone color.

9. A tone generation system as in claim 2 wherein said coupling means includes means for inverting and controlling the gain of signals passing therethrough.

10. A tone generation system as in claim 1 wherein the junction means includes conversion means for converting the signal from the second path in accordance with a conversion characteristic and switching means for selecting the conversion characteristic in accordance with the value of the control signal.

11. A tone generation system as in claim 1 wherein the junction means includes non-linear conversion means which receives the signal from the second path and converts it to the signal provided to the first path in accordance with a non-linear characteristic.

12. A tone generation system as in claim 11 wherein the non-linear conversion means includes table means for storing values representative of the non-linear characteristic and addressing means for addressing the table means in accordance with the values of the control signal and the signal from the second path, wherein the output of the table means is employed to generate the output of the junction means.

13. A tone generation system as in claim 12 wherein the addressing means receives the control signal and the signal from the second path and addresses the table means in accordance with the difference between the signals.

14. A tone generation system as in claim 12 wherein the table means stores compressed data and further including modification means for modifying the compressed data read out from the table means to provide the output of the junction means.

15. A tone generation system as in claim 14 wherein the table means stores data of a predetermined number of bits and wherein the modification means includes means for operating on the output of the table means to provide expanded data of a number of bits greater than the predetermined number of bits.

16. A tone generation system as in claim 1 wherein the control signal generating means includes means for generating a control signal having a noise component.

17. A tone generation system as in claim 16 wherein said noise component is white noise.

18. A tone generation system as in claim 1 wherein said control signal generating means includes means for generating a control signal having a regularly varying repeating component to impart a desired musical effect to the tone to be generated.

19. A tone generation system as in claim 18 wherein said repeating component is a tremolo component.

20. A tone generation system as in claim 1 wherein said delay means includes means for modifying a signal passing through the delay means in addition to delaying the signal.

21. A tone generation system as in claim 20 wherein the means for modifying includes all-pass filter means for imparting phase changes to a signal passing through the delay means.

22. A tone generation system as in claim 14 wherein the non-linear modification means includes interpolation means for interpolating values between stored values.

23. A tone generation system comprising;

means for providing a control signal for initiating and thereafter controlling generation of a tone;

wave transmission means for transmitting wave signals, the transmission means including an input and an output, a first signal path for receiving signals from the input, a second signal path for providing signals to the output, the first signal path being coupled to the second signal path, and delay means in at least one of the signal paths for delaying signals;

coupling means for at least partially coupling signals from the first path to the second path, wherein the coupling means includes means for blocking DC signals;

junction means having a first input for receiving the control signal, a second input for receiving a signal from the second path and an output for providing a signal to the first path which is a function of at least the value of the control signal and the value of the signal received from the second path so as to cause a tone signal to propagate in the wave transmission means, wherein transmission characteristics of the wave transmission means and junction means determine the pitch of the tone signal; and tone signal extracting means for extracting a tone signal from at least one of the wave transmission means and junction means.

24. A real time tone generation system comprising:

means for providing a control signal, the value of which is variable within a range including plural non-zero values in accordance with performance variation, for initiating and thereafter controlling generation of a tone, wherein the value of the control signal is substantially independent of the pitch of a tone to be generated;

wave transmission means for receiving the control signal and electronically simulating wave transmission which occurs in a natural musical instrument so as to create at least one wave signal in the wave transmission means in response to the control signal, said wave signal interacting with the control signal so as to be sustained and varied in response to variation of the value of the control signal; and means for extracting a signal from the wave transmission means as a musical tone signal whose pitch is determined by transmission characteristics of the wave transmission means.

25. A tone generation system as in claim 24 wherein the natural musical instrument is a wind instrument and the control signal represents mouth pressure, wherein the wave transmission means includes a first end representing a mouthpiece which receives the control signal and a second end representing an opening end, wherein wave signals are generated and transmitted in the wave transmission means between the first and second ends in response to the control signal.

26. A tone generation system as in claim 24 wherein the wave transmission means further includes pitch control means for altering wave propagation characteristics in the wave transmission means so as to change the pitch of the musical tone signal.

27. A tone generation system as in claim 26 wherein the wave transmission means includes a network of plural wave transmission paths and wherein the pitch control means includes means for varying the transmission characteristics of different portions of the network.

28. A tone generation system as in claim 25 wherein the wave transmission means includes means for simulating wave transmission characteristics of a wind instrument having a bore whose diameter increases from the mouth piece to the opening end.

29. A tone generation system as in claim 25 wherein the natural musical instrument is a reed instrument.

30. A tone generation system as in claim 29 wherein the natural musical instrument is a clarinet.

31. A tone generation system as in claim 29 wherein the natural musical instrument is a saxophone.

32. A tone generation system as in claim 24 wherein the natural musical instrument is a stringed instrument and the wave transmission means includes first and second wave transmission sections for transmitting wave signals and junction means interconnecting the first and second wave transmission sections and receiving the control signal, wherein wave signals are created in both the first and second wave transmission sections.

33. A real time tone generation system comprising:

control means for providing a control signal for initiating and thereafter controlling tone generation;

at least first and second wave transmission means, each including an input and an output, a first signal path for receiving signals from the input, a second signal path for providing signals to the output, coupling means for coupling signals from the first path to the second path, and delay means in at least one of the signal paths for delaying signals propagating therethrough;

junction means having a first input for receiving the control signal, a plurality of second inputs each of which is connected to the output of a wave transmission means, and a plurality of outputs each of which is connected to the input of a wave transmission means, the junction means providing outputs whose values are functions of the values of the control signal and the outputs of the wave transmission means, said control signal causing periodic signals to be generated and propagate in the wave transmission means; and musical tone extracting means for extracting a musical tone signal from at least one of the junction means and wave transmission means, wherein transmission characteristics of the wave transmission means and junction means determine the pitch of the tone signal.

34. A tone generation system as in claim 33 wherein the junction means includes adding means for adding the signals from the outputs of the wave transmission means to provide an addition signal, the junction means providing outputs whose values are functions of the control signal and the addition signal.

35. A tone generation system as in claim 34 wherein the junction means includes subtracting means for subtracting the addition signal from the control signal to obtain a subtraction signal, the junction means providing outputs whose values are functions of the subtraction signal.

36. A tone generation system as in claim 35 further including table means for providing an output from a predetermined table in response to the subtraction signal, the junction means providing outputs whose values are functions of the output from the table.

37. A tone generation system as in claim 36 further including plural output adding means each having an output to a wave transmission means, each adding means for adding the output from the table with the output of at least one wave transmission means other than the one to which the output of the respective output adding means is connected, the outputs of the output adding means forming the outputs of the junction means.

38. A tone generation system as in claim 33 wherein the coupling means includes means for inverting signals passing from the first signal path to the second signal path.

39. A tone generation system as in claim 33 wherein the coupling means includes means for low pass filtering signals passing therethrough.

40. A tone generation system as in claim 33 wherein the coupling means includes means for introducing a loss into signals passing therethrough.

41. A tone generation system as in claim 33 wherein there are two wave transmission means.

42. A tone generation system as in claim 41 wherein each wave transmission means provide a predetermined amount of delay in order to provide a desired frequency content in the musical tone signal.

43. A tone generation system as in claim 33 wherein the system simulates a bowed string instrument and wherein the control signal represents bow velocity.

44. A tone generation system as in claim 43 including means providing a control signal which varies with time to represent bow velocity.

45. A tone generation system as in claim 33 wherein the first and second wave transmission means provide a predetermined ratio of delay amounts.

46. A real time tone generation system comprising:

control means for providing a control signal for initiating and thereafter controlling generation of a tone;

at least first and second wave transmission means, each including an input and an output, a first signal path for receiving signals from the input, a second signal path for providing signals to the output, coupling means for coupling signals from the first path to the second path, and delay means in at least one of the signal paths for delaying signals propagating therethrough;

junction means, having a first input for receiving the control signal, a second input which is connected to the output of a wave transmission means, and an output which is connected to the input of a wave transmission means, the junction means providing an output signal whose value is a function of the values of the control signal and an output signal of a wave transmission means, said control signal causing a periodic signal to be generated and propagate in the wave transmission means; and musical tone extracting means for extracting a musical tone signal from at least one of the junction means and the wave transmission means, wherein transmission characteristics of the wave transmission means and junction means determine the pitch of the tone signal.

47. A tone generation system as in claim 46 wherein the junction means includes operating means for processing the signal at the second input as a function of the control signal to provide an operation result to the output of the junction means.

48. A tone generation system as in claim 47 wherein the operating means includes adding means for adding signals from the outputs of the first and second wave transmission means to provide an addition signal, the junction means providing at least one output signal whose value is a function of the control signal and the addition signal.

49. A tone generation system as in claim 48 wherein the operating means includes subtracting means for subtracting the addition signal from the control signal to obtain a subtraction signal, the junction means providing at least one output signal whose value is a function of the subtraction signal.

50. A real time tone generation system comprising:

control means for providing a control signal for initiating and thereafter controlling generation of a tone;

a plurality of wave transmission sections each having a first end and a second end, a first signal path for propagating signals from the first end to the second end and a second signal path for propagating signals from the second end to the first end, wherein each wave transmission section includes at least one delay element in at least one of its signal paths;

a first junction connected to the first end of a first wave transmission section, the first junction receiving at least the control signal and a signal from the second signal path and providing a signal to the first path which is a function of the received signals;

at least one additional junction, each connected to a first end of wave transmission section and a second end of another wave transmission section so as to interconnect the wave transmission sections in a cascade fashion, each additional junction receiving signals from the wave transmission sections connected to it and partially transmitting the signals from the wave transmission section to the other wave transmission section and partially reflecting the signals back to the wave transmission section from which the signals were received;

means connected to the second end of at last wave transmission section for at least partially coupling signals from the first signal path to the second signal path of the last wave transmission section; and means for extracting a signal from at least one point in the cascaded wave transmission section and junction combination to provide a musical tone signal which is created and propagated within the wave transmission sections in response to the control signal, where transmission characteristics of the wave transmission section and junction combination determine the pitch of the tone signal.

51. A tone generation system as in claim 50 including means for controlling the transmission and reflection characteristics of at least one additional junction to control the pitch of the musical tone signal.

52. A tone generation system as in claim 50 wherein at least one of the additional junctions includes at least three ports including a first port connected to an end of one waveguide, a second port connected to an end of another waveguide and a third port, each of at least two ports from among the three ports having an input path to the junction and an output path from the junction, wherein a signal received at the input path of any particular port is partially transmitted to the output paths of the other ports and is partially reflected to the output path of the particular port.

53. A tone generation system as in claim 50 wherein at least one delay element includes means for modifying a signal passing therethrough in addition to delaying the signal.

54. A tone generation system as in claim 53 wherein the means for modifying includes an all-pass filter.

55. A tone generation system as in claim 50 wherein at least one wave transmission section includes means for varying transmission characteristics with a lapse of time.

56. A tone generation system as in claim 55 wherein at least one wave transmission section includes gain control means for controlling gain in at least one of the first and second signal paths and the means for varying includes means for changing the gain of the gain control means over time.

57. A real time tone generation system comprising:

wave transmission means having a first end having an input and an output, wave transmission path means for receiving signals at the input and transmitting them to the output, the path means including delay means for delaying signals propagating in the path means, the delay means providing an amount of delay corresponding to the pitch of a tone to be generated.

control means for generating a performer-variable control signal for initiating and thereafter controlling generation of a tone;

junction means having a first input connected to the control means to receive the control signal, a second input connected to the output of the wave transmission means and an output connected to the input of the wave transmission means, wherein the signal at the output is a function of the values of the signals at the inputs and wherein a periodic signal is generated and propagated in the wave transmission means in response to the control signal; and output means for extracting a signal from at least one of the wave transmission means and junction means as a musical tone signal, said musical tone signal having a pitch corresponding to the amount of delay imparted by the delay means.

58. A real time tone generation system comprising:

means for providing at least first and second independently variable control signals, said first control signal having a value which is variable within a range including plural non-zero values in accordance with performance variation, said first control signal initiating and thereafter controlling generation of a tone;

wave transmission means for transmitting signals including an input and an output, a first signal path for receiving signals from the input, a second signal path for providing signals to the output, the first signal path being coupled to the second signal path, and delay means in at least one of the signals paths for delaying signals;

junction means, having a first input for receiving the first control signal, a second input for receiving the second control signal; a third input for receiving a signal from the output of the wave transmission means and an output for providing a signal as the input to the wave transmission means which is a function of the value of the first and second control signals and the value of the signal received from the output of the wave transmission means so as to cause a periodic signal to propagate in the wave transmission means; and nusical tone extracting means for extracting a musical tone signal from at least one of the wave transmission means and junction means, wherein transmission characteristics of the wave transmission means and junction means determine the pitch of the tone signal.

9. A tone generation system as in claim 58 wherein junction means includes conversion means for conting the signal from the second path to the signal ich is provided to the first path in accordance with a ıversion characteristic in switching means for select- the conversion characteristic in accordance with the ue of the first and second control signals.

0. A real time tone generation system comprising:

ontrol means for providing a control signal, the value of which is variable within a range including plural non-zero values in accordance with performance variation, for initiating and thereafter controlling generation of a tone;

wave transmission section having first and second ends, a first signal path for propagating signals from the first end to the second end, and a second signal path for propagating signals from the second end to the first end;

first junction connected to the second end of the wave transmission section, said first junction receiving a signal from the first path and transmitting signal to the second path;

vherein at least one of the first path, second path and first junction has at least one delay element therein;

second junction connected to the first end of the wave transmission section, said second junction receiving at least the control signal and a signal from the second path and providing a signal to the first path which is a function of said received signals, wherein a periodic wave signal is created in the wave transmission section as a result of the interaction of the control signal and the signal received from the second path; and an output for providing an output signal from at least one of the wave transmission section or junctions as a tone signal wherein the pitch of the tone signal is determined by transmission characteristics of the wave transmission section and junctions.

61. A real time tone generation system comprising:

means for providing a control signal for initiating and thereafter controlling generation of a tone, said means including memory means for storing control signal values and addressing means for addressing the memory means to provide a control signal value corresponding to a tone to be generated;

wave transmission means for transmitting wave signals, the wave transmission means including an input and an output, a first signal path for receiving signals from the input, a second signal path for providing signals to the output, the first signal path being coupled to the second signal path, and delay means in at least one of the signal paths for delaying signals;

junction means having a first input for receiving the control signal, a second input for receiving a signal from the output of the wave transmission means and an output for providing a signal as the input to the wave transmission means which is a function of at least the value of the control signal and the value of the signal received from the output of the wave transmission means so as to cause a tone signal to propagate in the wave transmission means, wherein transmission characteristics of the wave transmission means and junction means determines the pitch of the tone signal; and tone signal extracting means for extracting a tone signal from at least one of the wave transmission means and junction means.

* * * * *